US011504929B2

(12) United States Patent
Herron

(10) Patent No.: US 11,504,929 B2
(45) Date of Patent: Nov. 22, 2022

(54) CAN CRUSHER

(71) Applicant: Patrick D. Herron, Dunedin, FL (US)

(72) Inventor: Patrick D. Herron, Dunedin, FL (US)

( * ) Notice: Subject to any disclaimer, the term of this patent is extended or adjusted under 35 U.S.C. 154(b) by 0 days.

(21) Appl. No.: 17/128,508

(22) Filed: Dec. 21, 2020

(65) Prior Publication Data

US 2021/0221084 A1 Jul. 22, 2021

Related U.S. Application Data

(60) Provisional application No. 62/964,576, filed on Jan. 22, 2020.

(51) Int. Cl.

*B30B 9/32* (2006.01)
*B30B 15/04* (2006.01)
*B30B 1/04* (2006.01)

(52) U.S. Cl.

CPC ..... *B30B 9/321* (2013.01); *B30B 1/04* (2013.01); *B30B 15/04* (2013.01)

(58) Field of Classification Search

CPC ..... B30B 9/321; B30B 9/322; B30B 9/301; B30B 9/3078; B30B 9/3082; B30B 1/04; B30B 1/02; B30B 15/04; B30B 11/265; Y10S 100/902

USPC ..... 100/280, 902, 233

See application file for complete search history.

(56) References Cited

U.S. PATENT DOCUMENTS 2,466,907 A 5/1947 Nadolny et al.
3,667,386 A 6/1972 Workman
3,766,849 A 10/1973 Maron
3,901,141 A 8/1975 Bochmann
3,980,015 A * 9/1976 Woodard ..... B30B 9/323 100/902
4,212,242 A 7/1980 Willis
4,292,891 A 10/1981 Shelley
4,345,520 A 8/1982 Goldsmith et al.
4,387,637 A 6/1983 Baird
4,403,545 A 9/1983 Toburen et al.
4,976,196 A 12/1990 Phillips et al.
D335,617 S 5/1993 Scholl
5,249,689 A 10/1993 Wergeland et al.

(Continued)

FOREIGN PATENT DOCUMENTS

GB 2251395 A * 7/1992 ..... B02C 19/0081
WO WO-2019081429 A1 * 5/2019

OTHER PUBLICATIONS

Machine translation of WO-2019081429-A1 (Year: 2019).*

*Primary Examiner* — Shelley M Self
*Assistant Examiner* — Teresa A Guthrie
(74) *Attorney, Agent, or Firm* — Patrick Herron

(57) ABSTRACT

A can crusher (102), having: a backing plate (120); a left crush-arm (126) pivotally secured to the backing plate and having a left handle (130) and a left crush surface (128) that faces the backing plate when the can crusher is in a closed configuration (190); a right crush-arm (140) pivotally secured to the backing plate and having a right handle (144) and a right crush surface (142) that faces the backing plate when in the closed configuration; and a support plate (150). In a vertical orientation (152) the backing plate is oriented vertically; the support plate is disposed below horizontal sweeps (154, 156) of the crush surfaces; and the support plate supports a can in between the crush surfaces when the can crusher is in an open configuration (104).

19 Claims, 55 Drawing Sheets

(56) References Cited

U.S. PATENT DOCUMENTS 5,251,546 A * 10/1993 Wergeland ..... B30B 9/322
100/282
5,692,436 A 12/1997 Pishioneri

* cited by examiner

CAN CRUSHER

This application claims benefit of the Jan. 22, 2020 filing date of application 62/964,576 which is incorporated by reference herein.

FIELD OF THE INVENTION

The invention relates to a can crushing apparatus suitable for use where no mount is available or where the mount is not designed to withstand loads imposed by conventional can crushers.

BACKGROUND OF THE INVENTION

The majority of prior art can crushers operate by moving an arm, (often a single arm), through an arc during which leveraged force is applied to and crushes a can. The leveraged force applied to the can is transferred to a frame of the can crusher. The frame must then be mounted to a structure capable of providing a reactionary force that is sufficient to hold the frame in place. Often this structure is a wall or floor. In some prior art can crushers the frame is secured to a receptacle for crushed cans. However, the receptacle must, in turn, be supported by a wall, floor, or table etc. There are instances where a can crusher would provide benefit but there is no structure to which the can crusher can be mounted. There are also instances when such a structure is available, but a mounted can crusher would be obtrusive due to limited space. Hence, there is room in the art for improvement.

BRIEF DESCRIPTION OF THE DRAWINGS

The invention is explained in the following description in view of the drawings that show.

DETAILED DESCRIPTION OF THE INVENTION

The Inventor has created a unique and innovative can crushing apparatus which retains most or all of the force applied to the handles within the apparatus. This permits the crushing of a can without transferring force from the can crusher to a mount. This, in turn, eliminates the need to mount the can crusher to any object. Should the can crusher be secured to a mount, the mount can be much more fragile than possible using prior art devices because little to no force is transferred to the mount.

Figure 1:
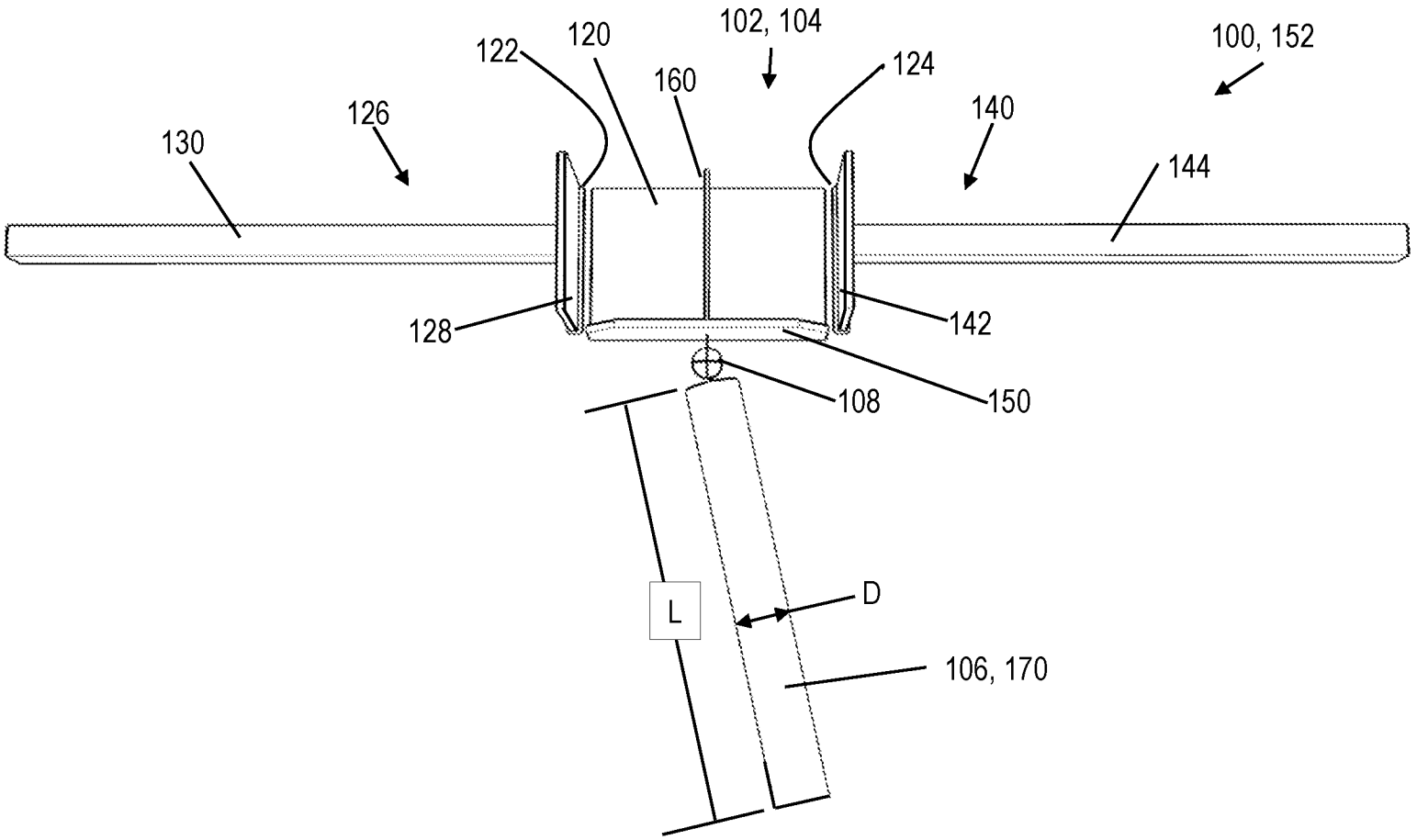
FIG. 1 is a front view of an embodiment of an apparatus having a can crusher in an open configuration.
Figure 2:
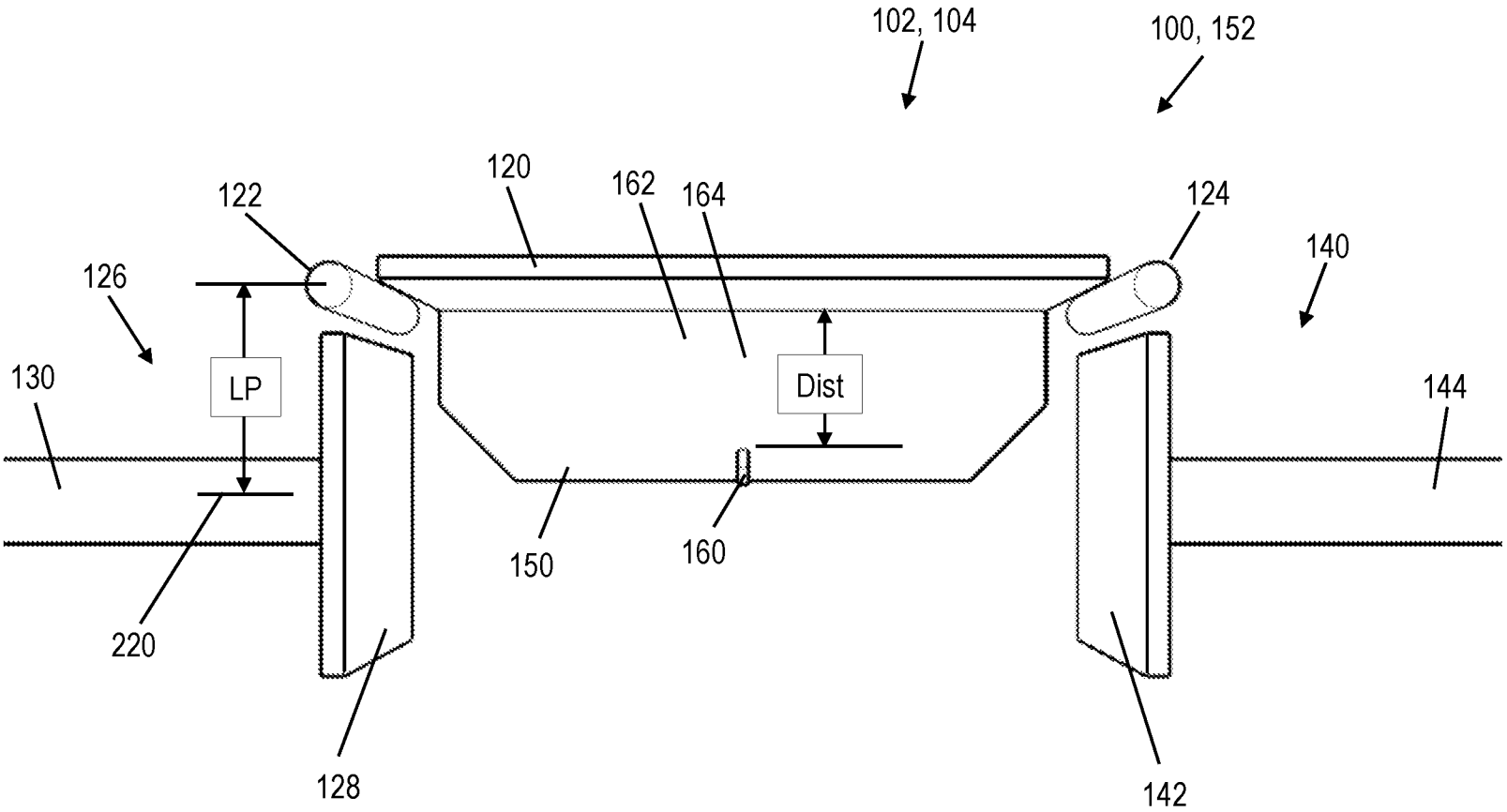
FIG. 2 is a top view of the apparatus of FIG. 1.
Figure 3:
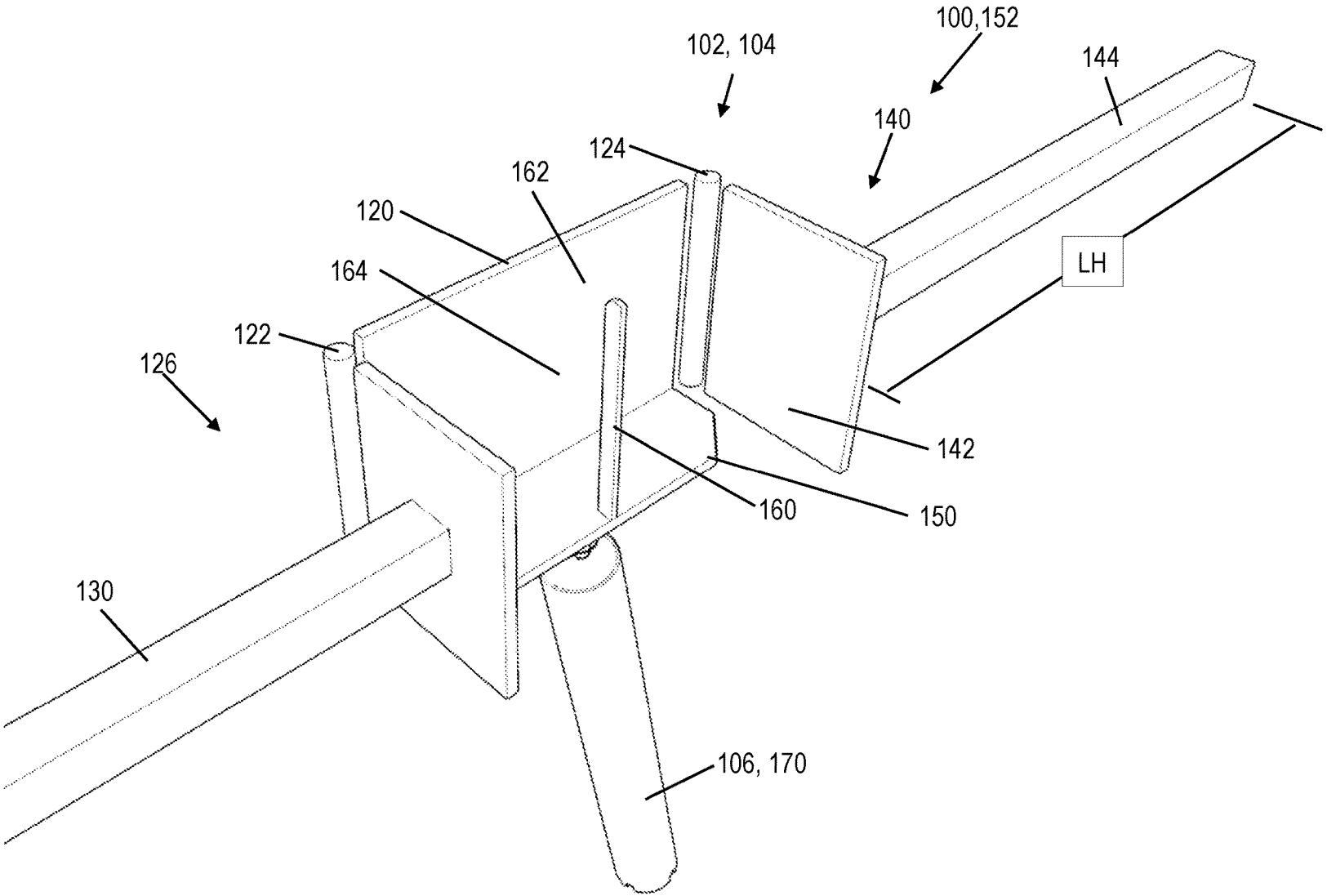
FIG. 3 is an elevated perspective view of a left side of the apparatus of FIG. 1.

FIGS. 1-5 show various views of an embodiment of an apparatus 100 having a can crusher 102 in an open configuration 104, an optional base 106, and an optional joint 108 between the can crusher 102 and the base 106. The can crusher 102 includes a backing plate 120, optionally a left hinge 122 secured to the backing plate 120, and optionally a right hinge 124 secured to the backing plate 120. The can crusher 102 also includes a left crush-arm 126 secured to the left hinge 122 and having a left crush surface 128 that faces the backing plate 120 when the can crusher 102 is in a closed configuration (not shown) and a left handle 130 that extends transverse relative to the left crush surface 128 when in the closed configuration. The can crusher 102 further includes a right crush-arm 140 secured to the right hinge 124 and having a right crush surface 142 that faces the backing plate 120 when in the closed configuration and a right handle 144 that extends transverse relative to the right crush surface 142 when in the closed configuration. Alternately, the left crush-arm 126 and the right crush-arm 140 may be directly pivotally secured to the backing plate 120. In the open configuration 104 the left crush surface 128 and the right crush surface 142 are disposed transverse to the backing plate 120 so the can is positionable therebetween, the left handle 130 extends to the left as shown in FIG. 1, and the right handle 144 extends to the right. This creates an access 162 through which a sideways-oriented can is lowered from above the can crusher 102 until reaching a crush position 164 between the backing plate 120 and a retaining pin 160.

The can crusher 102 includes a support plate 150. In the vertical orientation 152 shown in FIG. 1, the support plate 150 the backing plate 120, the left hinge 122, and the right hinge 124 are oriented vertically. In the vertical orientation 152, the support plate 150 is disposed below a horizontal sweep 154 of the left crush surface 128 and below a horizontal sweep 156 of the right crush surface 142. The support plate 150 is close enough to the sweeps 154, 156 to support a can (not shown) in between the left hinge 122 and the right hinge 124 in a position suitable for crushing the entire can. In an example embodiment, a distance between the sweeps 154, 156 and the support plate is less than a ¼ inch (0.25"). In an example embodiment, the distance is a $\frac{1}{8}^{th}$ of an inch (0.125"). In an example embodiment, the distance is a $\frac{1}{16}^{th}$ of an inch (0.0625").

When the can crusher 102 is in the vertical orientation 152, the retaining pin 160 extends vertically upward from the support plate 150, is outside the horizontal sweep 154 the left crush surface 128 and outside the horizontal sweep 156 the right crush surface 142, and is configured to trap the can between the retaining pin 160 and the backing plate 120. A distance "Dist" between the backing plate 120 and the retaining pin 160 (FIGS. 2 and 3) is selected to ensure a can is held therebetween. A common diameter for a standard twelve ounce (12 oz.) can is approximately 2 and ⅝ inches (2.625"). Hence, distance Dist may be 2.625". In an embodiment, distance Dist is less than 2.625". When a distance Dist of less than 2.625 is selected, the can must be bent (resulting in a bowtie shape) at least enough to fit between the retaining pin 160 and the backing plate 120. If bent just enough to squeeze the can between the retaining pin 160 and the backing plate 120, a resilience of the can will press the sides of the can against the retaining pin 160 and the backing plate 120. This, in turn, creates a frictional force that holds the can in place. This provides a benefit that once so held, an operator need no longer use his or her hands to hold the can in place. Instead, the user can move his or her hands to the handles without having the can fall out. This is particularly helpful in embodiments where the can crusher 102 is not mounted but is instead handheld. In handheld embodiments, the can crusher 102 is likely to be moved about in a manner that would otherwise cause the can to fall out. The retaining pin 160 may extend to be flush with a top of the backing plate 120, farther than flush with the backing plate 120, or below being flush with the backing plate 120. In an embodiment, the retaining pin 160 extends at least as far as half a diameter of a can. This ensures the retaining pin 160 at least reaches a height that coincides with the widest part of a sideways oriented can and sandwiches the widest part between the retaining pin 160 and the backing plate 120.

Moreover, this bend starts/ensures a folding process where the ends of the can will fold over. This is preferable to crushing the ends (i.e. reducing a diameter of the ends until flat) because the ends are already flat and they are more substantial. Folding the ends over takes less force than does crushing them and produces a very flat profile of the crushed can.

The crush surfaces 128, 142 may or may not be coated to protect from being scratched. The top of a can includes a ring that is thicker than the wall of the can, and therefore more resistant to being crushed. The top edge of this relatively thick ring becomes flush with the crush surface 128, 142 when being crushed. As such, all the force being exerted by the crush arm/crush surface is concentrated on the top edge of the upper ring, which also resists being crushed. This results in a significantly greater stress at the interface of the crush surface and the upper ring of the can during a crush than at other locations. The same thing occurs between the bottom of the can and the crush surface 128, 142, but to a lesser degree because the bottom of the can is not as thick. In contrast, the part of the can in contact with the backing plate 120 is flat and crushable/compliant, so there is less force and stress on the backing plate 120. The tendency of the crushing surfaces to scratch is great, which makes it difficult to prevent it. In an embodiment, the crush surfaces 128, 142 are treated or coated to protect from being scratched. For example, the crush surfaces 128, 142 may be Type II anodized or in particular, Type III hard anodized.

In another embodiment, the crush surfaces 128, 142, are left bare, or only coated with a wax or oil or the like for corrosion resistance purposes. It is understood that aluminum, for example, will likely be scratched/marred when crushing cans. However, the scratches will generally be out of sight because the crush surfaces 128, 142, are often out of sight. In addition, it is possible to dress the crush surfaces relatively quickly, and thereby return its appearance to almost new when the crush surface is bare metal. For example, a marred aluminum crush surface can be dressed/restored in a matter of minutes by applying a nylon wheel brush attachment for a drill (or the like) to the crush surfaces. Nylon wheel brush grits from 240 to 600 grit can be used, individually or successively, to restore a brushed finish to the crush surface that approaches the appearance of new. Given that scratches are likely to occur, this approach permits restoring the appearance of the crush surfaces to the user's tastes with what amounts to negligible costs and effort.

In an embodiment, the optional base 106 is an elongated base 170 configured to support the can crusher 102. The elongated base 170 includes a diameter "D" of not greater than two inches (2") and is configured to fit within and be held in place by a fishing rod holder (not shown). In an embodiment, the diameter D is 1½ inches (1.5").

Fishing rod holders, also known as "rocket launchers" are essentially cylindrically shaped receptacles configured to hold fishing rods. They are commonly used on boats where space is tight. They may be approximately ten inches (10") long and have in internal diameter of 1.625 inches. The structure may include a plastic sleeve inside a metal frame. A bottom of the rod holder may taper down slightly from a mid-diameter to the diameter "D" and an upper end may flare slightly from the mid-diameter. A cross pin may be placed inside at the bottom to provide a lower end stop and/or to provide an anchor that an item installed in the rod holder can use to prevent rotation of the item within the rod holder.

The rod holders may be welded to a cross bar, or they may be recessed into a transom and have a flange at an upper end that is screwed to the transom. In the former, the weld is between the mostly-vertical cylindrical rod holder and a cylindrical support that is oriented transverse to the rod holder. Cylinder-on-cylinder results in a small contact area and an associated small weld. Consequently, while the weld holding the two together is sufficiently strong to hold fishing rod, it is not designed to withstand the forces a can crusher frame would impart. Hence, a conventional can crusher may damage such a joint. In the latter, the flange is typically secured to the transom using screws. Here again, while the screws holding the flange to the transom is sufficiently strong to hold fishing rod, it is not designed to withstand the forces a can crusher frame would impart. The screws may simply pull out of the fiberglass transom and/or the fiberglass transom may fatigue and crack after repeated applications of force from the can crusher frame.

Figure 4:
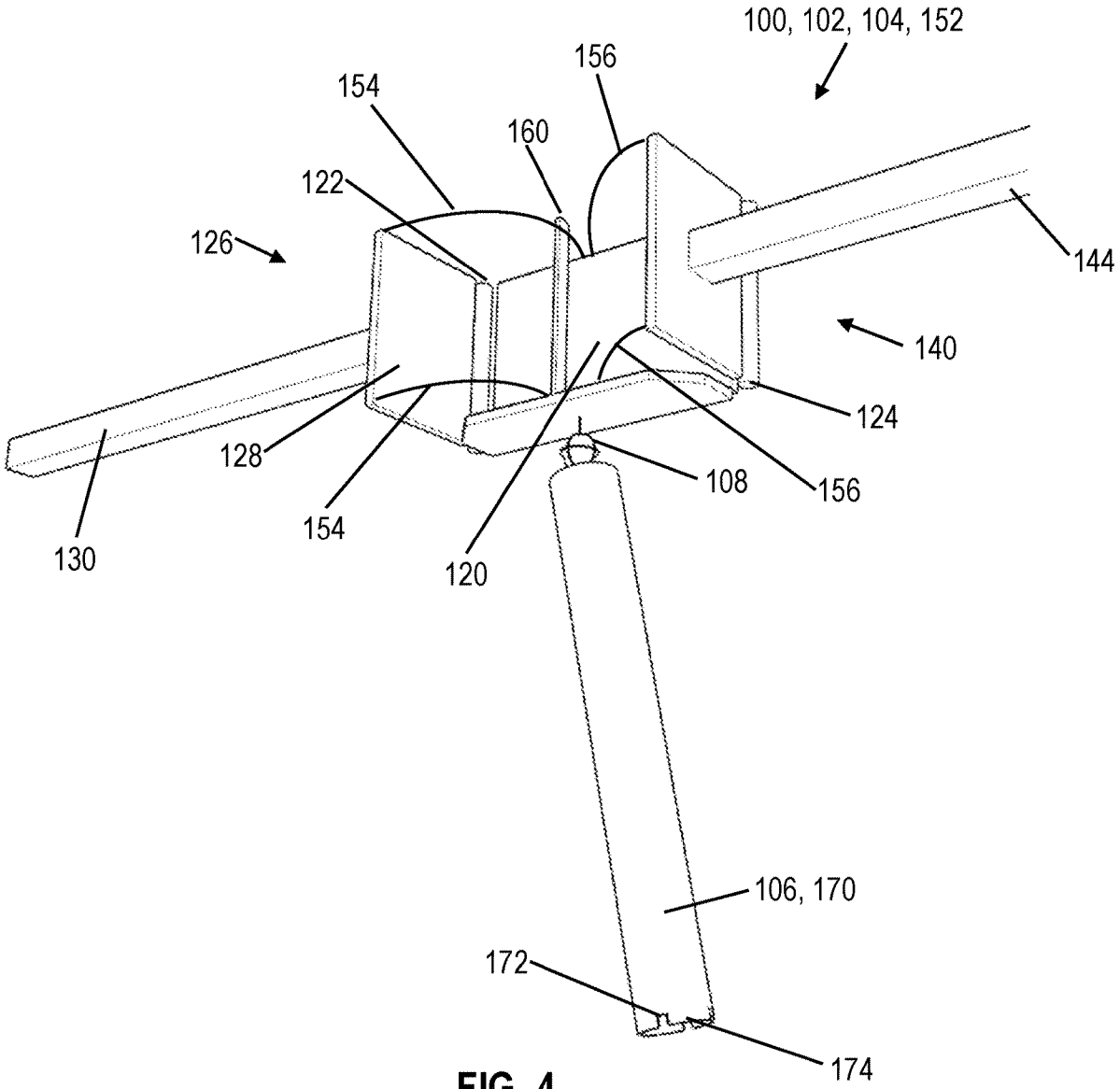
FIG. 4 is a perspective view from below of a right side of the apparatus of FIG. 1.
Figure 5:
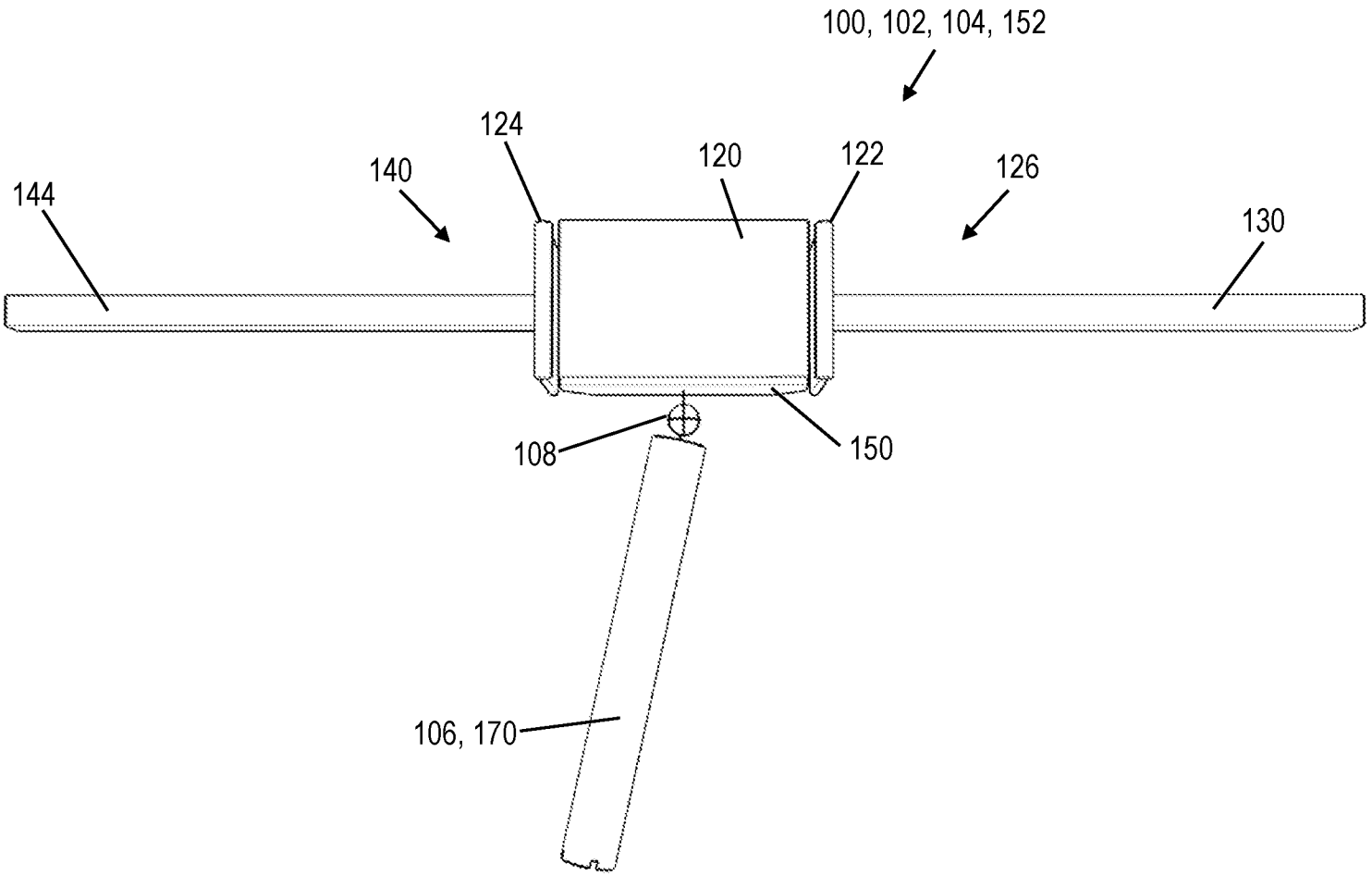
FIG. 5 is a rear view of the apparatus of FIG. 1.

As can be seen in FIG. 4, the horizontal sweep 154 of the left crush surface 128 and the horizontal sweep 156 of the right crush surface 142 are toward each other when crushing a can (as will be discussed further below). As a result, with respect to what the base 106 feels, forces applied to the left handle 130 and to the right handle 144 cancel each other out. No force or minimal forces transfer to the base 106. Consequently, no or minimal forces transfer to whatever the can crusher 102 is mounted. In the case of the elongated base 170 disposed in the rocket launcher, the weld or screws will feel virtually no force. Hence, there is no concern that the weld will break, screws will pull out, or fiberglass will be damaged etc. Moreover, if the can crusher is not mounted, one can still crush a can due to the motion of the left crush-arm 126 and the right crush-arm 140 and cancellation of forces resulting therefrom.

Since the can crusher 102 transfers minimal or no force, it can be mounted to nearly anything. For example, a post can be driven into the ground (dirt, sand etc.) and the can crusher 102 can be mounted thereon. The can crusher 102 can be mounted with the backing plate 120 facing a wall. The can crusher 102 can be mounted using a boat davit (not shown) where a female davit base is mounted to a boat and a male davit piece is connected to the can crusher 102. Mounting the can crusher 102 in this case is achieved by inserting the male davit part into the female davit base. The can crusher 102 can even be mounted in a drawer as will be discussed later.

With respect to the elongated base 170 for use with the rod holders, the diameter D may be constant along an entire length "L" of the elongated base 170. Alternately, the diameter may vary to more closely conform to a particular rock launcher's dimensions. The diameter D of 1.5" is commonly used for items intended to fit in a rod holder because it fits in the bottom end of most conventional can crushers. There may be recesses 172 disposed at a bottom edge 174 and configured to receive the cross pin of the rod holder.

The joint 108 may be any adjustable joint that permits adjustment of a position of the can crusher 102 relative to a position of the base 106/elongated base 170. Rod holders may be disposed at any angle. Common angles include approximately fifteen degrees (15°) from vertical. More than this may position fishing rods too close to heads of boat occupants. In an embodiment, the joint 108 may be a ball joint that can be adjusted and then locked into an adjusted position. Other joints are possible, such as a joint with one interface that provides one degree of rotation, or a joint that combines two interfaces disposed at ninety degrees (90°) to each other, where each interface provides one degree of rotation.

Figure 6:
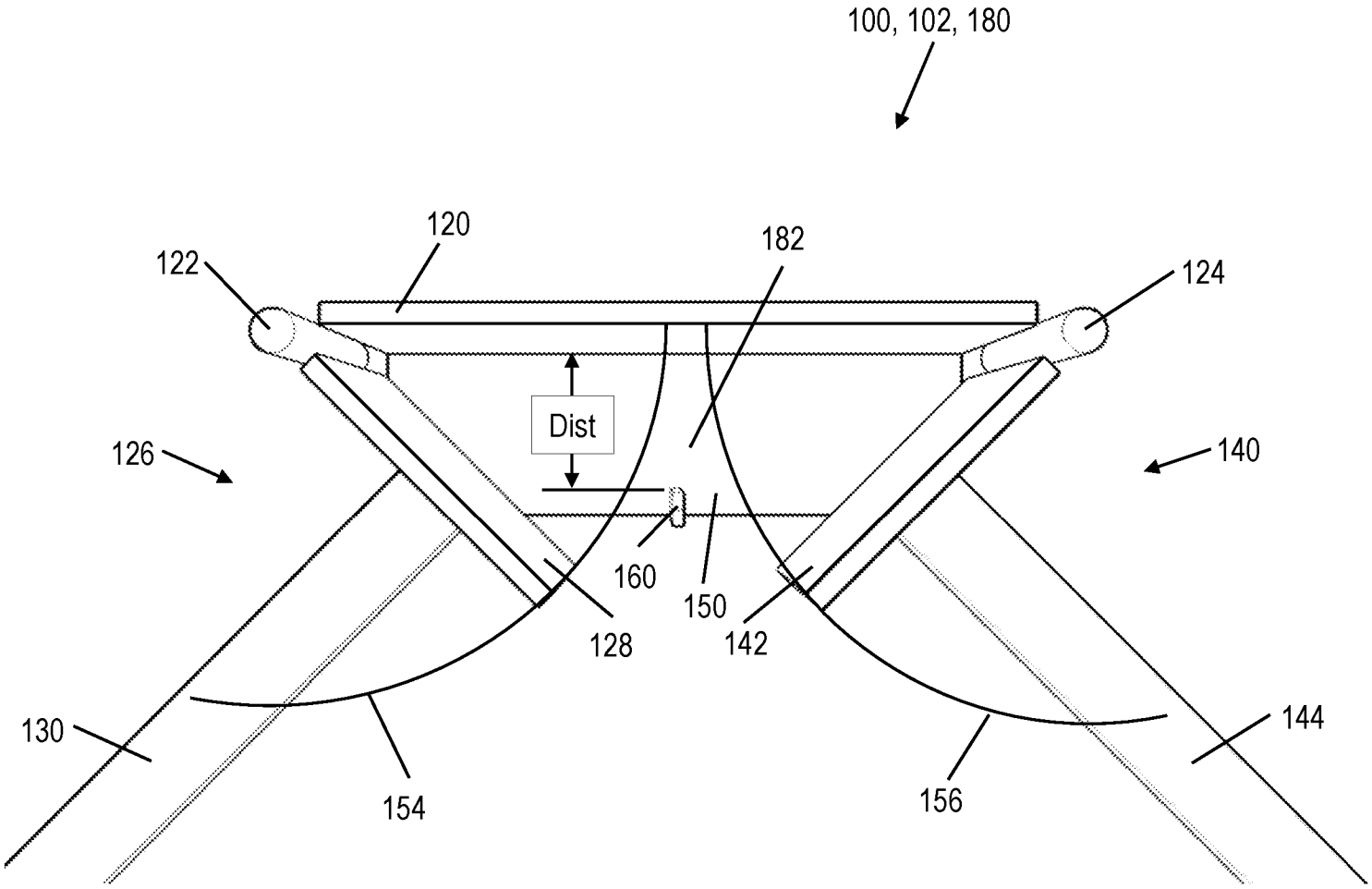
FIG. 6 is a top view of the can crusher of FIG. 1 in a semi-closed configuration.

FIG. 6 is a top view of the can crusher 102 of FIG. 1 in a semi-closed configuration 180. In this embodiment, the can crusher 102 does not have a base 106 or joint 108. The retaining pin 160 is well outside the horizontal sweeps 154, 156. The permits positioning of the retaining pin 160 anywhere in an area 182 between the horizontal sweeps 154, 156 and far enough apart from the backing plate 120 to permit a can to fit therebetween. Convenience of the operator may favor a greater distance Dist, whereas efficient folding may favor a smaller distance Dist.

Figure 7:
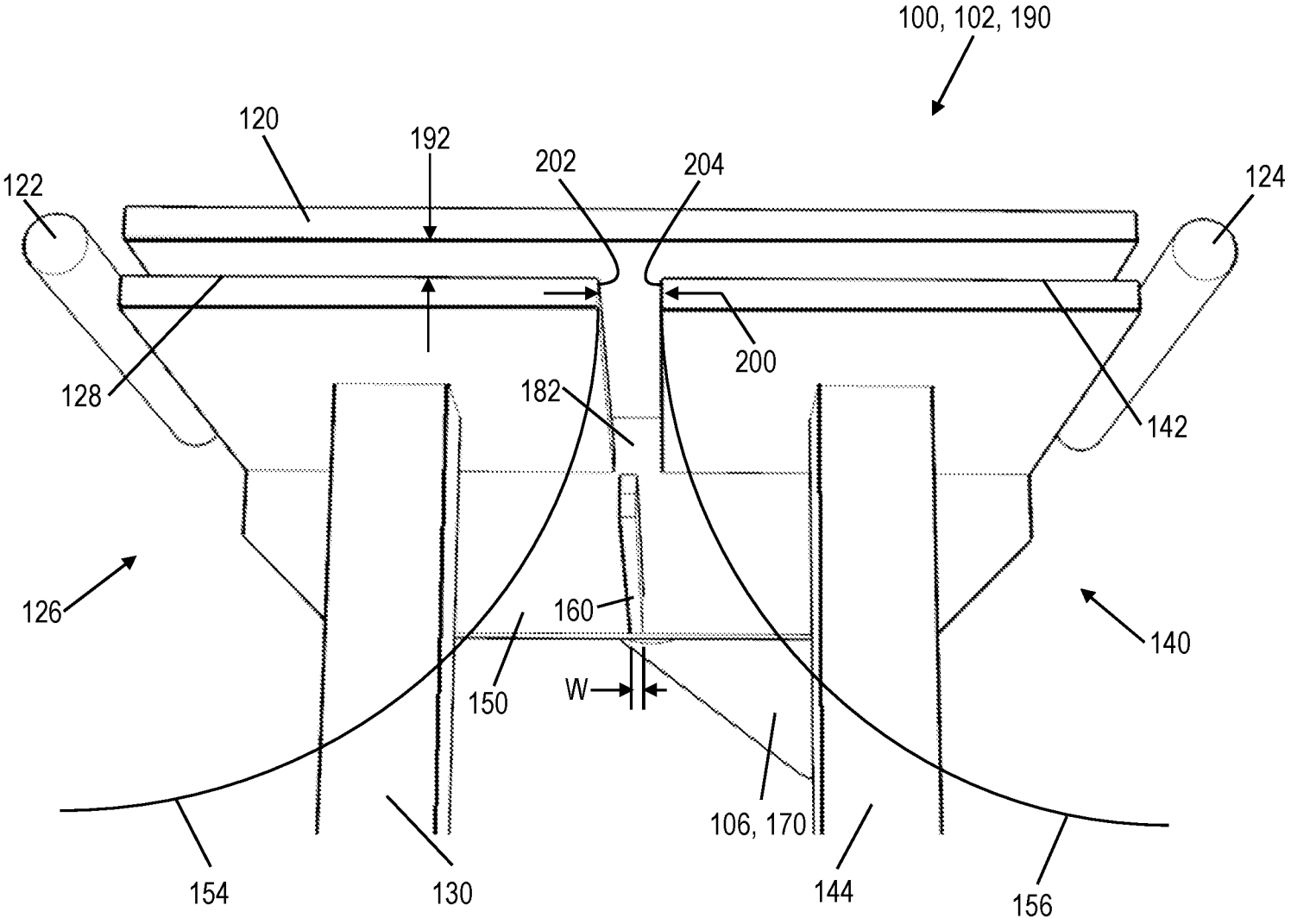
FIG. 7 is a top view of the can crusher of FIG. 1 in a closed configuration.

FIG. 7 is a top view of the can crusher 102 of FIG. 1 in the closed configuration 190 where the can is considered fully folded/crushed. When the crush surfaces 128, 142 are parallel to the backing plate 120, a can gap 192 is present in the closed configuration 190 to accommodate the crushed can. The can gap 192 can be any size suitable for a crushed/folded can. In example embodiments the can gap 192 is not less than 3/16 inch (0.188") and not greater than 5/16" or 3/8 inch (0.375"). In an example embodiment, the can gap is 1/4 inch (0.25") or less.

An edge gap 200 between immediately adjacent edges 202, 204 of the left crush surface 128 and the right crush surface 142 is selected to ensure a cylindrical center of the can crushes as the ends of the can fold over. This ensures the center of the crushed/folded can is not wider than the folded edges. In example embodiments less than one quarter inch (W). In embodiments where the edge gap 200 is larger than a width "W" of the retaining pin 160, then the area 182 extends between the immediately adjacent edges 202, 204 and the retaining pin 160 could be disposed even between the immediately adjacent edges 202, 204. However, in example embodiments, the edge gap is minimized to ensure adequate crushing. In example embodiments the edge gap 200 is less than one quarter inch (W). In example embodiments, the edge gap 200 is less than 1/16 of an inch (0.0625"). The edge gap 200 can be made as possible as the sweeps 154, 154 permit.

In an embodiment, the left crush surface 128 and the right crush surface 142 are within fifteen degrees (15°) of being parallel to the backing plate 120 in the closed configuration 190. In an embodiment, they are parallel. In an example embodiment, in the closed configuration 190 the handles 130, 144 extend transverse to the backing plate 120. In an example embodiment, in the closed configuration 190 the handles 130, 144 extend perpendicular to the backing plate 120 and parallel to each other.

Although shown as straight, the handles 130, 144 are not necessarily straight.

For example, the handles 130, 144 may have offsets at ends opposite the crushing surfaces 128, 142 so that in the closed configuration 190 an operator's hands do not touch each other while applying force. For example, in the closed configuration 190 the end of the left handle 130 opposite the crushing surface 128 may be offset to the left. Similarly, in the closed configuration 190 the end of the right handle 144 opposite the crushing surface 142 may be offset to the right. This creates a larger gap between those ends to accommodate an operator's hands.

Figure 8:
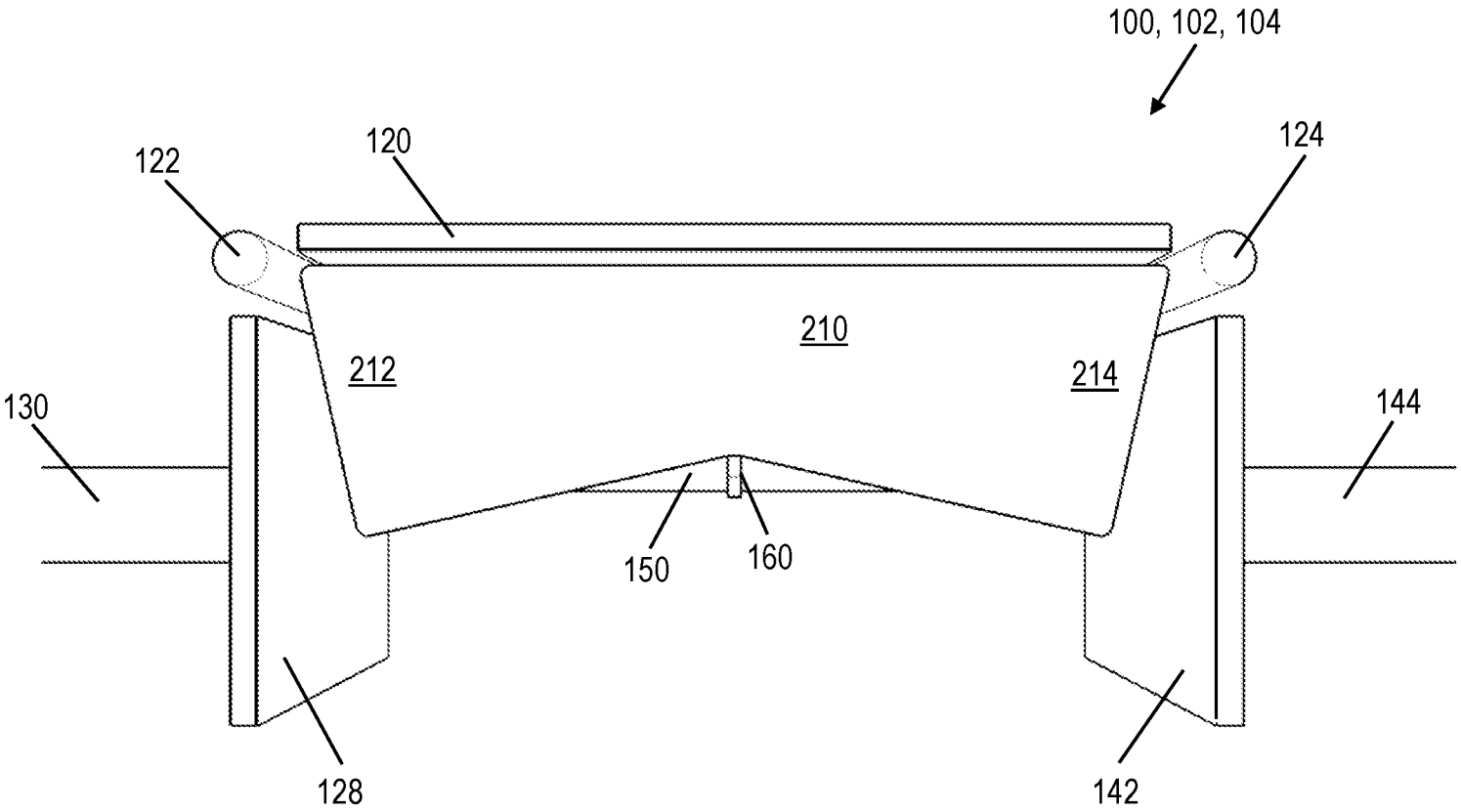
FIG. 8 is a top view of the can crusher of FIG. 1 in the open configuration and with a can disposed therein.

FIG. 8 is a top view of the can crusher 102 in the open configuration 104 and with a can 210 disposed therein. The retaining pin 160 is positioned with a distance Dist of less than 2.625" and the can 210 is a conventional twelve ounce can having a diameter of approximately 2.625". Accordingly, the can 210 is pre bent to fit between the retaining pin 160 and the backing plate 120. This holds the can 210 in position and begins the process where ends 212, 214 of the can 210 are folded.

Figure 9:
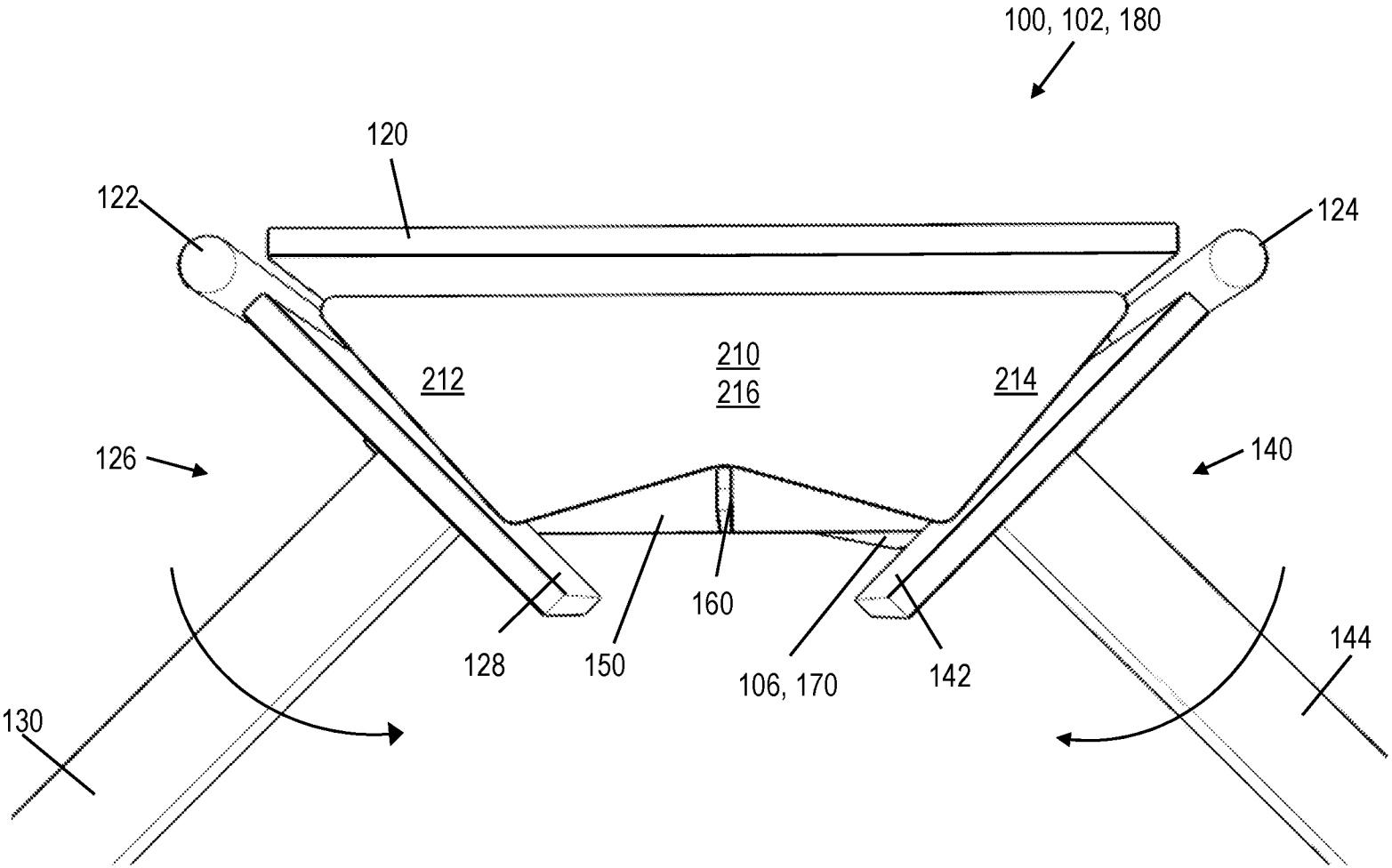
FIG. 9 is a top view of the can crusher of FIG. 1 in the semi-closed configuration and with the can disposed therein.

FIG. 9 is a top view of the can crusher 102 in the semi-closed configuration 180 and with the can 210 disposed therein. The left crush-arm 126 has been moved counterclockwise and the right crush arm 140 has been moved clockwise. This brings the left crush surface 128 and the right crush surface 142 to bear on the ends 212, 214 of the can 210 and begins to fold the ends 212, 214 over onto a center 216 of the can 210.

Figure 10:
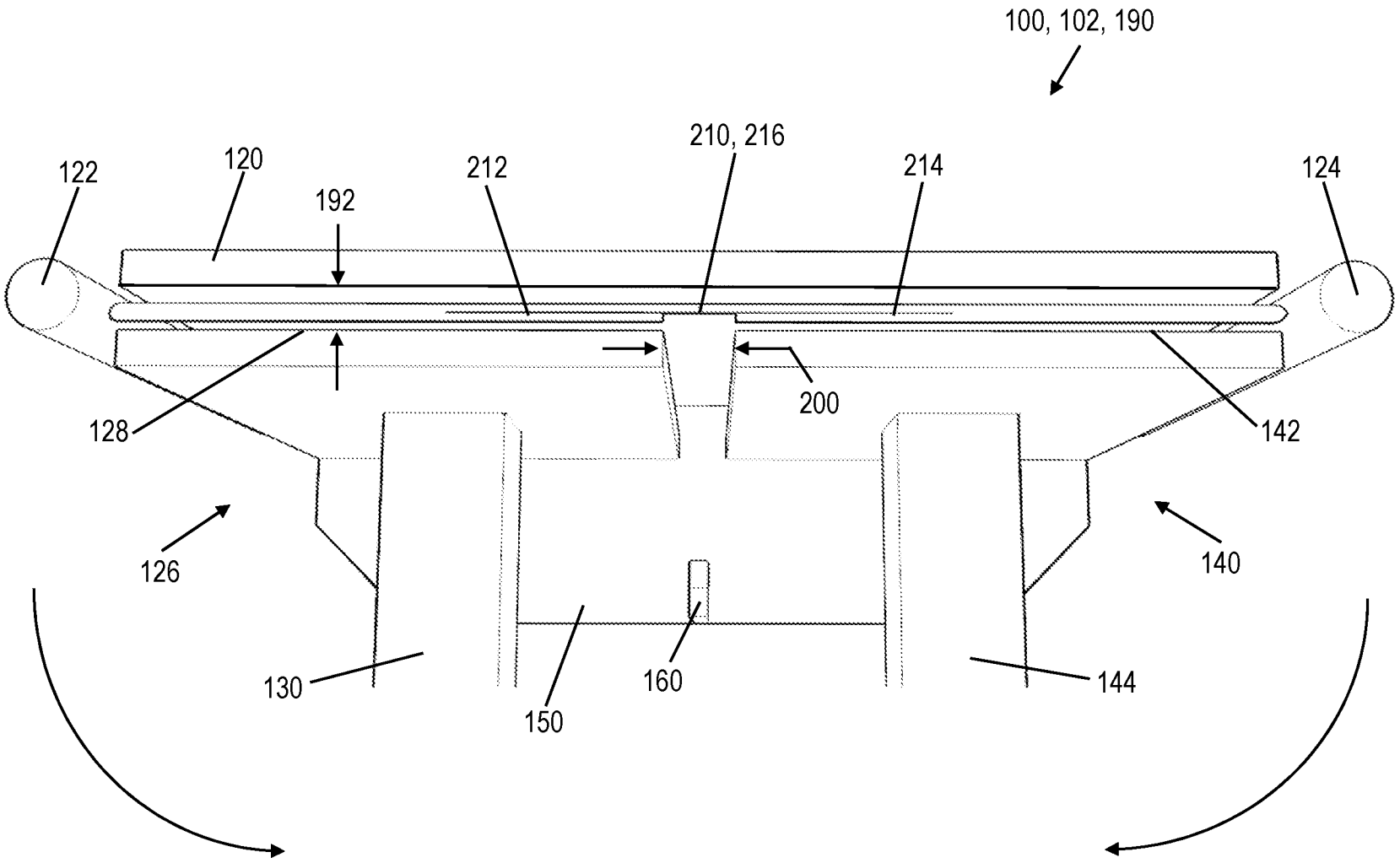
FIG. 10 is a top view of the can crusher of FIG. 1 in a closed configuration and with a can disposed therein.

FIG. 10 is a top view of the can crusher 102 in the closed configuration 190 and with the can 210 disposed therein.

The left crush-arm 126 has been moved farther counter-clockwise and the right crush arm 140 has been moved farther clockwise until the left crush surface 128 and the right crush surface 142 are sufficiently parallel to the backing plate 120 to fully fold/crush the ends 212, 214 onto the center 216 of the can 210. From here, the operator simply moves the handles 130, 144 toward the open configuration 104 and removes the crushed can 210.

Proper crushing requires a certain amount of force be applied to the can by the crush surfaces 128, 142. By pivoting the crush surfaces 128, 142 and the handles 130, 144 about the respective hinges 122, 124, force applied at the ends of the handles 130, 144 is magnified at the crush surfaces 128, 142. As the can is crushed, the force is transferred to the backing plate 120. This requires a certain structural rigidity of the can crusher 102. In example embodiments, the can crusher 102 may be made of metals such as steel, stainless steel, and/or aluminum. In other example embodiments, the can crusher 102 may be made of polymers such as plastics (e.g. ABS plastic), or composites such as carbon fiber reinforced polymers or fiberglass etc. In other example embodiments, components of the can crusher 102 may be made of various materials. For example, the crush surfaces may be a surface of a metal and other components may be another material such as a plastic. Further, a single component can be made of more than one material. For example, a crush surface may be of a metal while a remainder of the component having the crush surface may be another material. Any combination of these materials that enables crushing of a can is suitable.

Reinforcements may be applied strategically to permit the use of thinner backing plate material and material behind the crush surfaces 128, 142. For example, the support plate 150 may be connected to the bottom of the backing plate 120 to provide structural support to help keep the backing plate 120 from bending when crushing a can. Another horizontal support could be added to the back of the backing plate 120 at the top of the backing plate 120 to further strengthen the backing plate 120 against the folding/crushing forces that may work to bend the backing plate 120. In an embodiment, 3/16 inch (0.1875") plate may be used for the backing plate 120 and/or for the crush surfaces 128, 142. Hinges may use any suitably sized pin. In an example embodiment, the pin may be ¼ inch (0.25") or ⅜ inch (0.375") in diameter. Any length LH for the handle that generates sufficient force is suitable. In example embodiments, the length LH is from twelve inches (12") to twenty inches (20"). In an example embodiment, the length LH is eighteen inches (18"). Any pivot length LP between a center/pivot axis of a respective hinge and a longitudinal axis 220 of the handle may be suitable so long as the appropriate force is generated. In example embodiments, the pivot length is up to three inches (3"). In an example embodiment, the pivot length LP is two inches (2").

An example base 106 is a Levelock® All-Angle Fish Rod Holder Mount T10-355 manufactured by Magma USA of Lakewood Calif. However, any suitable mount can be used.

Figure 11:
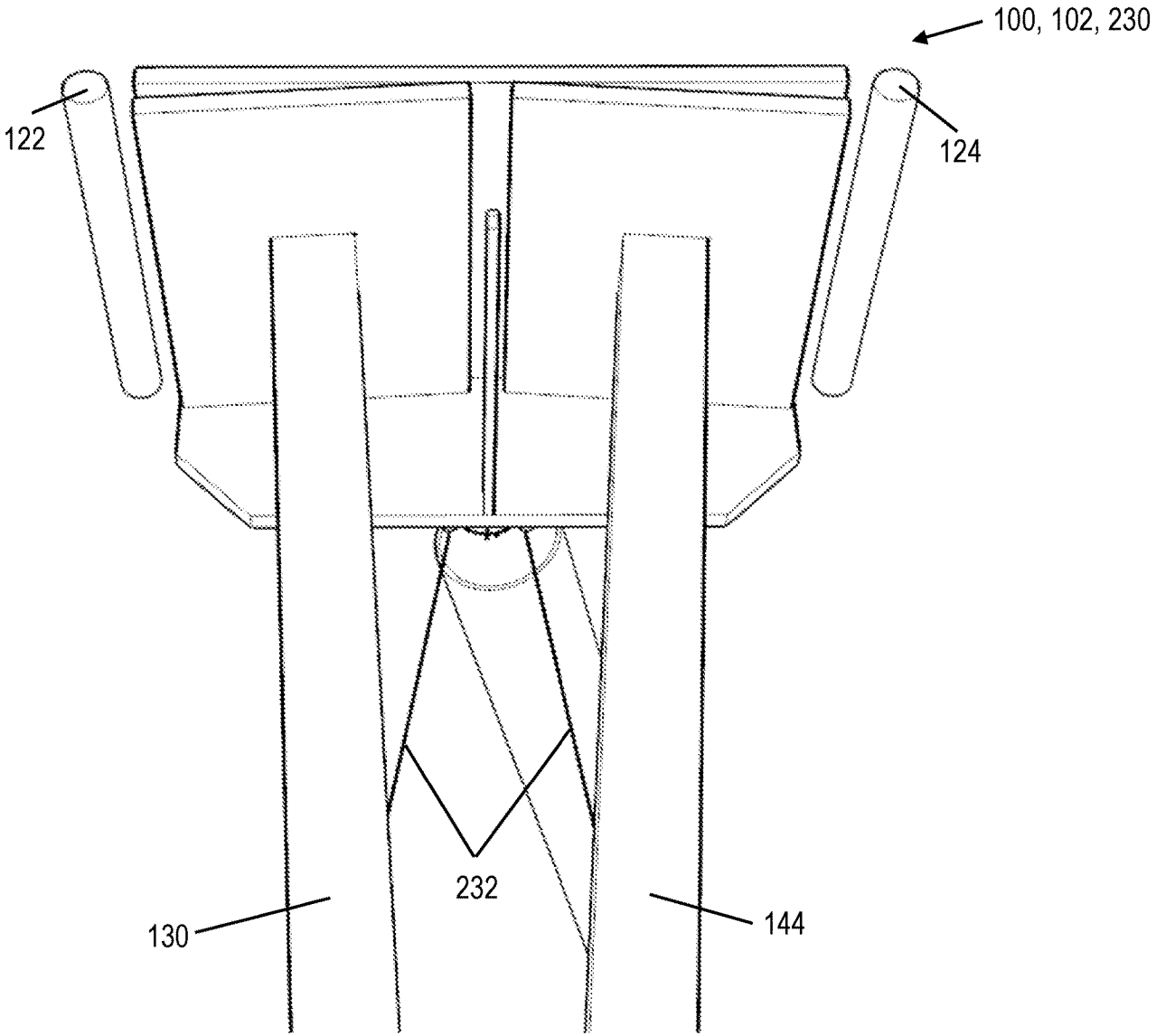
FIG. 11 is an elevated perspective view of the apparatus of FIG. 1 where the can crusher is in a stowed configuration.
Figure 12:
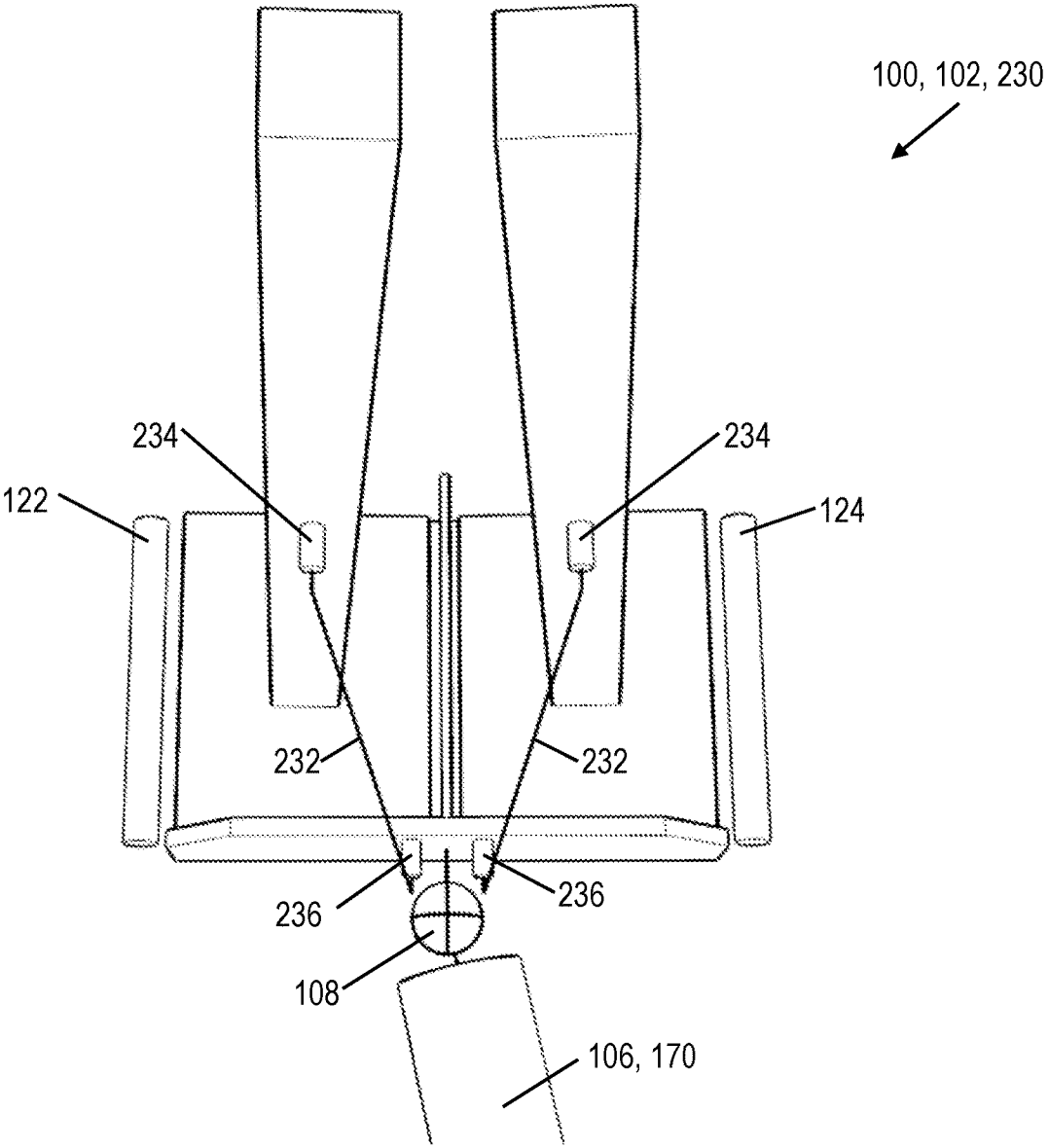
FIG. 12 is a perspective view from below of the apparatus of FIG. 1 where the can crusher is in the stowed configuration.

FIGS. 11 and 12 show the apparatus 100 of FIG. 1 where the can crusher 102 is in a stowed configuration 230. Here the left crush-arm 126 and the right crush-arm 140 have rotated past the closed configuration 190 because there is no can 210 present in the can gap 192. As such, in an example embodiment the left crush-arm 126 and the right crush-arm 140 converge toward each other. The artisan will recognize any number of ways that the stowed configuration 230 may be maintained. For example, in embodiments where ends of the left crush-arm 126 and the right crush-arm 140 contact each other, magnets could be disposed in the ends to secure the ends to each other. Straps, snaps, and hooks etc. could also be used. In an example embodiment, resilient elements 232 are connected between handle mounts 234 and support plate mounts 236. The resilient elements 232 (e.g. coil springs, bungee cords etc.) may be selected to be strong enough to maintain the stowed configuration 230, but resilient enough to permit an operator to open the left crush-arm 126 and the right crush-arm 140 to the open configuration 104 and crush a can. Such an arrangement permits stowing and unstowing without having to engage and/or disengage any straps, snaps, and/or hooks etc. Moreover, the rotation of the left crush-arm 126 and the right crush-arm 140 past the closed configuration 190 better positions the resilient elements 232 to hold the left crush-arm 126 and the right crush-arm 140 in the stowed configuration.

Figure 13:
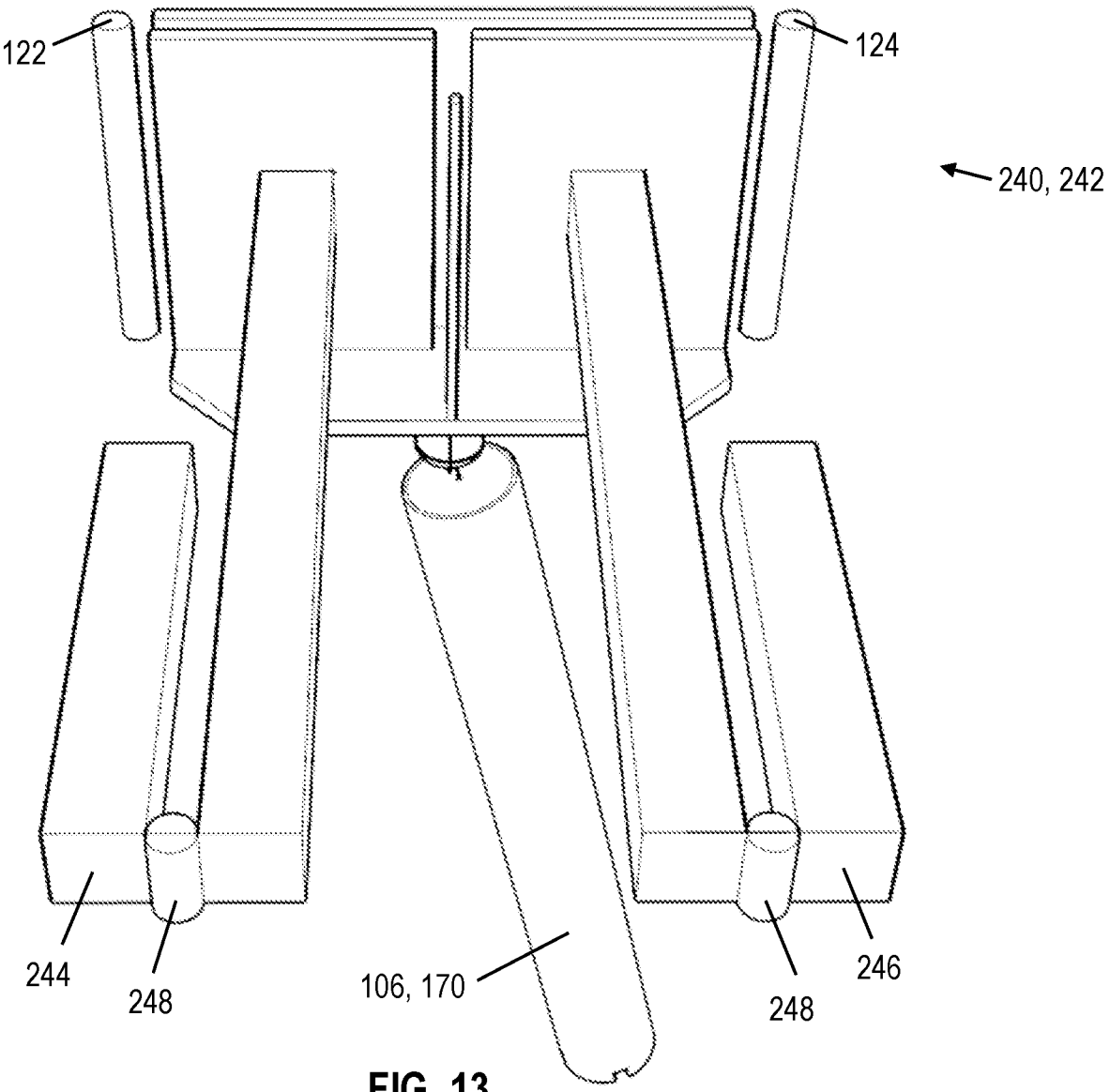
FIG. 13 is a perspective view of an alternate embodiment of the apparatus where the can crusher has folding handles.

FIG. 13 is a perspective view of an alternate embodiment of the apparatus 240 where the can crusher 242 a folding left handle 244 and a folding right handle 246. Hinges 248 may enable this folding feature. The shorter handles 244, 246 offer the clear benefit of taking up less space when not being used.

Figure 14:
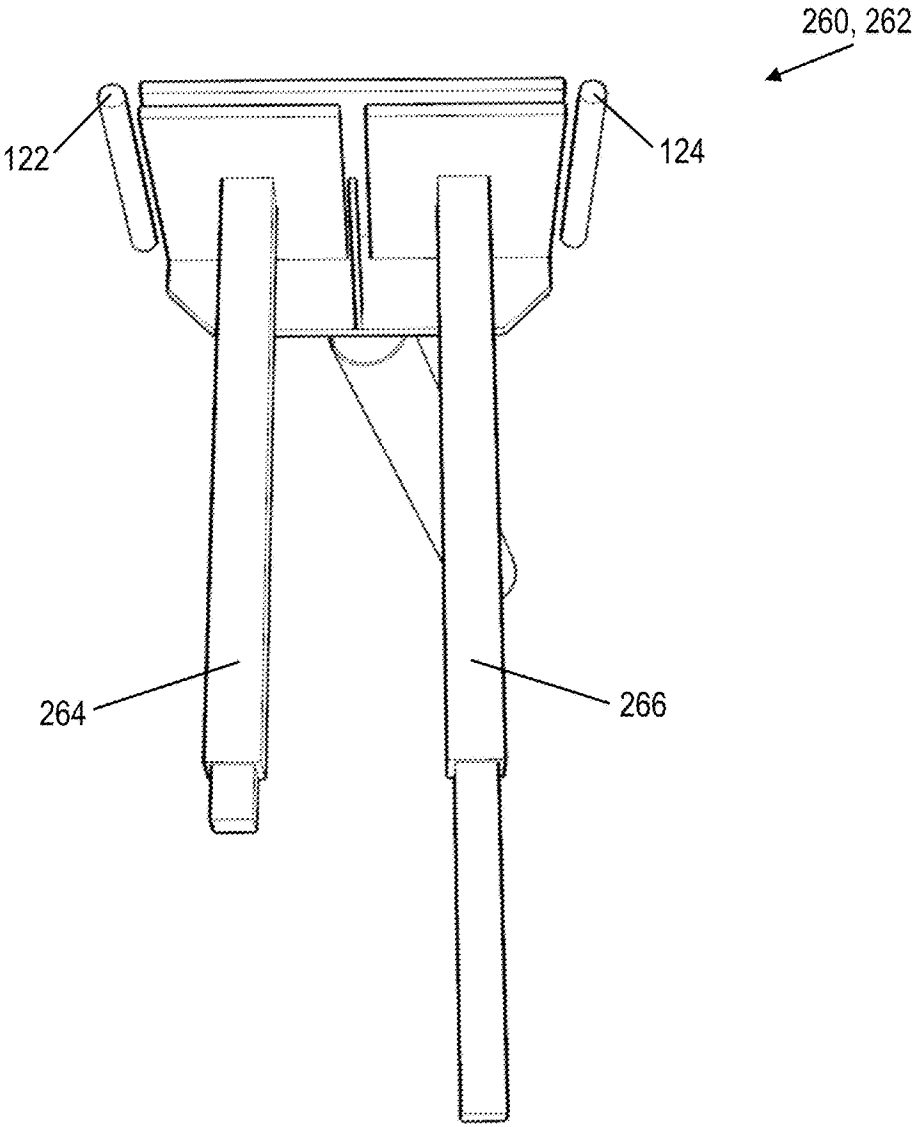
FIG. 14 is a perspective view of another alternate embodiment of the apparatus where the can crusher has telescoping handles.

FIG. 14 is a perspective view of another alternate embodiment of the apparatus 260 where the can crusher 262 has a telescoping left handle 264 (shown stowed) and a telescoping right handle 266 (shown deployed). The shorter handles 264, 266 also offer the clear benefit of taking up less space when not being used.

Figure 15:
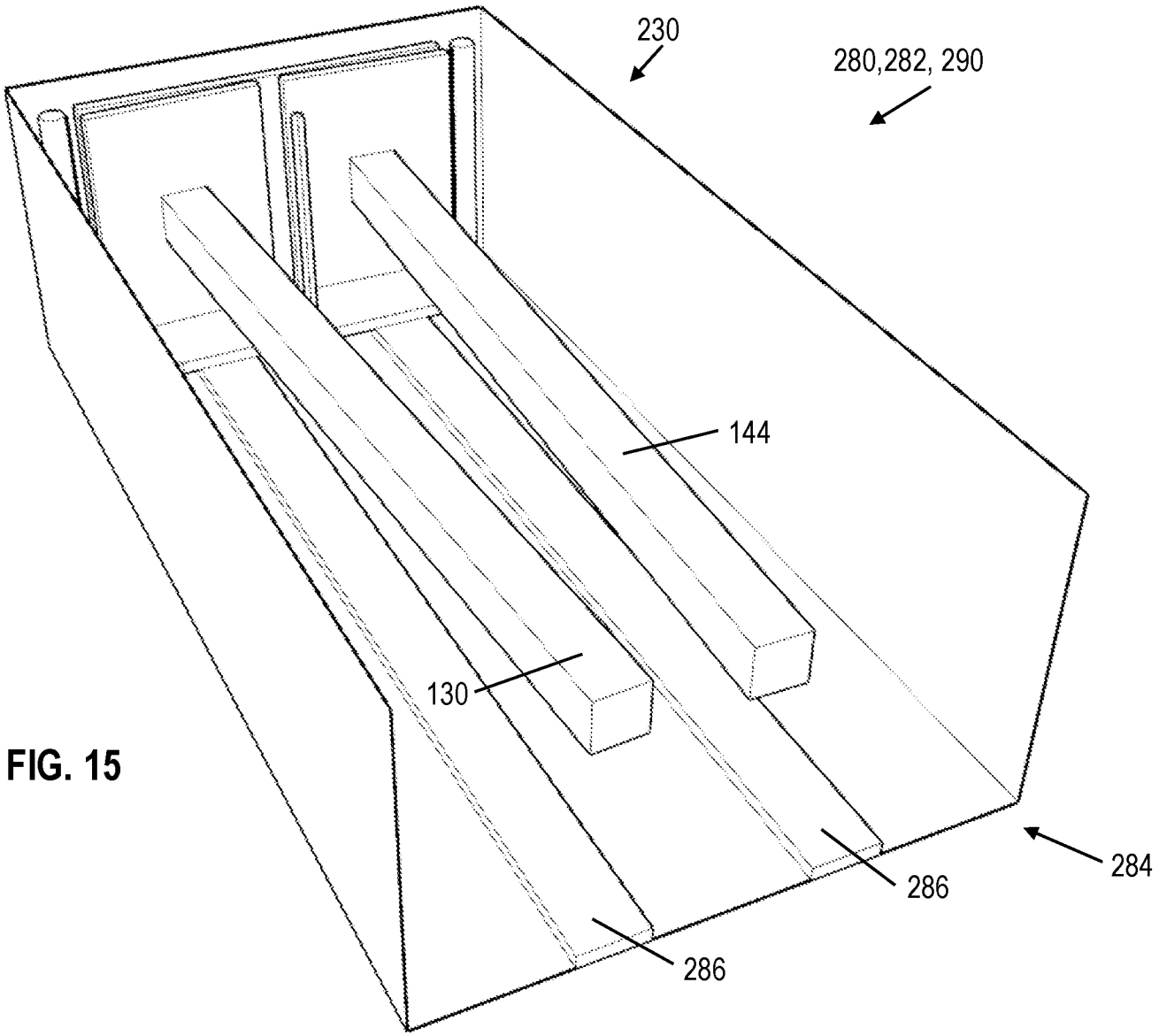
FIG. 15 is a perspective view of an alternate embodiment of the apparatus where the can crusher is stowed in a drawer.
Figure 16:
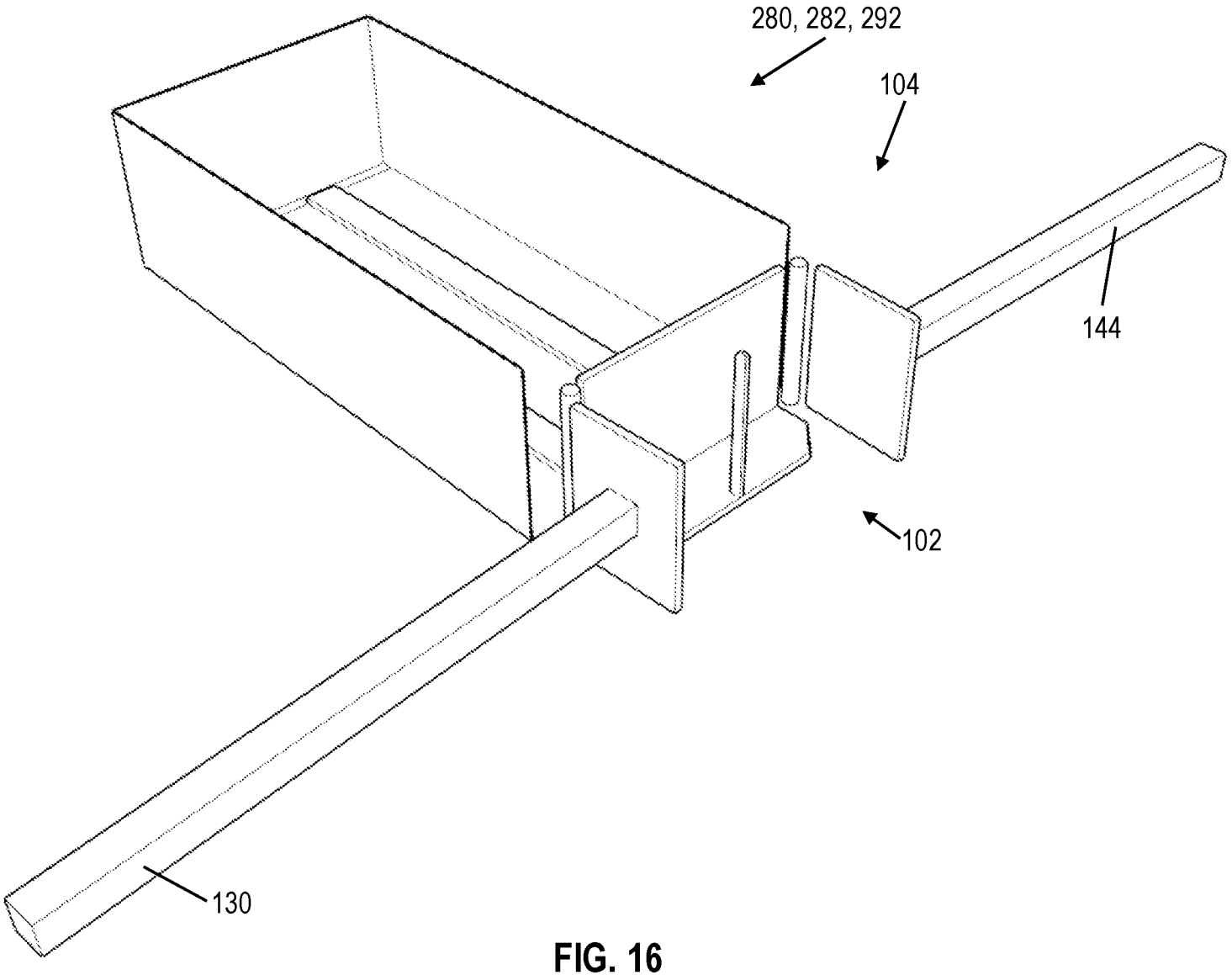
FIG. 16 is a perspective view of the alternate embodiment of the apparatus of FIG. 15 where the can crusher is in an extended position outside the drawer.

FIGS. 15-16 show an alternate embodiment of the apparatus 280 where the can crusher 282 is stowable in a drawer 284. The drawer 284 is shown schematically to have a bottom and sides, but could also include a top and/or a front. Such a drawer could be installed in any place a regular storage drawer could be installed. For example, the drawer 284 could be installed under a seat in leaning post of a center console boat, or in a portable cooler.

The can crusher 282 may simply be placed freely inside of the drawer 284. Alternately, the can crusher 282 may be secured to the drawer 284 via extendable and retractable tracks 286. The tracks 286 enable the can crusher 282 to be moved from a retracted position 290 (FIG. 15) where the can crusher 280 fits entirely within the drawer 284 in the closed configuration 190 (or the stowed configuration 230) and an extended position 292 (FIG. 16) where the can crusher 282 can be cycled between the closed configuration 190 (or the stowed configuration 230) and the open configuration 104. Hence, the can crusher 282 could be stored in the drawer 284 and out of sight until wanted. Then, the can crusher 282 can be moved out and cycled to crush cans, after which the can crusher 282 can simply be put away again.

Figure 17:
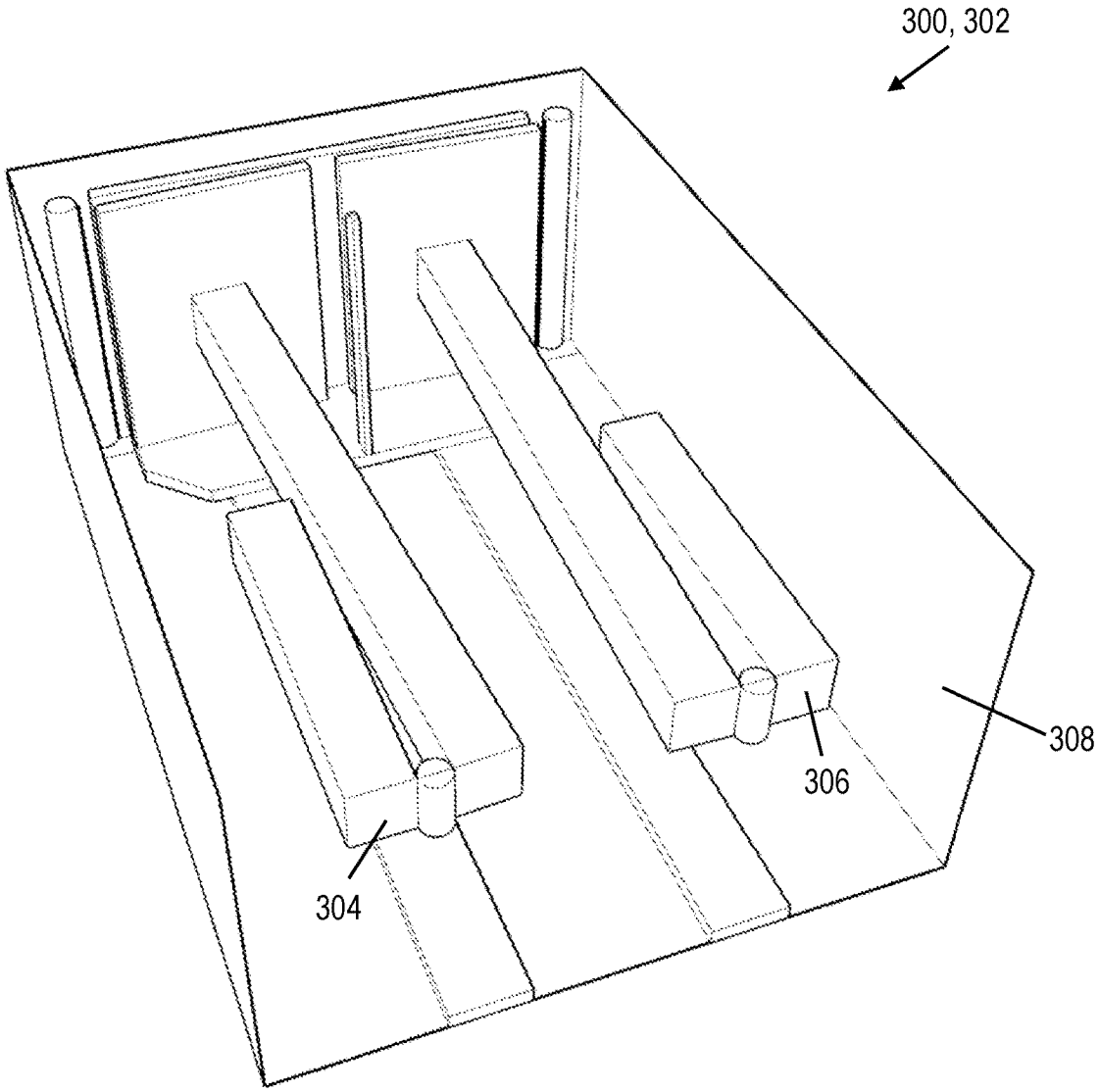
FIG. 17 is a perspective view of an alternate embodiment of the apparatus where the can crusher has folding handles and is disposed in the drawer.

FIG. 17 is a perspective view of an alternate embodiment of the apparatus 300 where the can crusher 302 has folding handles 304, 306 and is disposed in the drawer 308. Since the folding handles 304, 306 take up less space, the drawer 308 can be shorter and likewise take up less space.

Figure 18:
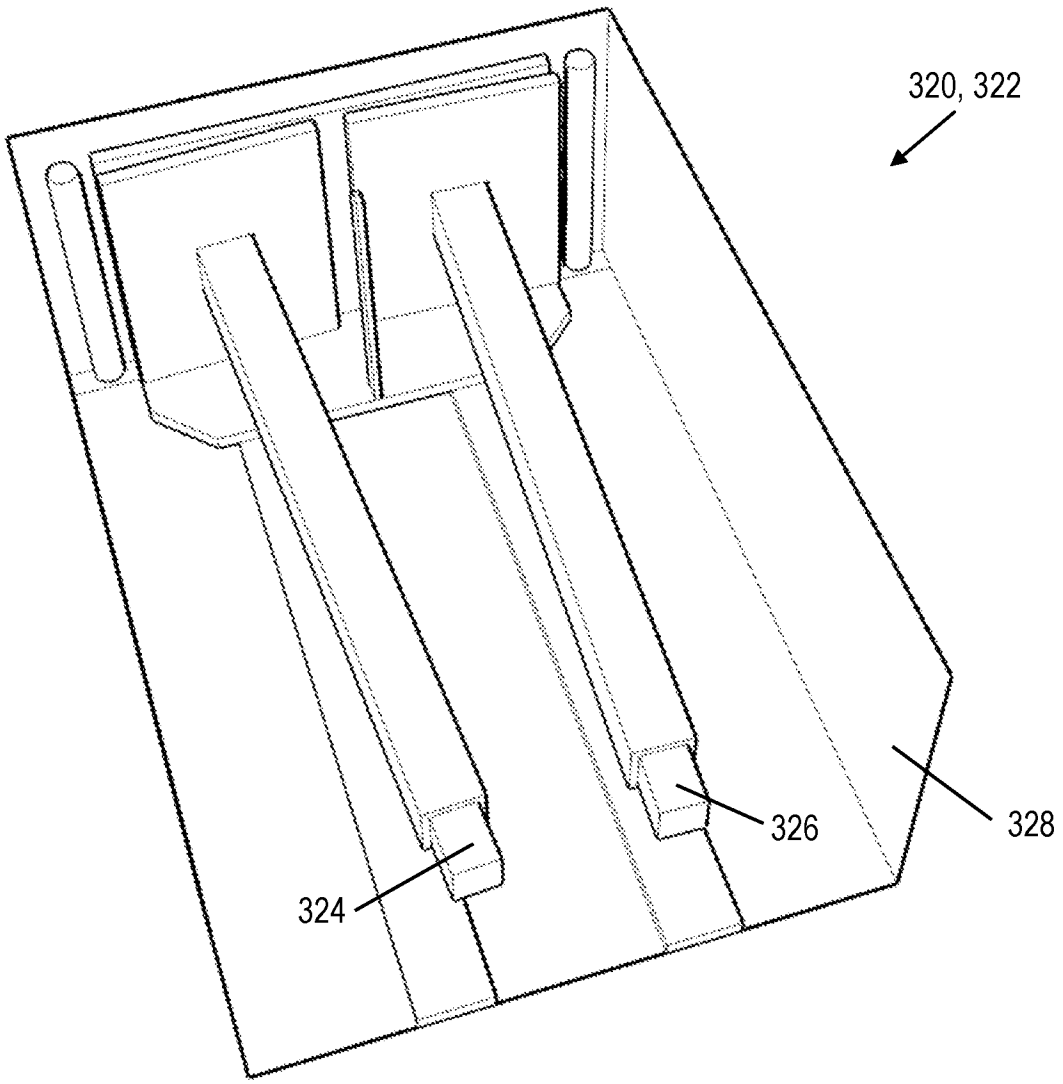
FIG. 18 is a perspective view of an alternate embodiment of the apparatus where the can crusher has telescoping handles and is disposed in the drawer.
Figure 19:
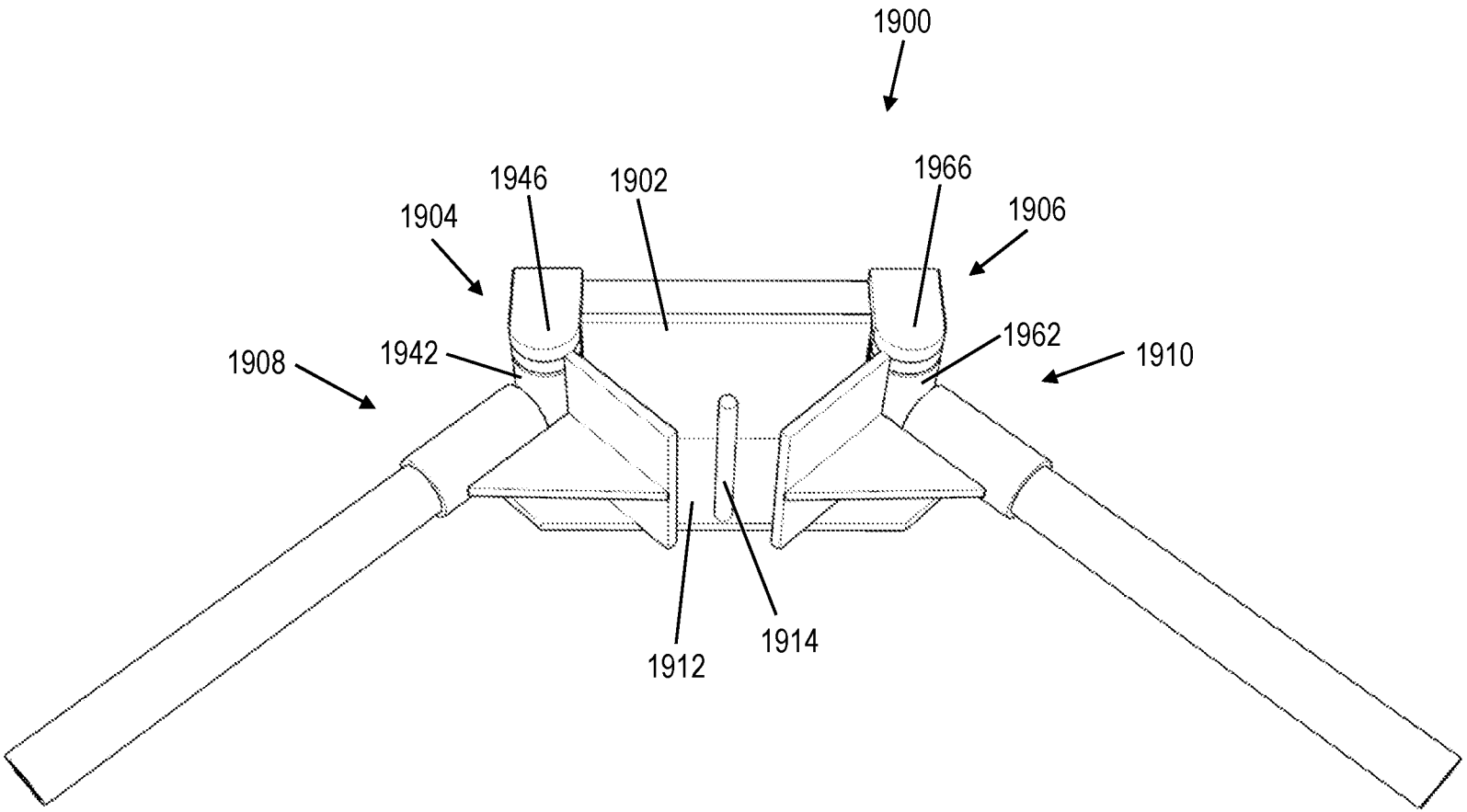
FIG. 19 to FIG. 23 show an alternate example embodiment of the can crusher.
Figure 20:
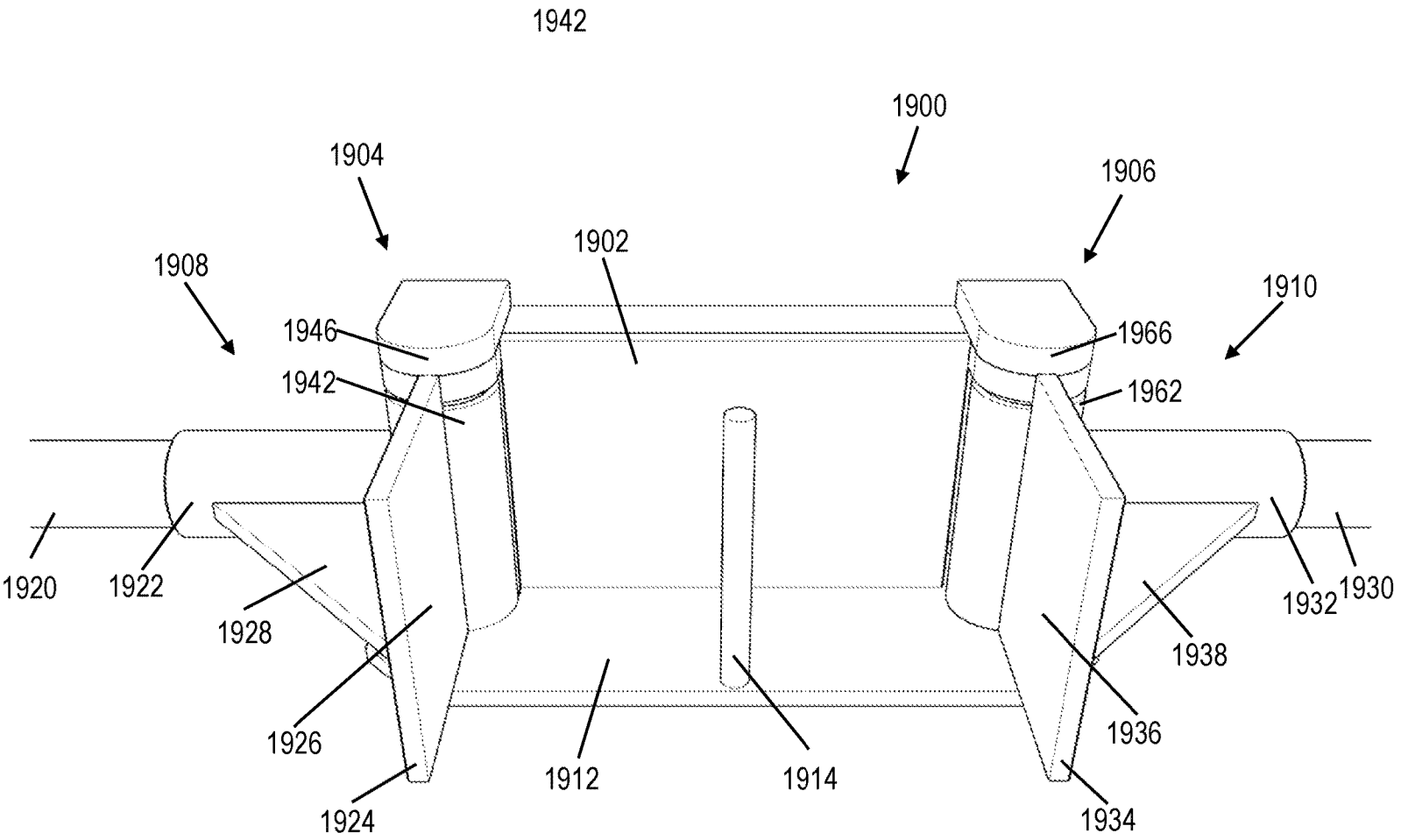
Figure 21:
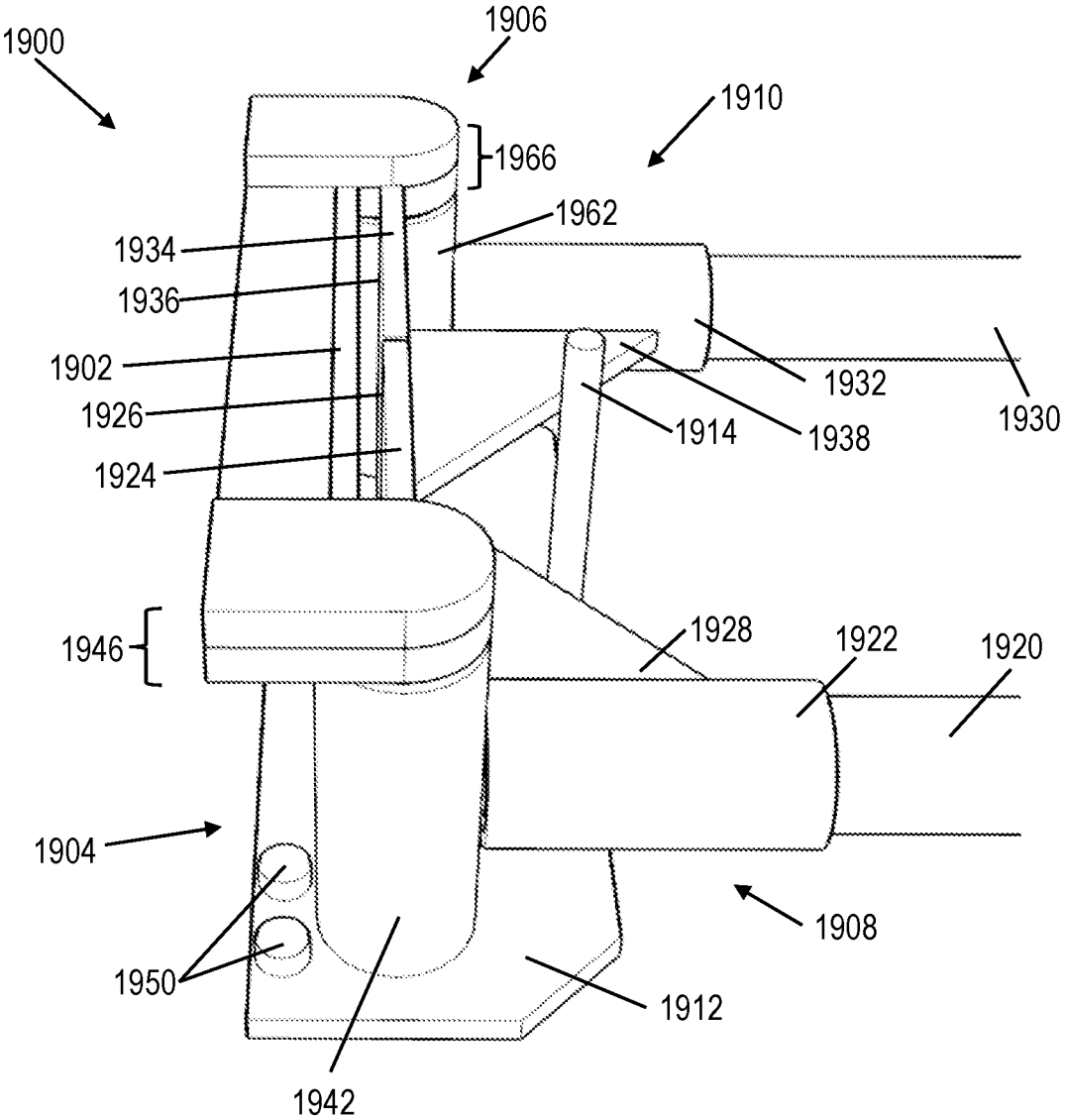

FIG. 18 is a perspective view of an alternate embodiment of the apparatus 320 where the can crusher 322 has telescoping handles 324, 326 and is disposed in the drawer 328. Since the telescoping handles 324, 326 take up less space, the drawer 328 can be shorter and likewise take up less space.

FIG. 19 to FIG. 23 show an example embodiment of the can crusher 1900. This and all example embodiments disclosed herein operate under the same principles as disclosed above and are likewise configured to be mounted to a suitable base as disclosed above. The can crusher 1900 includes a backing plate 1902, a left pivot joint 1904, a right pivot joint 1906, a left crush-arm 1908, a right crush arm 1910, a support plate 1912, and a retaining pin 1914. The left crush arm 1908 includes a left handle 1920 with an optional reinforcing tube 1922, a left flap 1924 having a left crush surface 1926, and an optional left gusset 1928. The right crush arm 1910 includes a right handle 1930 with an optional reinforcing tube 1932, a right flap 1934 having a right crush surface 1936, and an optional right gusset 1938.

The left pivot joint 1904 includes a left pin 1940 and a left outer tube 1942 that is disposed concentrically around the left pin 1940. The left pin 1940 is held in place via a support plate hole 1944 in the support plate 1912, a countersunk upper bracket hole (not visible) in a left upper bracket 1946, and a lower left bracket 1948 that is secured to the left pin 1940 and is, in turn, secured to the support plate 1912 via fasteners 1950.

The right pivot joint 1906 includes a right pin 1960 and a right outer tube 1962 that is disposed concentrically around the right pin 1960. The right pin 1960 is held in place via a support plate hole 1964 in the support plate 1912, a countersunk upper bracket hole (not visible) in a right upper bracket 1966, and a lower right bracket 1968 that is secured to the right pin 1960 and is, in turn, secured to the support plate 1912 via fasteners 1970.

Figure 22:
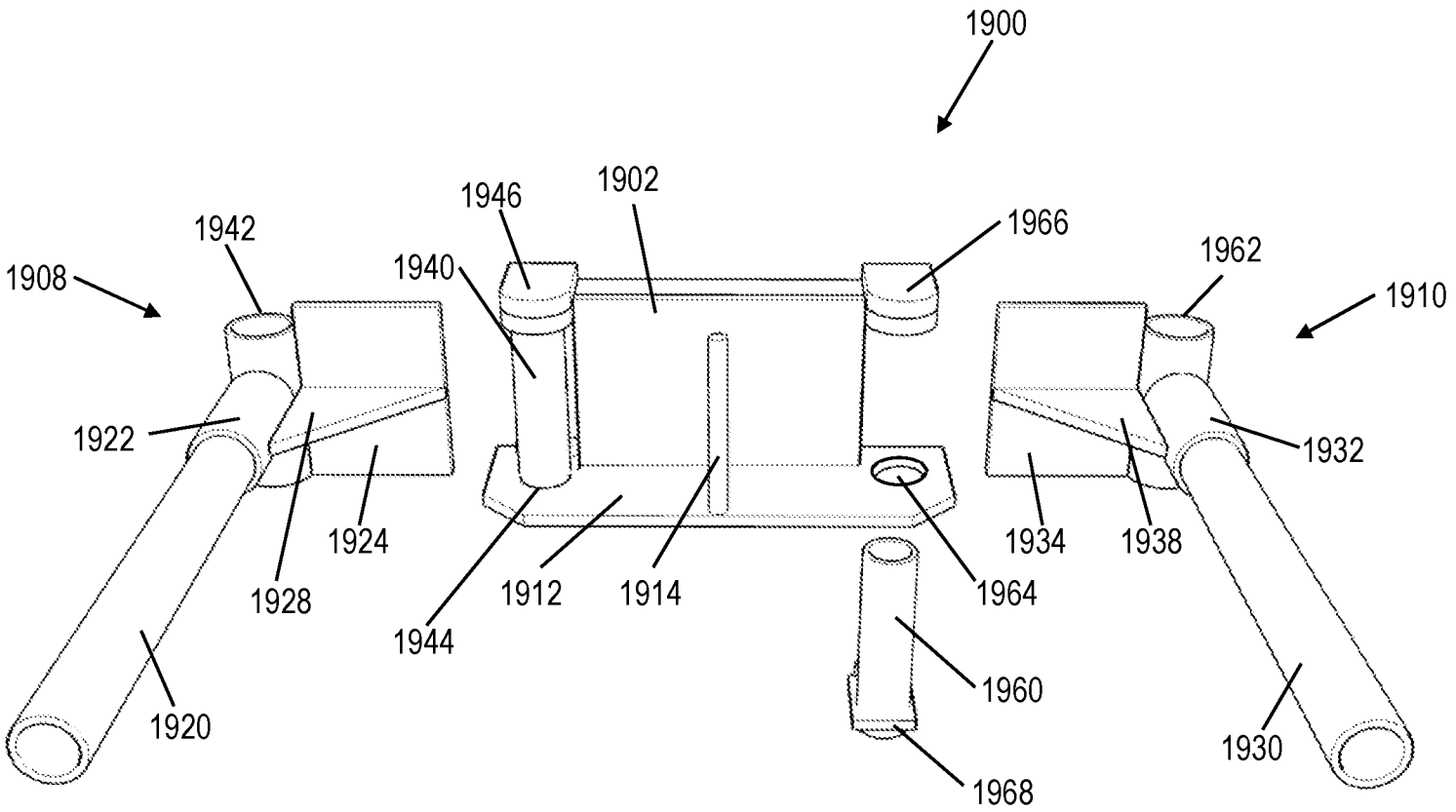
Figure 23:
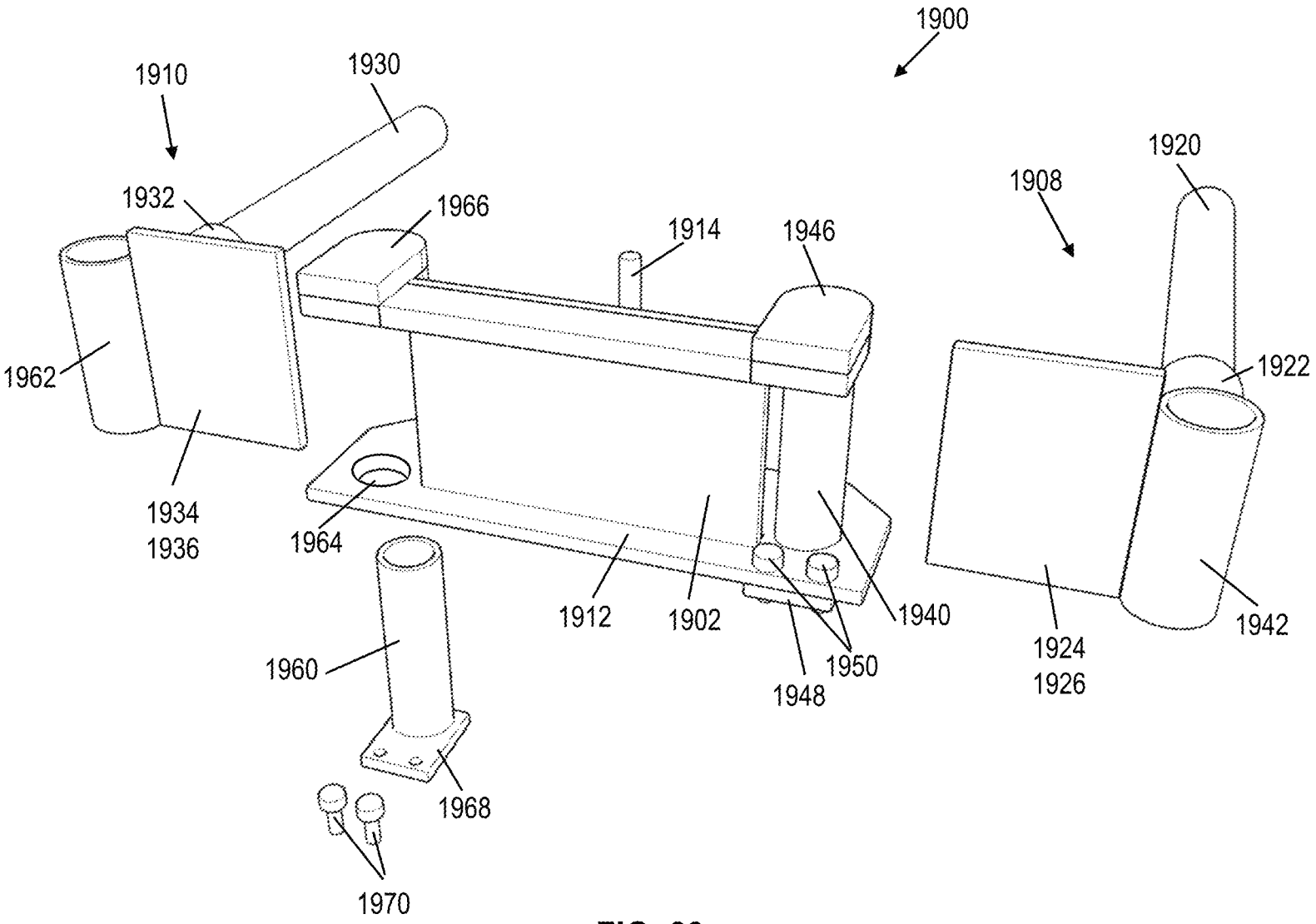

As can be seen in FIG. 22 to FIG. 23, the can crusher 1900 can be readily assembled and disassembled by undoing the fasteners 1950, 1970. This makes it possible to lower the pins 1940, 1960 which, in turn, releases the crush arms 1908, 1910. The disassembled pieces can then be conveniently stowed in a conventional drawer or the like.

Figure 24:
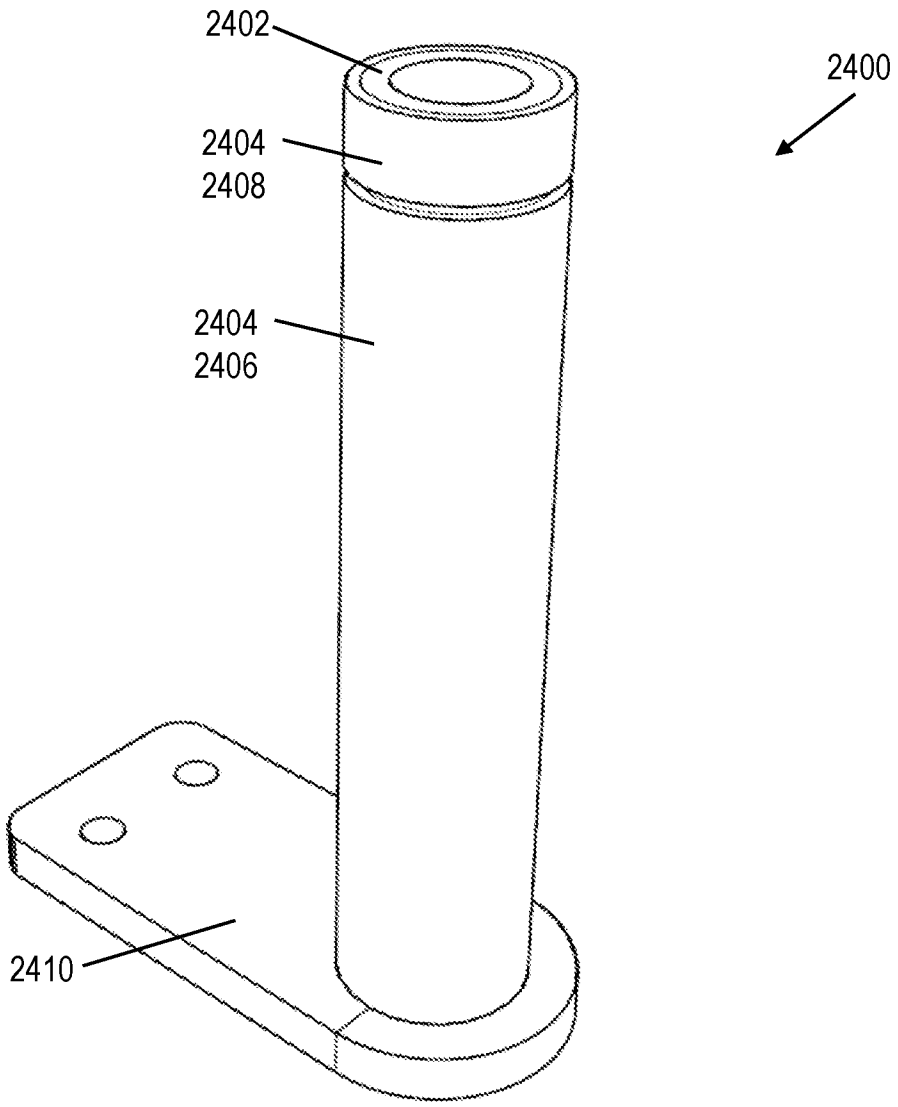
FIG. 24 is a perspective view of an alternate example embodiment of the pin.
Figure 25:
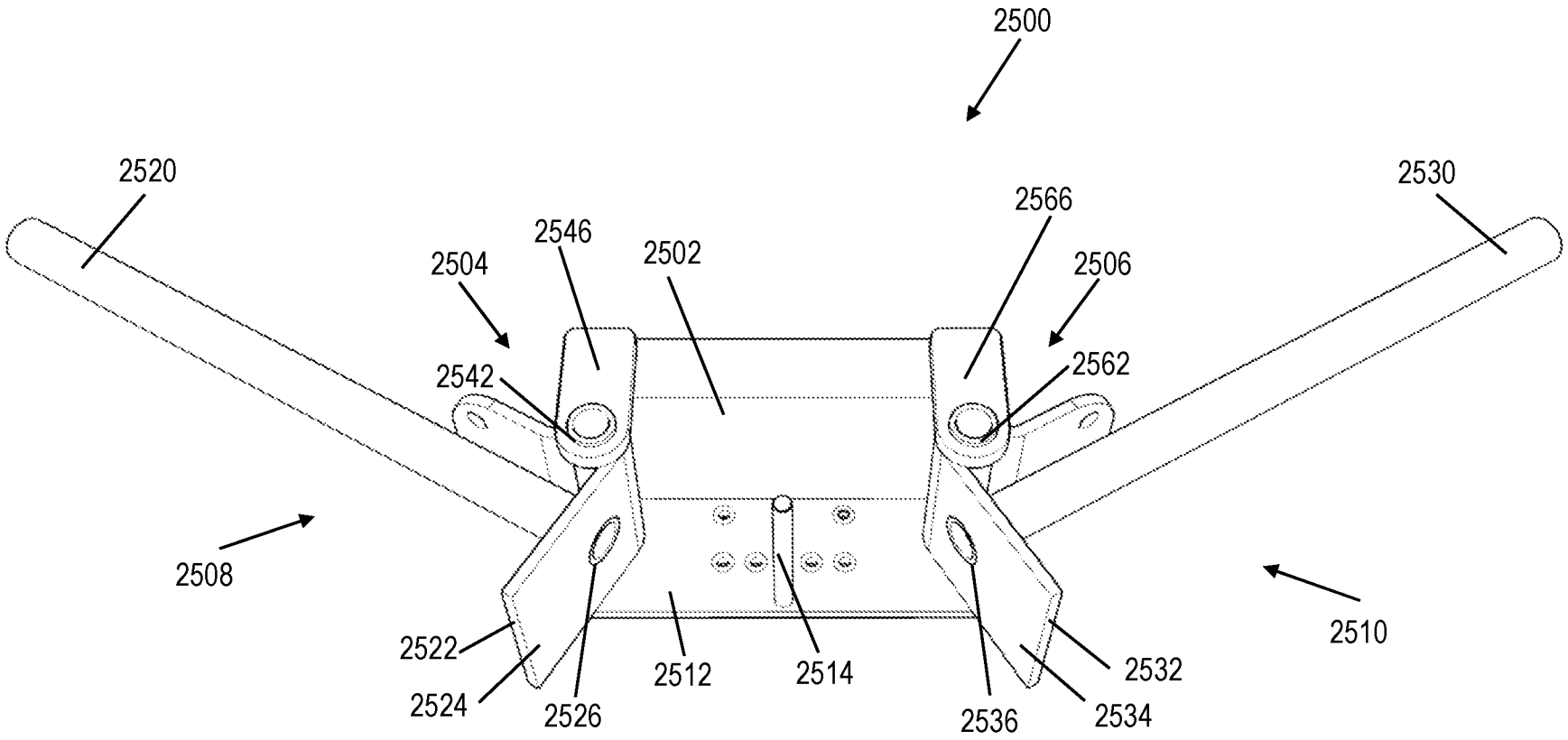
FIG. 25 to FIG. 30 show an alternate example embodiment of the can crusher.
Figure 26:
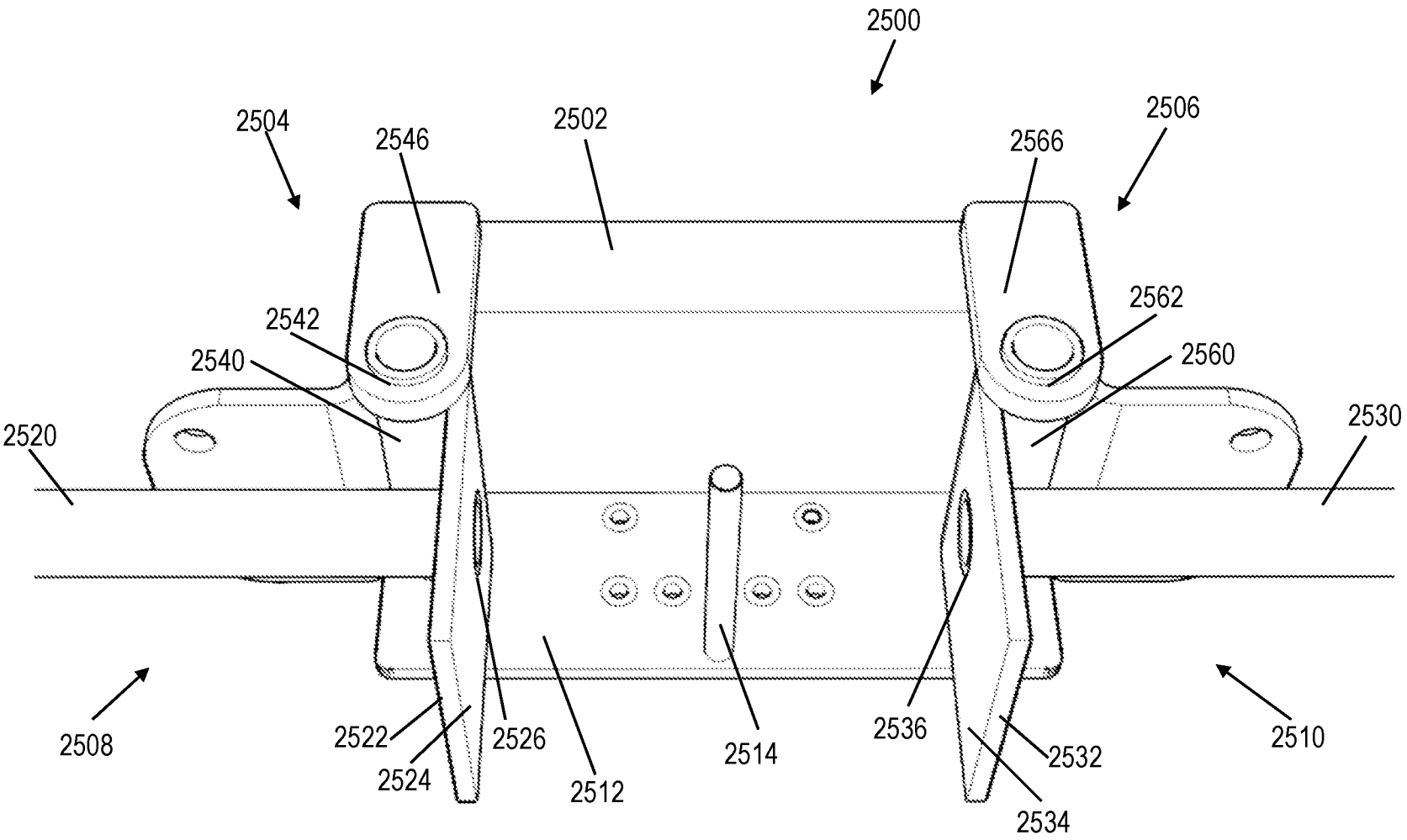

As can also be seen in FIG. 22 to FIG. 23, the pins 1940, 1960 can be made of a solid material. FIG. 24 shows an alternate example embodiment of the pin 2400. The pin 2400 includes an inner tube 2402 that provides strength, and a sleeve 2404 that reduces friction between the pin 2400 and the respective outer tube 1942, 1962. In example embodiments, the inner tube 2402 is composed of a metal such as carbon steel, stainless steel, aluminum and the like. The sleeve 2404 is composed of highly wear resistant, low friction material such as nylon or the like. The sleeve 2404 may extend continuously along the entire length of the inner tube 2402. Alternately, as shown in FIG. 24, the sleeve 2404 may include a lower sleeve portion 2406 and optionally an upper sleeve portion 2408. The lower sleeve portion 2406 reduces the friction between the pin 2400 and the respective outer tube 1942, 1962. In embodiments where an inner diameter of the upper bracket hole (not shown) in the upper bracket 1946, 1966 matches a diameter of the inner tube 2402, the lower sleeve portion 2406 is trapped in place between the lower bracket 2410 and the respective upper bracket 1946, 1966, or between the support plate 1912 and the respective upper bracket 1946, 1966. In embodiments where the inner diameter of the upper bracket hole in the brackets 1946, 1966 matches an outer diameter of the lower sleeve portion 2406, the upper sleeve portion 2408 acts as a spacer between the upper bracket hole and the inner tube 2402. This enables the lower sleeve portion 2406 to rotate freely around the inner tube 2402 with the respective crush arm 1908, 1910, while allowing the upper sleeve portion 2408 to not rotate around the inner tube 2402 while it is within the respective bracket 1946, 1966, which does not rotate. The upper sleeve portion 2408 thereby traps the lower sleeve portion 2406 and prevents the lower sleeve portion 2406 from working its way up and eventually off the inner tube 2402 after may uses/turns of the respective crush arm 1908, 1910.

FIG. 25 to FIG. 30 show an alternate example embodiment of the can crusher. The can crusher 2500 includes a backing plate 2502, a left pivot joint 2504, a right pivot joint 2506, a left crush-arm 2508, a right crush arm 2510, a support plate 2512, and a retaining pin 2514. The left crush arm 2508 includes a left handle 2520 and a left flap 2522. The left flap 2522 includes a left crush surface 2524, a left flap opening 2426, and a left curved section 2528. The right crush arm 2510 includes a right handle 2530 and a right flap 2532. The right flap 2532 includes a right crush surface 2534, a right flap opening 2536, and a right curved section 2538.

The left pivot joint 2504 includes a left pin 2540, the left curved section 2528 and the left handle 2520. The left curved section 2528 and the left handle 2520 trap the left pin 2540 therein and rotate the left crush arm 2508 about the left pin 2540. The left pin 2540 is held in place via a support plate hole 2544 in the support plate 2512, an upper bracket hole 2542 in a left upper bracket 2546, and a lower left bracket 2548 that is secured to the left pin 2540 and is, in turn, secured to the support plate 2512 via fasteners.

The right pivot joint 2506 includes a right pin 2560, the right curved section 2538 and the right handle 2530. The right curved section 2538 and the right handle 2530 trap the right pin 2560 therein and rotate the right crush arm 2510 about the right pin 2560. The right pin 2560 is held in place via a support plate hole 2564 in the support plate 2512, an upper bracket hole 2562 in a right upper bracket 2566, and a lower right bracket 2568 that is secured to the right pin 2560 and is, in turn, secured to the support plate 2512 via fasteners.

Figure 27:
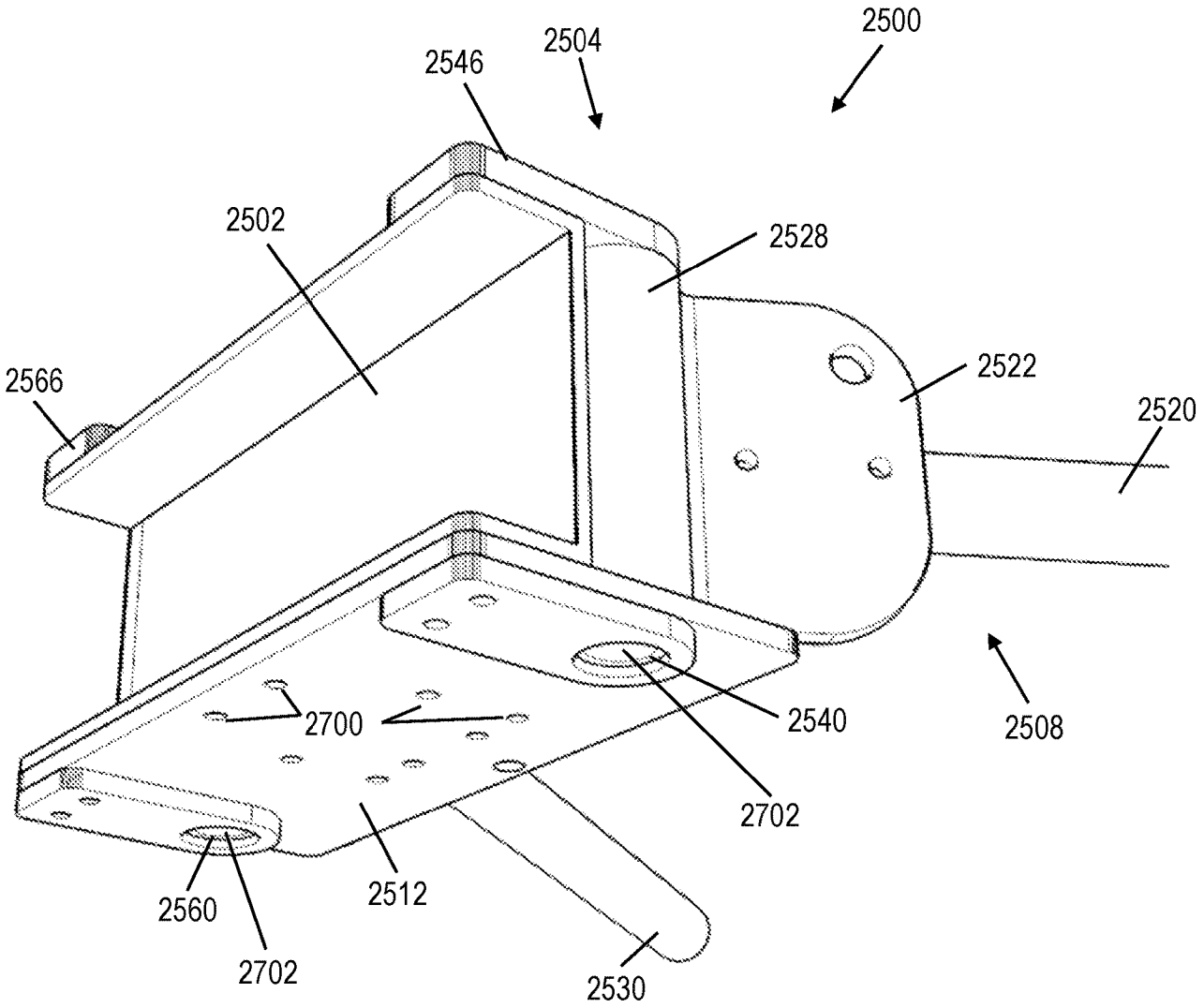
Figure 28:
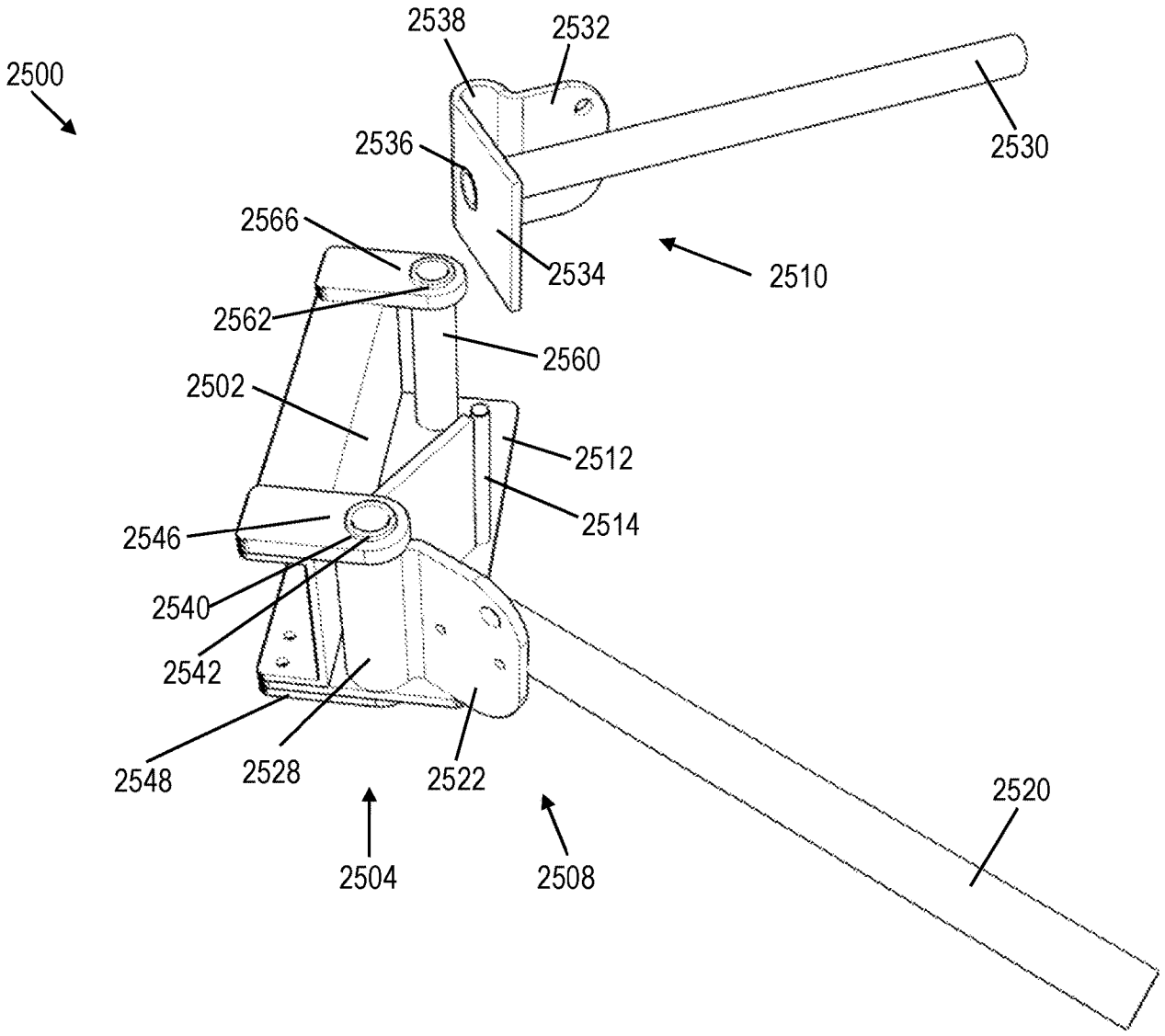

As can be seen in FIG. 27, the support plate 2512 includes several mount holes 2700 that can be used to secure the optional base 106 to the can crusher 2500. In this example embodiment, four of the mount holes 2700 form a rectangle oriented front to back, while the other four form a rectangle oriented side to side. This permits mounting of the optional base 106 in a front to back orientation, or a side to side orientation.

Also visible in FIG. 27 are mounting recesses 2702 in the pins 2540, 2560. In an example embodiment, the pins 2540, 2560 are tubes whose interior volume define the mounting recesses 2702.

Figure 29:
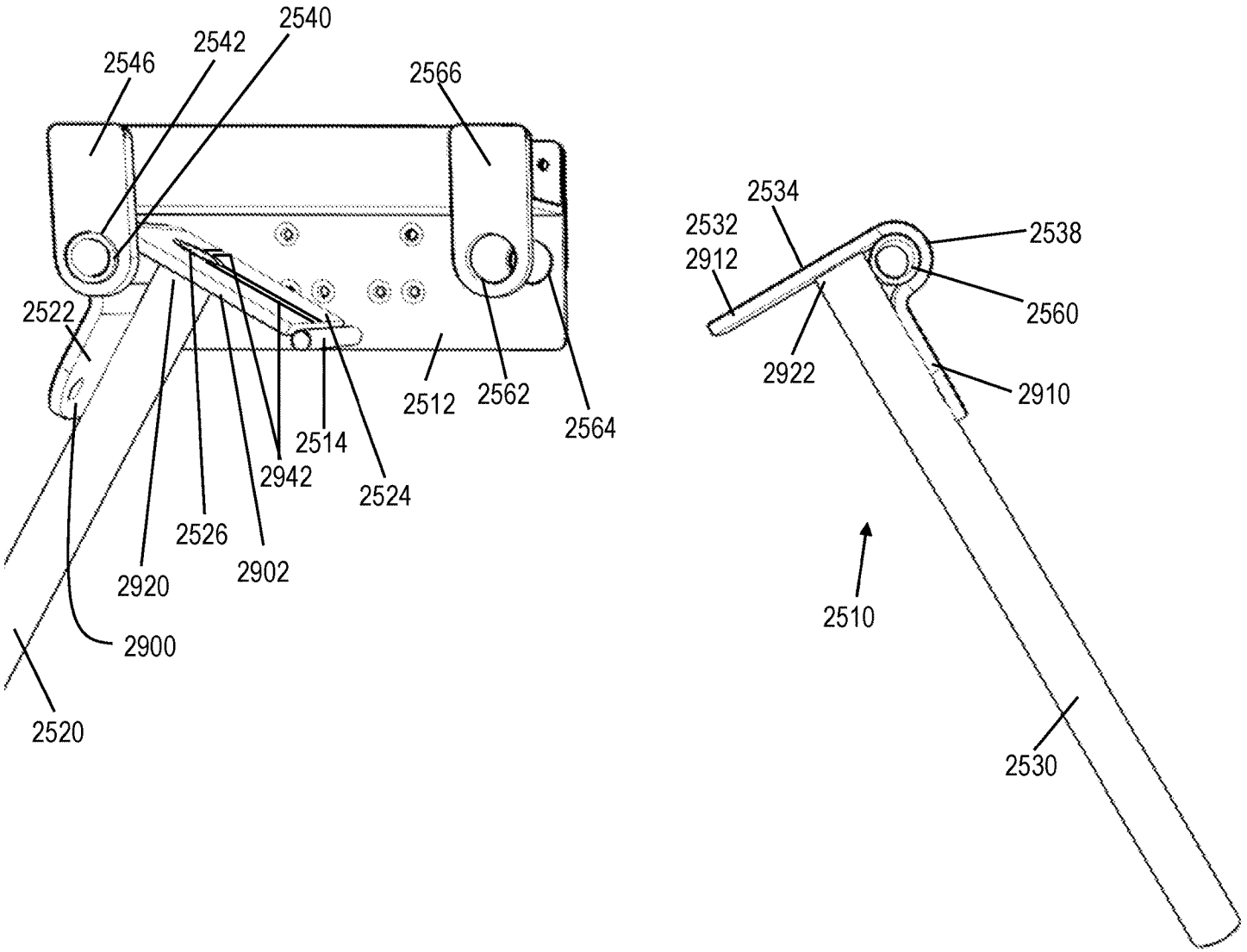

As can be seen in FIG. 29, left flap further includes a left attachment section 2900 to which the left handle 2520 is secured via, e.g. fasteners, and a left crush section 2902 which defines the left crush surface 2524. The right flap 2532 further includes a right attachment section 2910 to which the right handle 2530 is secured, and a right crush section 2912 which defines the right crush surface 2534. The handles 2520, 2530 and the curve sections 2528, 2538 provide a secure fit when the handles 2520, 2530 lightly abut or almost abut the pins 2540, 2560.

The left handle 2520 further includes a left handle end 2920 and the right handle 2530 further includes a right handle end 2922. By placing the ends 2920, 2922 of the handles 2520, 2530 in the flap openings 2426, 2536 and securing the handles 2520, 2530 to the attachment sections 2900, 2910 in this manner, the handles 2520, 2530 do not pinch the pins 2540, 2560 as a result of flexing of the flaps 2522, 2532 when force is applied to the handles 2520, 2530 and resisted by the can.

While the flap openings 2426, 2536 prevent the pinching of the pins 2540, 2560, the flap openings 2426, 2536 simultaneously permit the crush sections 2902, 2912 to flex/yield when the force is applied to the handles 2520, 2530. This softens the feedback provided to the user through the handles 2520, 2530 when crushing a can. The flex can feel to the user similar to a spring arrangement, and when combined with a yielding of the can, may resemble a damped spring arrangement.

Moreover, the flap openings 2426, 2536 provide a path for air that is forced from the interior of the can when crushing a can. This is beneficial when the crush surfaces are flat because the crush forces can be enough for the top of the can to form a seal with the crush surfaces which traps the air and makes the crushing the can more difficult. Accordingly, in an example embodiment, the crush surface can include any combination of relief holes 2940 and/or grooves 2942 (FIG. 30) to permit the air to escape. The holes can be in addition or instead of the flap openings 2426, 2536.

Figure 30:
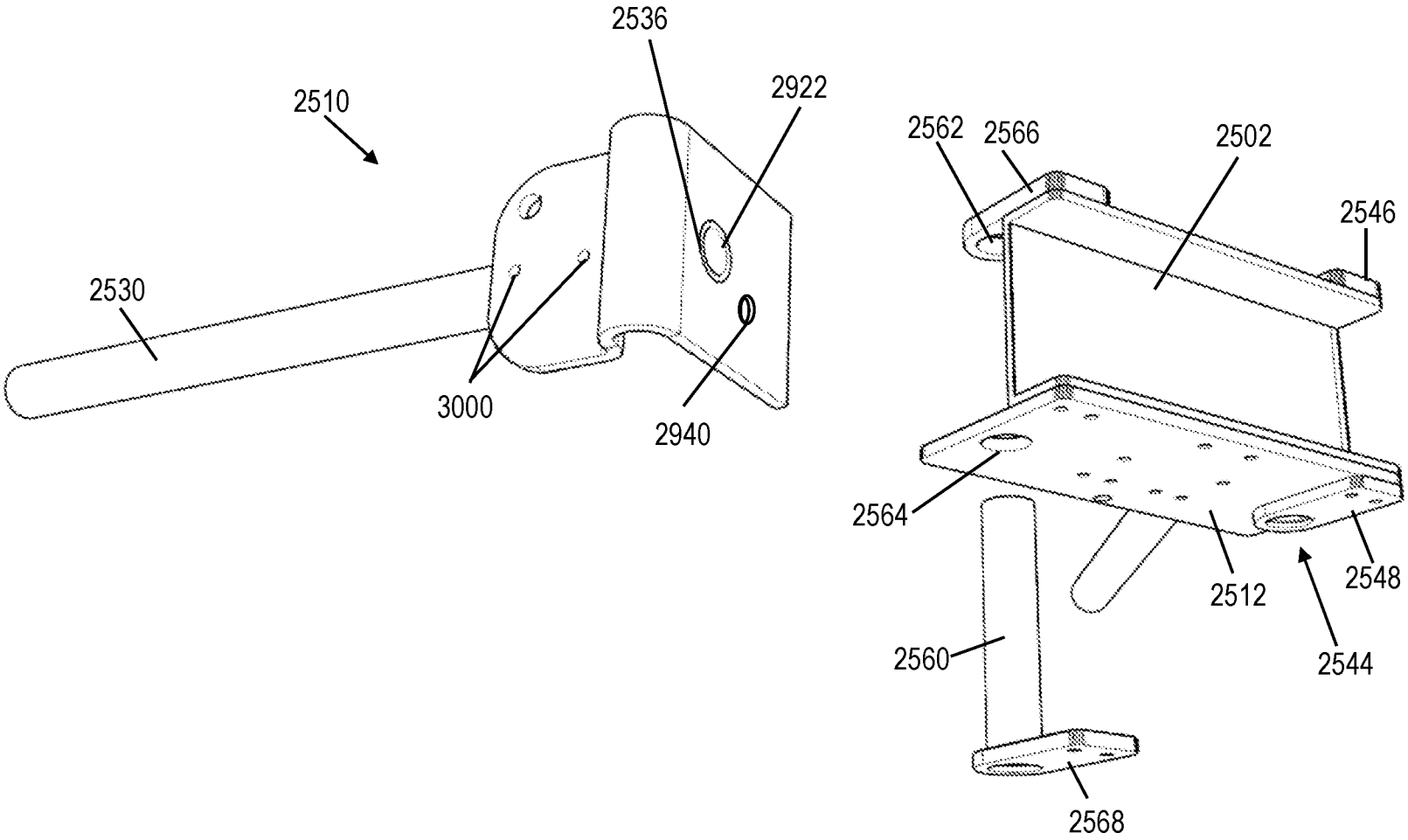

As can be seen in FIG. 29 to FIG. 30, the can crusher 2500 can be readily assembled and disassembled by undoing the fasteners 2550, 2570. This makes it possible to lower the pins 2540, 2560 which, in turn, releases the crush arms 2508, 2510. The flaps 2522, 2532 may include fastener holes 3000 for fastening the handles 2520, 2530 thereto, which can provide for further disassembly.

Figure 31:
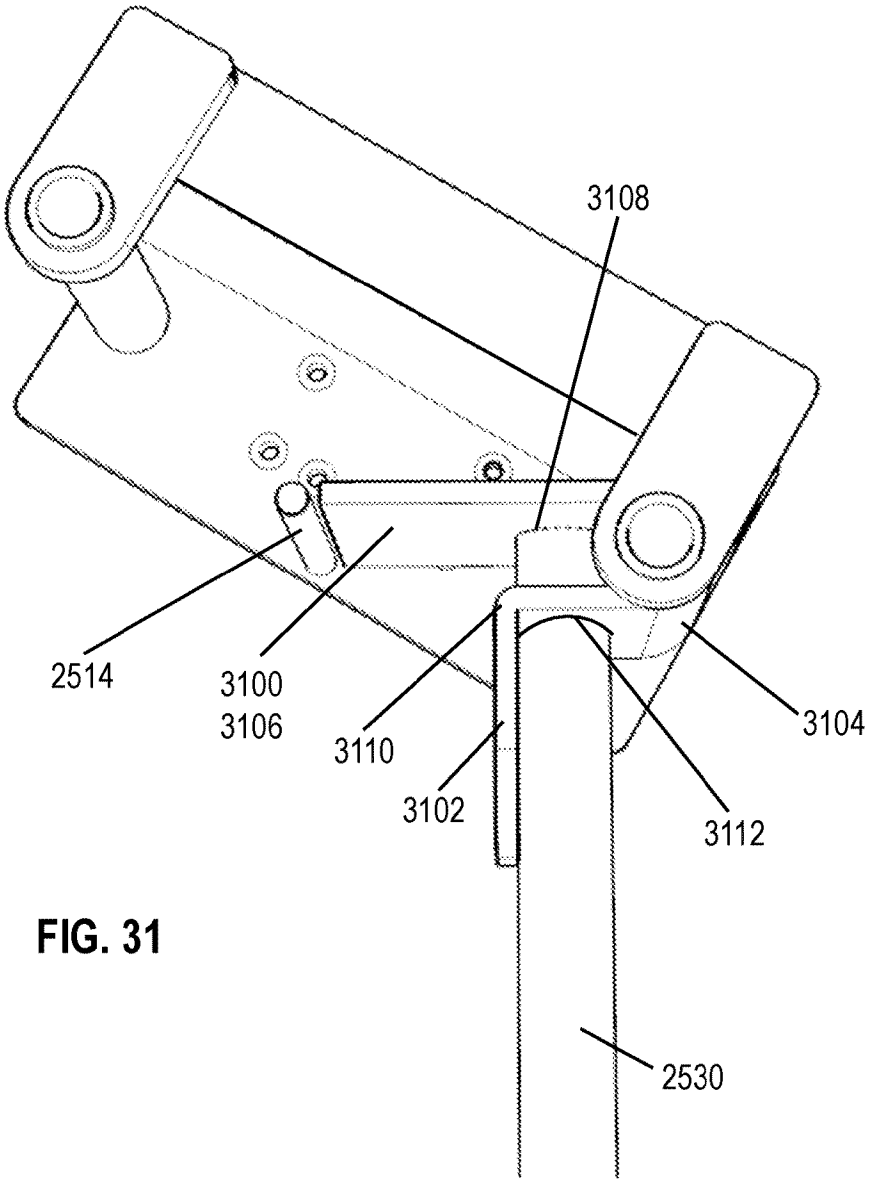
FIG. 31 is a perspective view of an alternate example embodiment of the flap.

FIG. 31 shows an alternate example embodiment of a flap 3100 that can be used with the remainder of the example embodiment can crusher 2500 of FIG. 25 to FIG. 30. In this example embodiment, the flap 3100 includes the attachment section 3102, the curved section 3104, the crush section 3106, and the right flap opening 3108. The attachment section 3102 in this example embodiment, extends past the right handle 2530 before making the outward turn at bend 3110. The flap thereby includes an attachment section hole 3112 to permit the right handle 2530 to pass through the attachment section 3102. This example embodiment functions essentially the same as that of FIG. 25 to FIG. 30 but may have more flex when crushing a can due to the greater lengths, which would further reduce the feedback to the user.

FIG. 31 only shows flap 3100 on the right side. However, the same principles apply to the left side flap. Moreover, any examples provided herein that show only the right or left side are intended to apply to both sides.

A further benefit associated with the retaining pin 2514 disposed at Dist. of 2.625" or less is that, when in the closed configuration, certain commonly available items can be wedged between the retaining pin 2514 and the flaps 2522, 2532. This holds the flaps 2522, 2532 in place. This provides an advantage during, for example, transport and storage in that the crush arms 2508, 2510 are not free to move. For example, a tennis ball can be placed between the pin 2514 and the flaps 2522, 2532. The diameter of a conventional tennis ball (at least 2.575 inches and at most 2.700 inches) is such that an installed tennis ball provides an appropriate force on the flaps 2522, 2532 that the flaps 2522, 2532 are held in place sufficiently during transport and/or storage. This applies to all embodiments.

Figure 32:
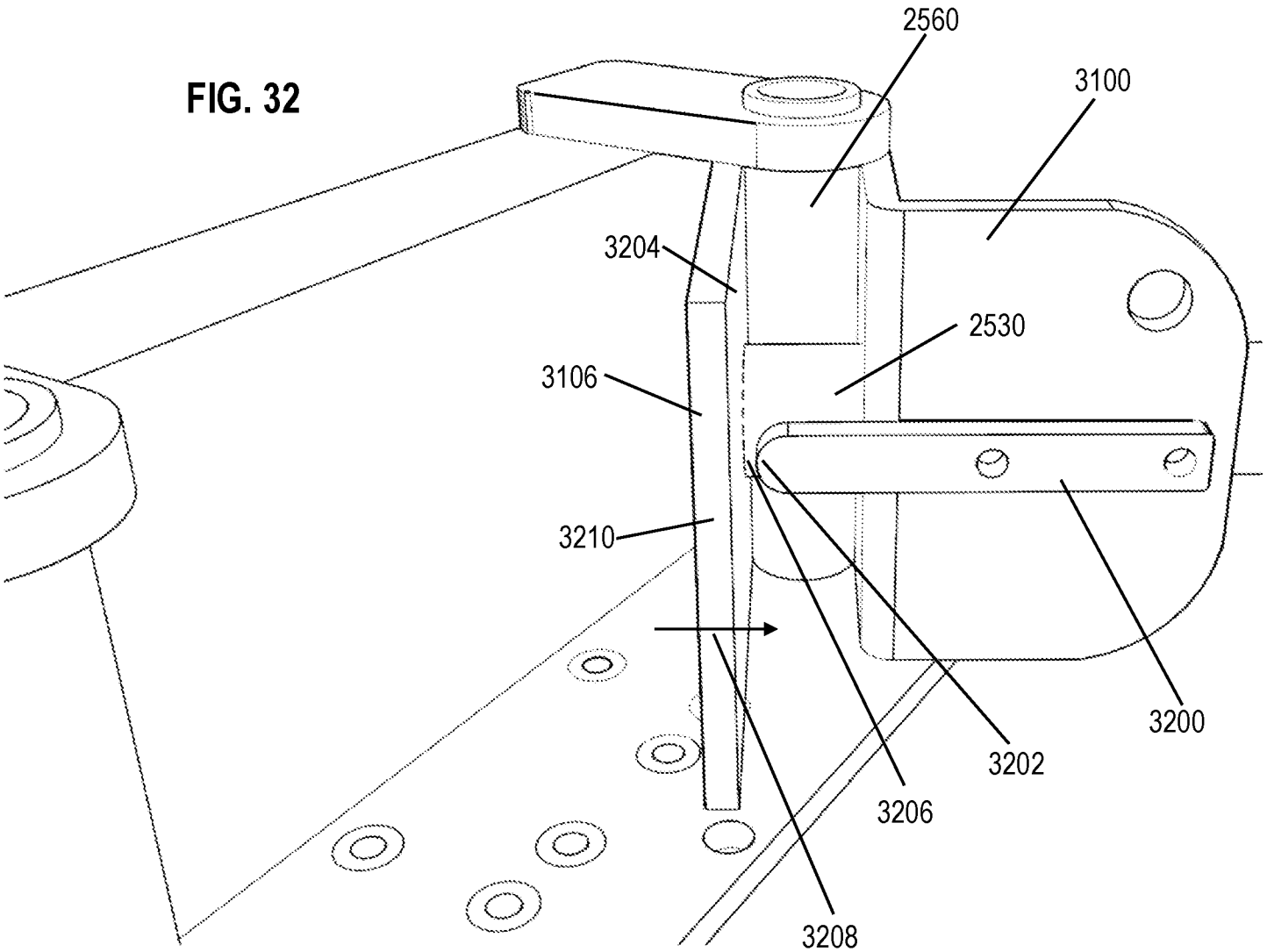
FIG. 32 to FIG. 33 show example embodiments of flex stops.

FIG. 32 shows an example embodiment of a flex stop 3200 that can be used at least with the flap 3100 shown in FIG. 31. A bitter end 3202 of the flex stop 3200 is set apart from a back surface 3204 of the crush section 3106 to form a gap 3206. When crushing a can, the crush section 3106 flexes in direction 3208 toward the flex stop. When the user pushes the crush section 3106 toward the backing plate 2502 the can resists this force and pushes back on the crush section 3106. The crush section 3106 is able to flex because it is effectively a cantilevered configuration which is supported at the right pin 2560. Further, the right flap opening (not visible) makes it possible for the crush section 3106 to move relative to/along the right handle 2530.

The flex stop 3200 will permit the crush section 3106 to flex a limited amount until the gap 3206 is reduced to zero. Once the gap 3206 is gone, the bitter end 3202 of the flex stop 3200 blocks further flex of the part of the crush section 3106 at the flex stop 3200. As such, before contacting the flex stop 3200 the crush section 3106 has a relatively long first cantilever arm length that extends from the right pin 2560 to a free end 3210 of the crush section 3106. Once the crush section 3106 contacts the flex stop 3200, the flex stop becomes the new support for the cantilevered configuration, so a relatively short second cantilever arm is established that extends from the flex stop 3200 to the free end 3210. Since the length of the second cantilever arm is significantly shorter than the length of the first cantilever arm, the crush section 3106 becomes much more rigid once the crush section 3106 reaches the flex stop 3200. As such, in this embodiment, the can crusher essentially creates a two-stage crushing operation. In the first stage, the crush section 3106 flexes, and this provides for greater user comfort. In the second stage, the crush section 3106 abuts the bitter end 3202 of the flex stop 3200 and greatly increases its stiffness, at which point the user can impart much greater crush force with a nearly rigid connection between the user's hands and the can being crushed.

Figure 33:
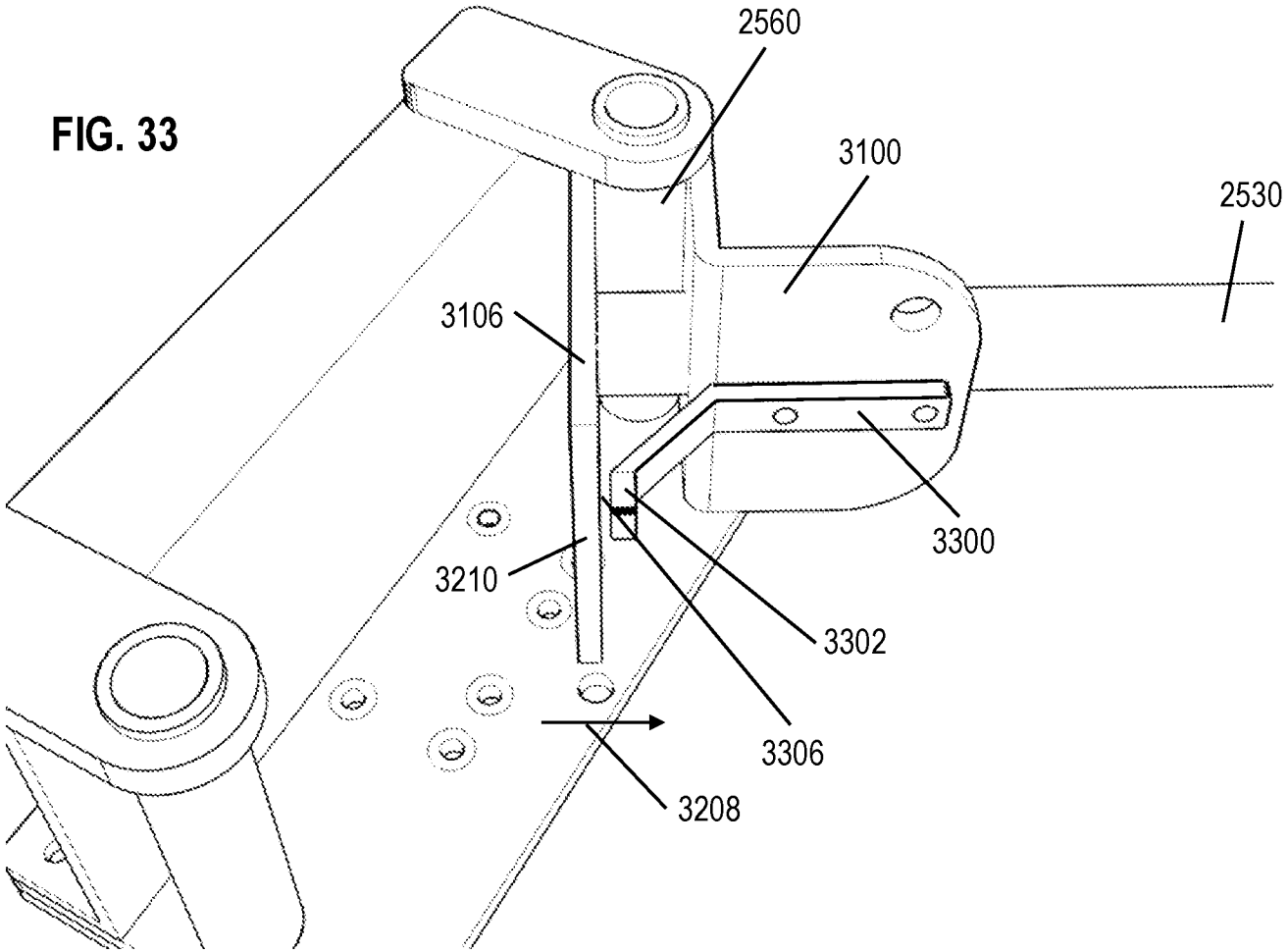

FIG. 33 shows an alternate example embodiment of a flex stop 3300 that can be used at least with the flap 3100 shown in FIG. 31. An end 3302 of the flex stop 3300 is set apart from a back surface 3204 of the crush section 3106 to form a gap 3306. In this example embodiment, when the crush section 3106 contacts the end 3302 of the flex stop 3300, the end 3302 provides additional support. However, the end 3302 itself is cantilevered. Hence, the end 3302 can also flex in direction 3208. This flex stop 3300 is therefore not a positive stop but is instead a reinforcing stop. The crush section 3106 will still be cantilevered from the right pin 2560 whether or not the crush section 3106 is in contact with the flex stop 3300 but will be stiffer once in contact with the flex stop 3300. Hence, prior to contacting the flex stop 3300, the crush section 3106 will exhibit what amounts to a first increasing resistance curve. After contacting the flex stop 3300, the crush section will exhibit what amounts to a second increasing resistance curve that jumps in magnitude upon contacting the flex stop 3300. In an example embodiment, flex stop 3200 and flex stop 3300 could be combined so that the crush section first contacts flex stop 3300 and then contacts flex stop 3200. For example, flex stop 3200 could be installed between the right handle 2530 and flex stop 3300.

Figure 34:
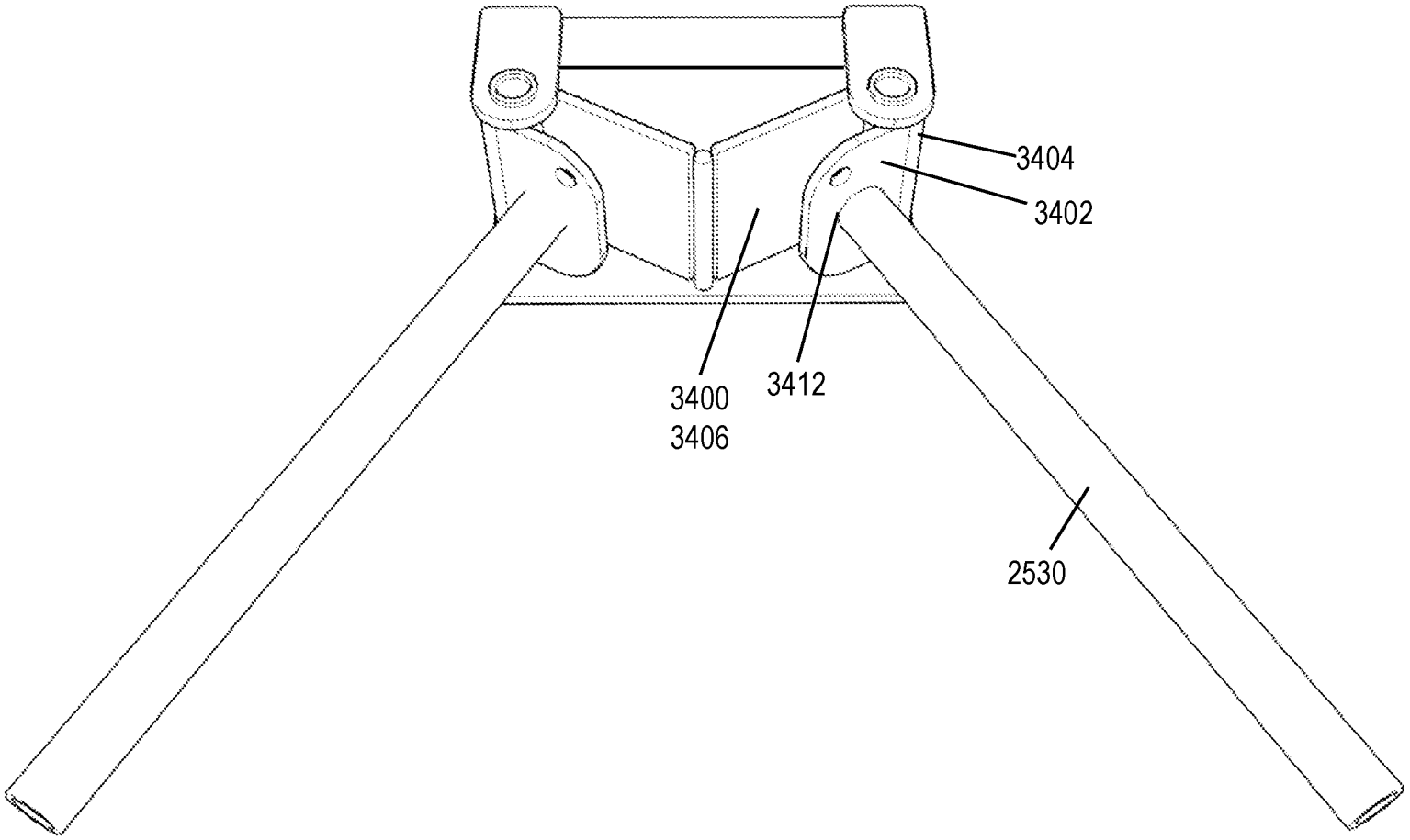
FIG. 34 is a perspective view of another alternate example embodiment of the flap.

FIG. 34 shows an alternate example embodiment of a flap 3400 that can be used with the remainder of the example embodiment can crusher 2500 of FIG. 25 to FIG. 30. In this example embodiment, the flap 3400 includes the attachment section 3402, the curved section 3404, the crush section 3406, and the right flap opening (not visible), but no bend leading to the attachment section 3402. The attachment section 3402 in this example embodiment also extends past the right handle 2530. The flap thereby includes an attachment section hole 3412 to permit the right handle 2530 to pass through the attachment section 3102. This example embodiment functions essentially the same as that of FIG. 25 to FIG. 30 but may have less flex when crushing a can due to the shorter lengths, which would further increase the feedback to the user.

FIG. 35 to FIG. 38 show an example embodiment of a crush arm clamp 3500 securing the right handle 2530 with the flap 3100 to the right pin 2560. In an embodiment, a fastener such as a bolt is installed through a clamp fastener opening 3504 and secured, for example, via a nut inside the right handle 2530. The crush arm clamp 3500 includes a back 3510, legs 3512, and pads 3514 that contact the right pin 2560. As can be seen best between FIG. 35 and FIG. 37, a distance 3516 between the right pin 2560 and the back 3510 is greater than an outer diameter 3518 of the right handle 2530. As such, tightening the bolt draws the right handle 2530 toward the back 3510 which, in turn, draws the flap 3100 onto the (back of the) right pin 2560. This action clamps/tightens the fit around the right pin 2560. Adjusting the bolt adjusts an amount of clamp force applied to the right pin 2560. Because the clamp fastener opening 3504 is disposed in a vertical center of the back 3510, the crush arm clamp 3500 can pivot/seesaw about the clamp fastener opening 3504 and thereby self-adjust to ensure equal forces are applied by the top and bottom feet.

In addition, a width 3520 of the crush arm clamp 3500 can be selected relative to a gap 3522 in the flap 3100. If the width 3520 of the crush arm clamp 3500 equals the gap 3522 in the flap 3100, then the crush section 3106 will be relatively rigid. This is because it will be cantilevered from the back 3510 of the crush arm clamp 3500 and thereby have a relatively short cantilever arm from the back 3510 of the crush arm clamp 3500 to the free end 3210. Alternately, the width 3520 of the crush arm clamp 3500 can be set to be slightly less than the gap 3522 in the flap 3100, in which case the back 3510 of the crush arm clamp 3500 permits limited flex but then acts like positive stop in the same way flex stop 3200 does.

Figure 35:
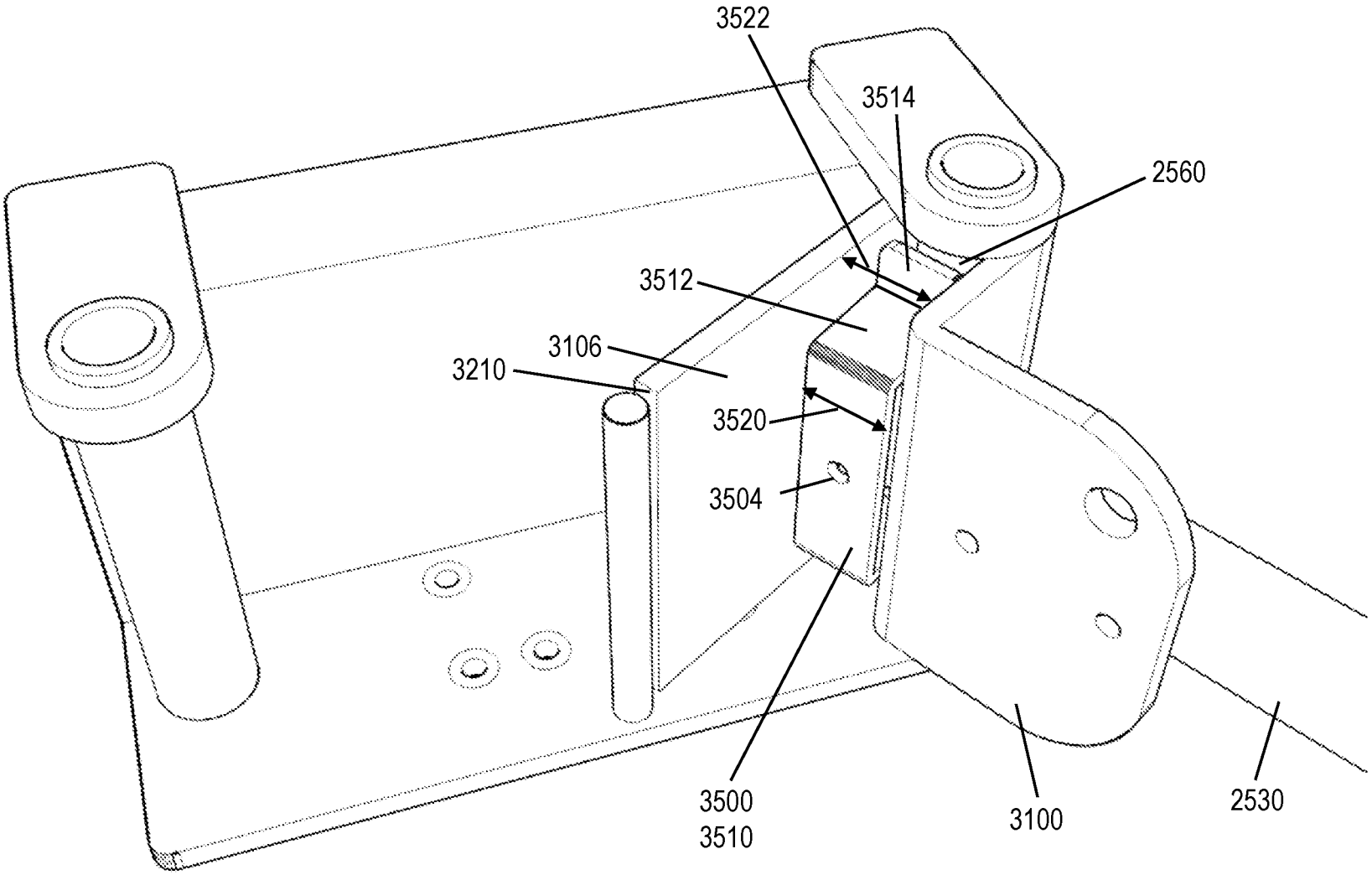
FIG. 35 to FIG. 38 show an example embodiment of a crush arm clamp.
Figure 36:
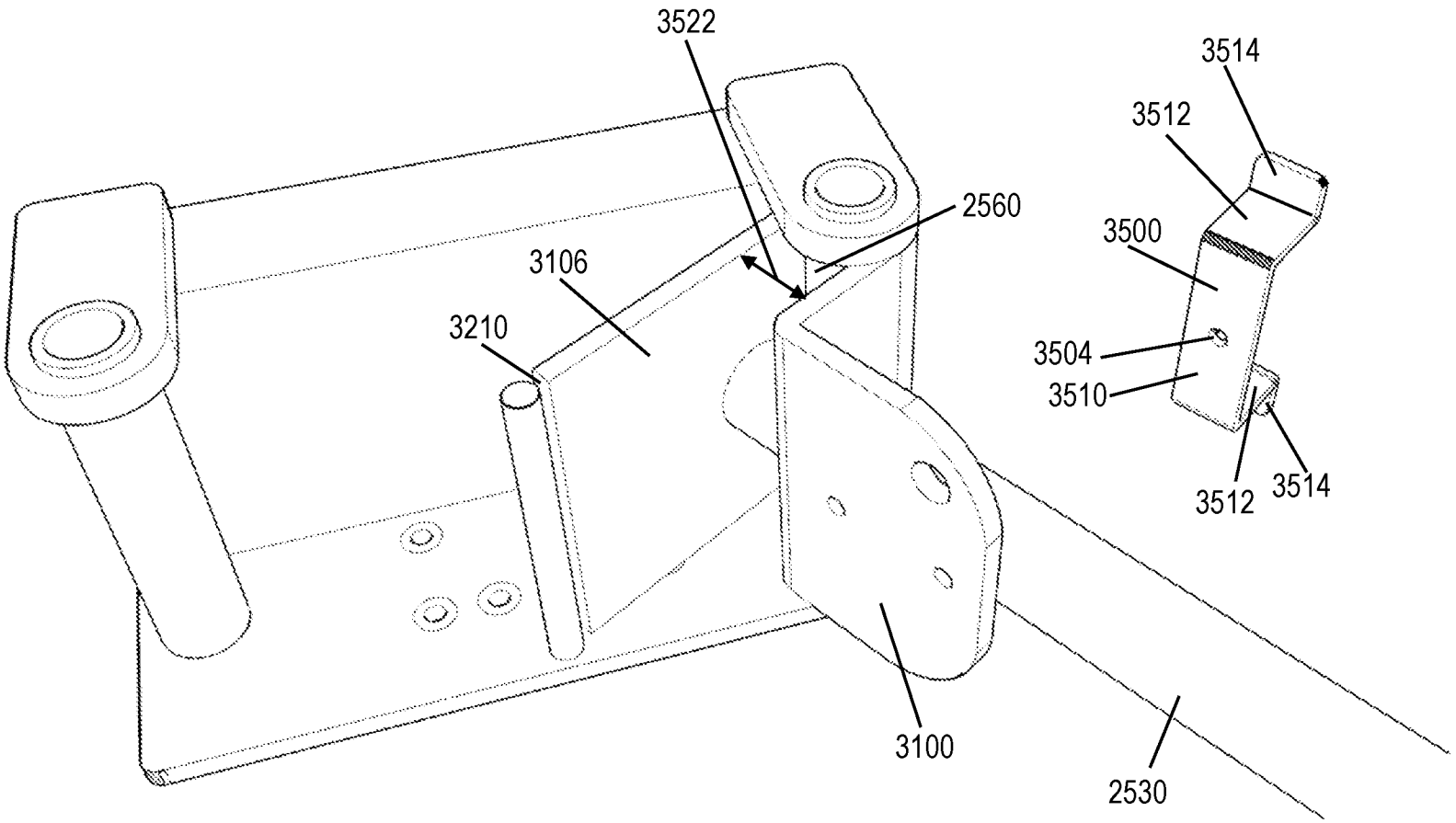
Figure 37:
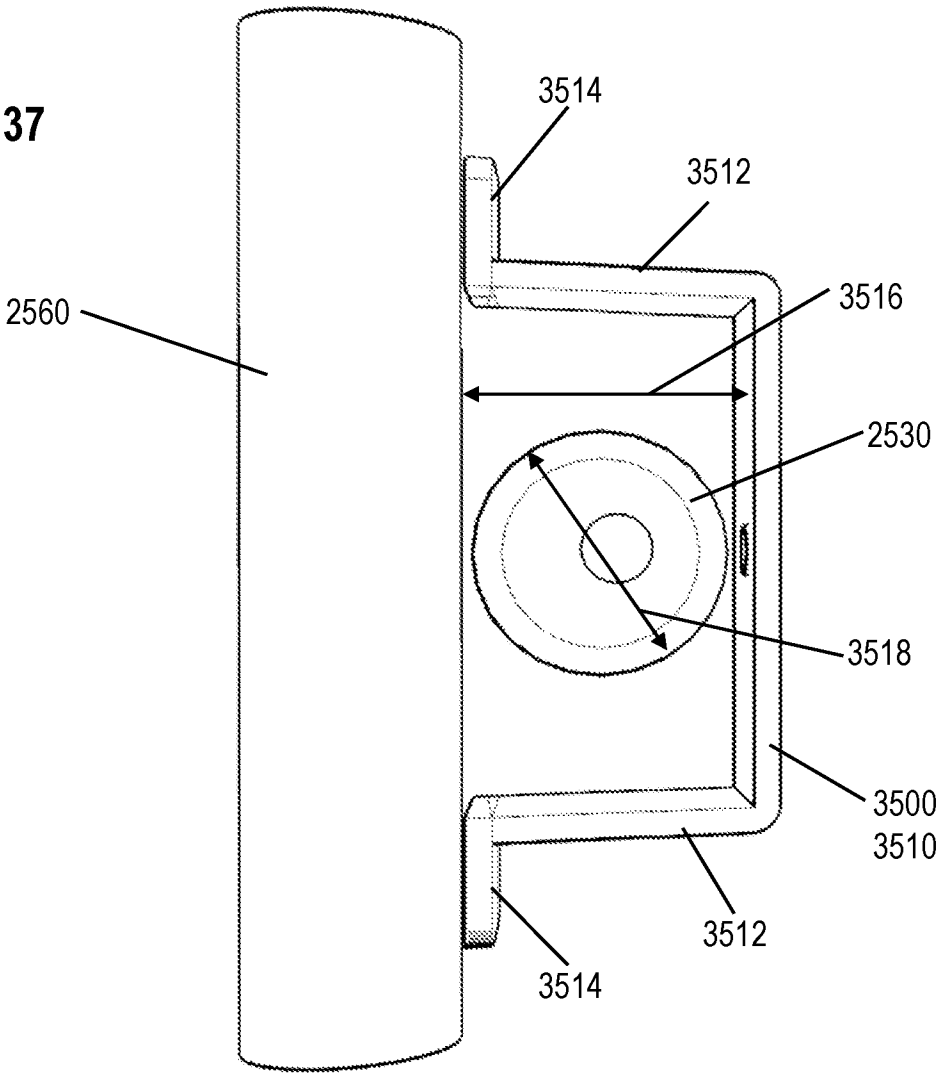
Figure 38:
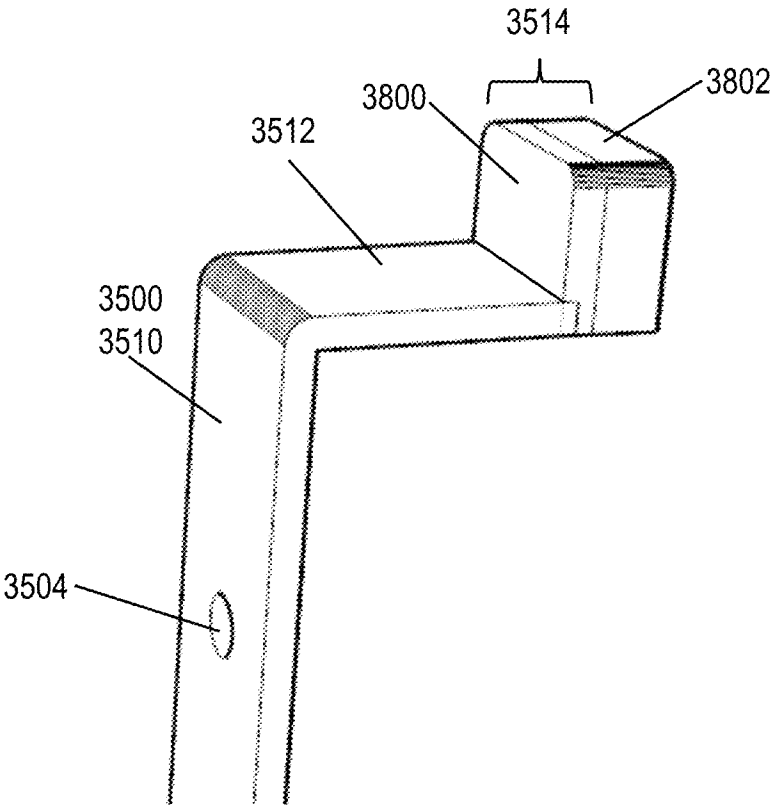

As can be seen best in FIG. 38, the feet 3514 may include a structural portion 3800 and a wear portion 3802. The structural portion 3800 may be made of carbon steel, stainless steel, aluminum or the like. The wear portion 3802 may be made of a wear resistant, low friction material such as nylon or the like. This is in contrast to feet 3514 such as shown in FIG. 35, which do not include the wear portion 3802.

Figure 39:
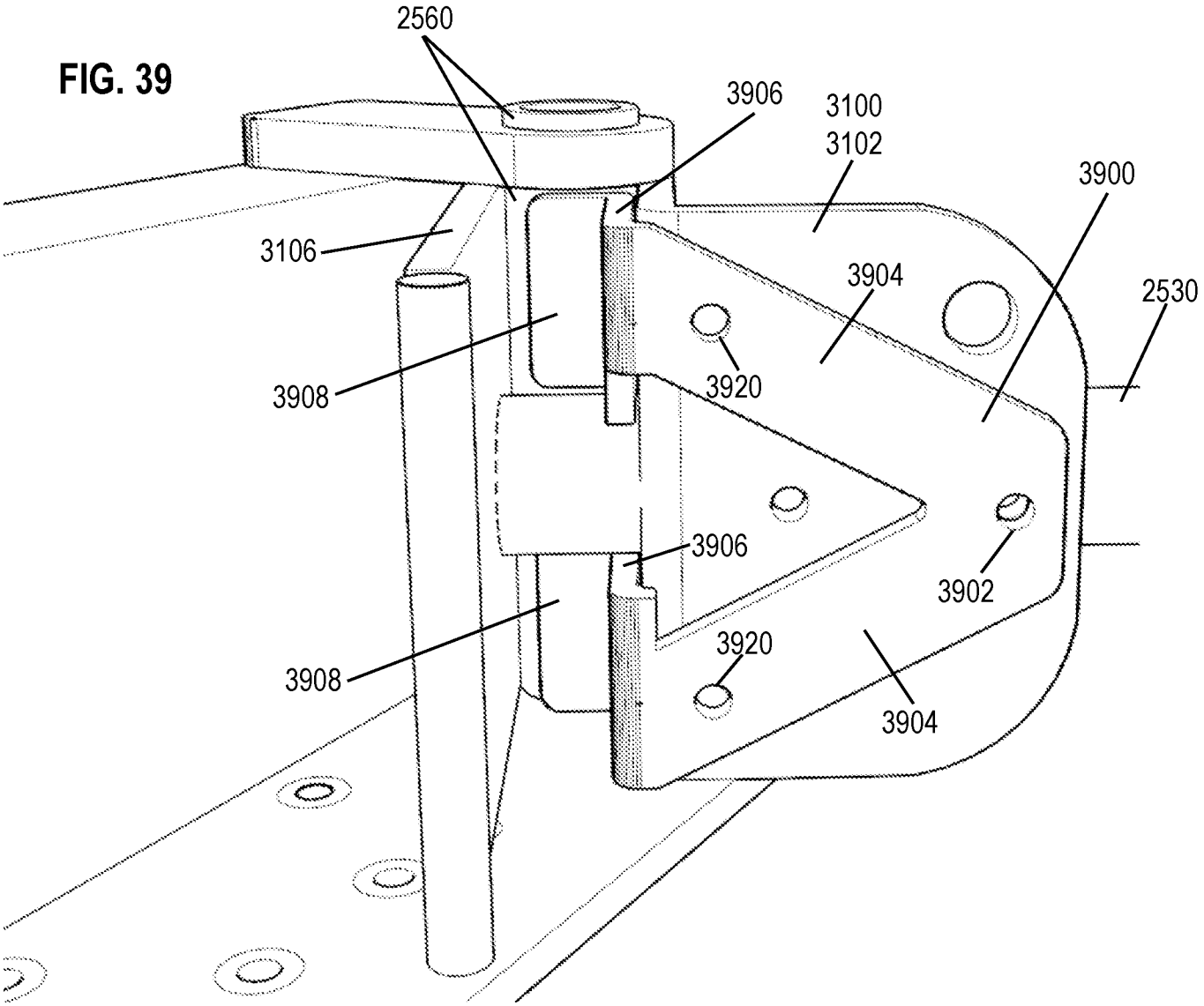
FIG. 39 and FIG. 40 show an alternate example embodiment of a crush arm clamp.
Figure 40:
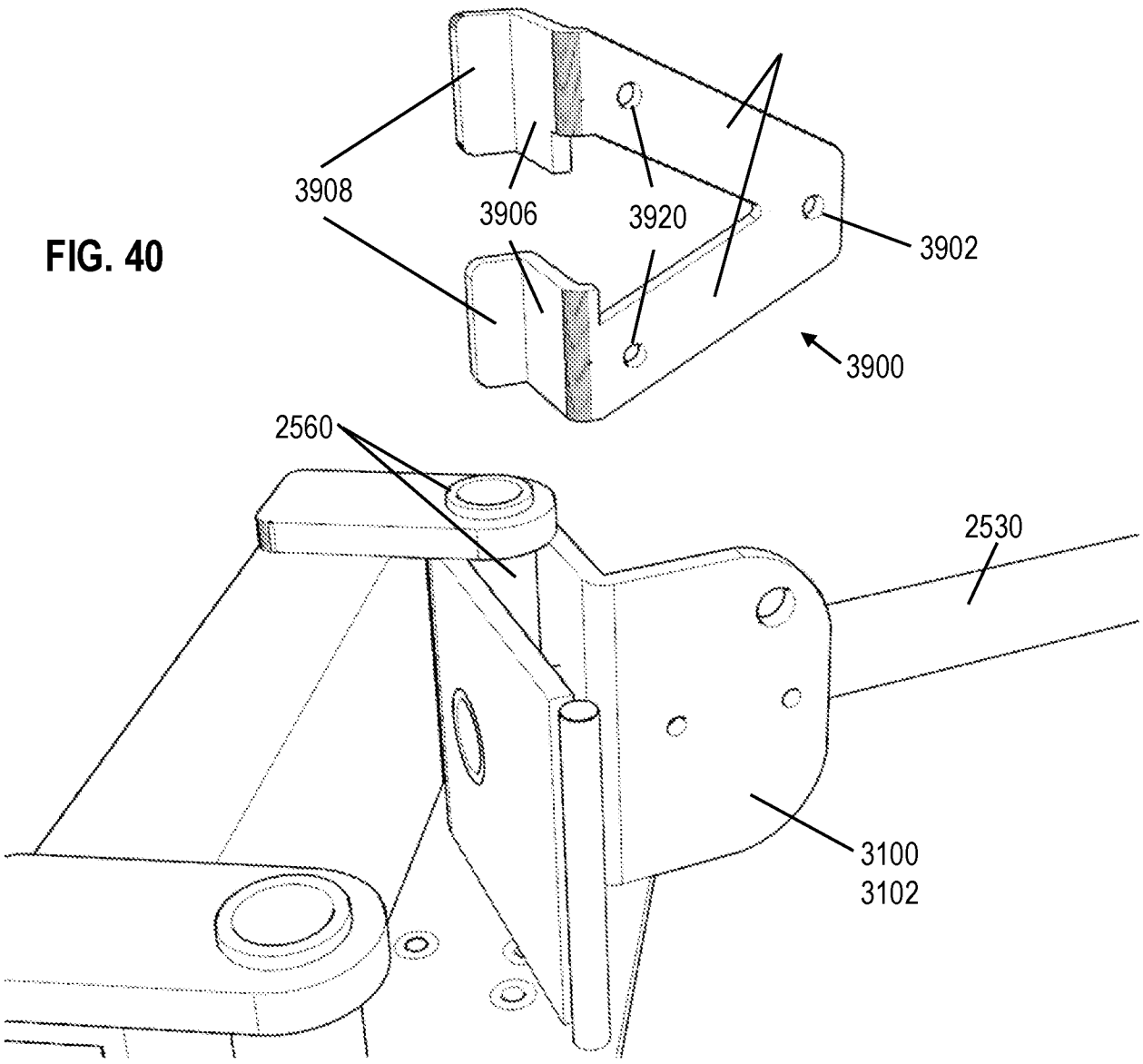

FIG. 39 and FIG. 40 show an alternate example embodiment of a crush arm clamp 3900 securing the right handle 2530 with the flap 3100 to the right pin 2560. In an embodiment, a fastener such as a bolt is installed through a clamp fastener opening 3902 and secured, for example, via a bolt through the right handle 2530. The crush arm clamp 3900 includes prongs 3904, legs 3906, and pads 3908 that contact the right pin 2560. The fastener (e.g. bolt) that secures the crush arm clamp 3900 to the flap 3100 biases the prongs 3904 toward the attachment section 3102 and biases the pads 3908 onto the right pin 2560. This action clamps/tightens the fit around the right pin 2560. The legs 3906 abut the top and bottom of the right handle 2530 and thereby keep the crush arm clamp 3900 properly positioned on the flap 3100. The transition between the prongs 3904 and the legs 3906 at the bend can be done in a variety of ways, two of which are shown in FIG. 40.

The legs 3906 can be slightly longer than needed to reach the right pin 2560. The longer the legs 3906, the more the prongs 3904 will flex once the pads 3908 contact the right pin 2560 as the fastener through the clamp fastener opening 3902 is further tightened. The more flex, the greater the clamp force that will be exerted on the right pin 2560. Hence, the length of the legs 3906 can be selected to achieve a desired clamp force. The crush arm clamp 3900 may be made of carbon steel, stainless steel, aluminum or the like, and the pads 3908 may include a wear portion/pad.

In an example embodiment, optional female threaded prong adjustment holes 3920 are disposed at an end of each prong 3904 opposite the clamp fastener opening 3902. A set screw (not shown) can be installed in each prong adjustment hole 3920. Once the fastener through the clamp fastener opening 3902 is fully tightened, a maximum clamp force is exerted on the right pin 2560. After the set screw is sufficiently threaded into the prong adjustment hole 3920 and contacts the attachment section 3102, further turning of the set screw will move the respective, flexible prong 3904 away from the attachment section 3102. This, in turn, adjusts/reduces an amount of force exerted by the pads 3908 on the right pin 2560. Hence, an amount of clamp force exerted on the right pin 2560 by the pads 3908 can be individually adjusted/controlled via the optional female threaded prong adjustment holes 3920 and set screws.

Figure 41:
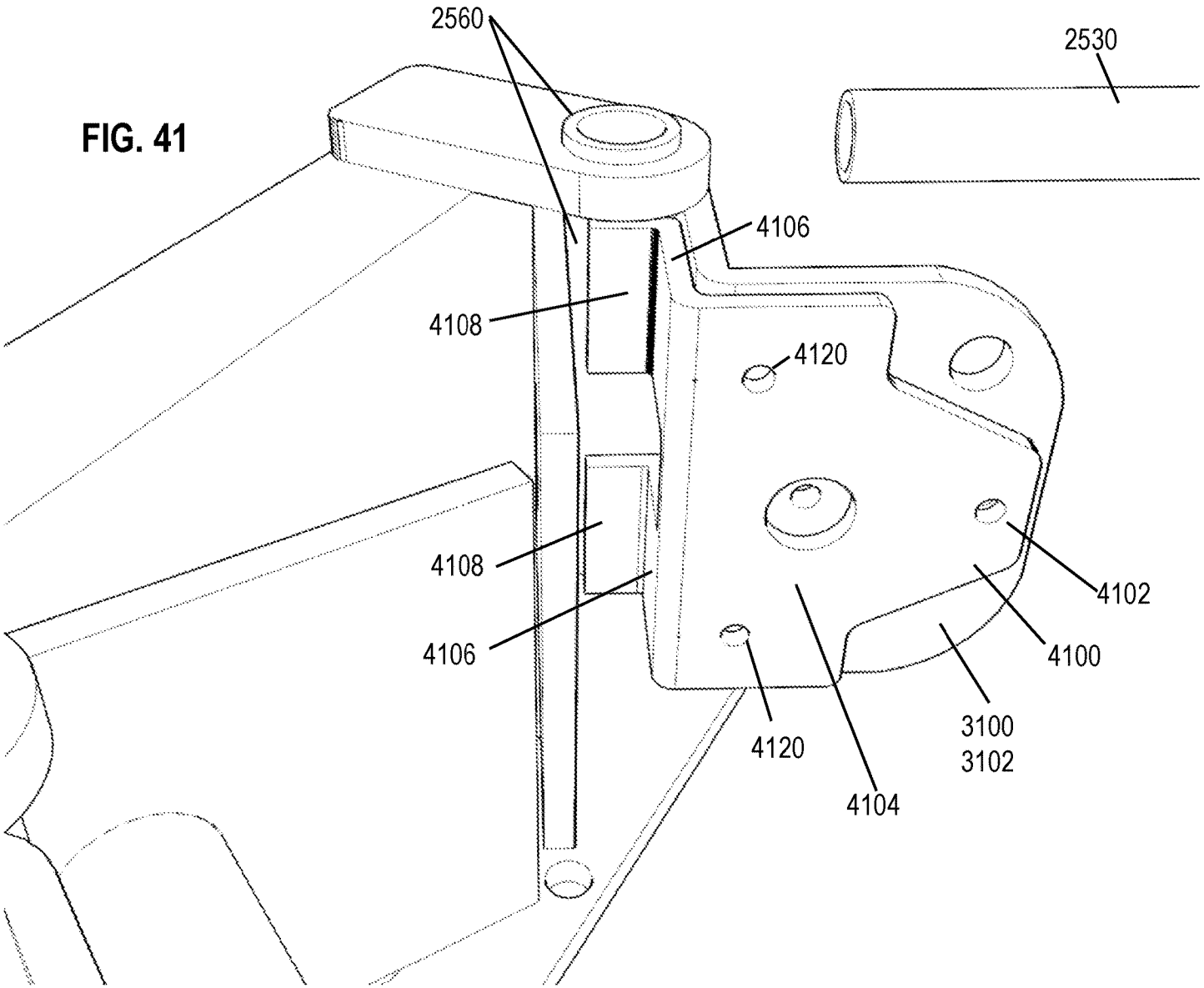
FIG. 41 and FIG. 42 show another alternate example embodiment of a crush arm clamp.
Figure 42:
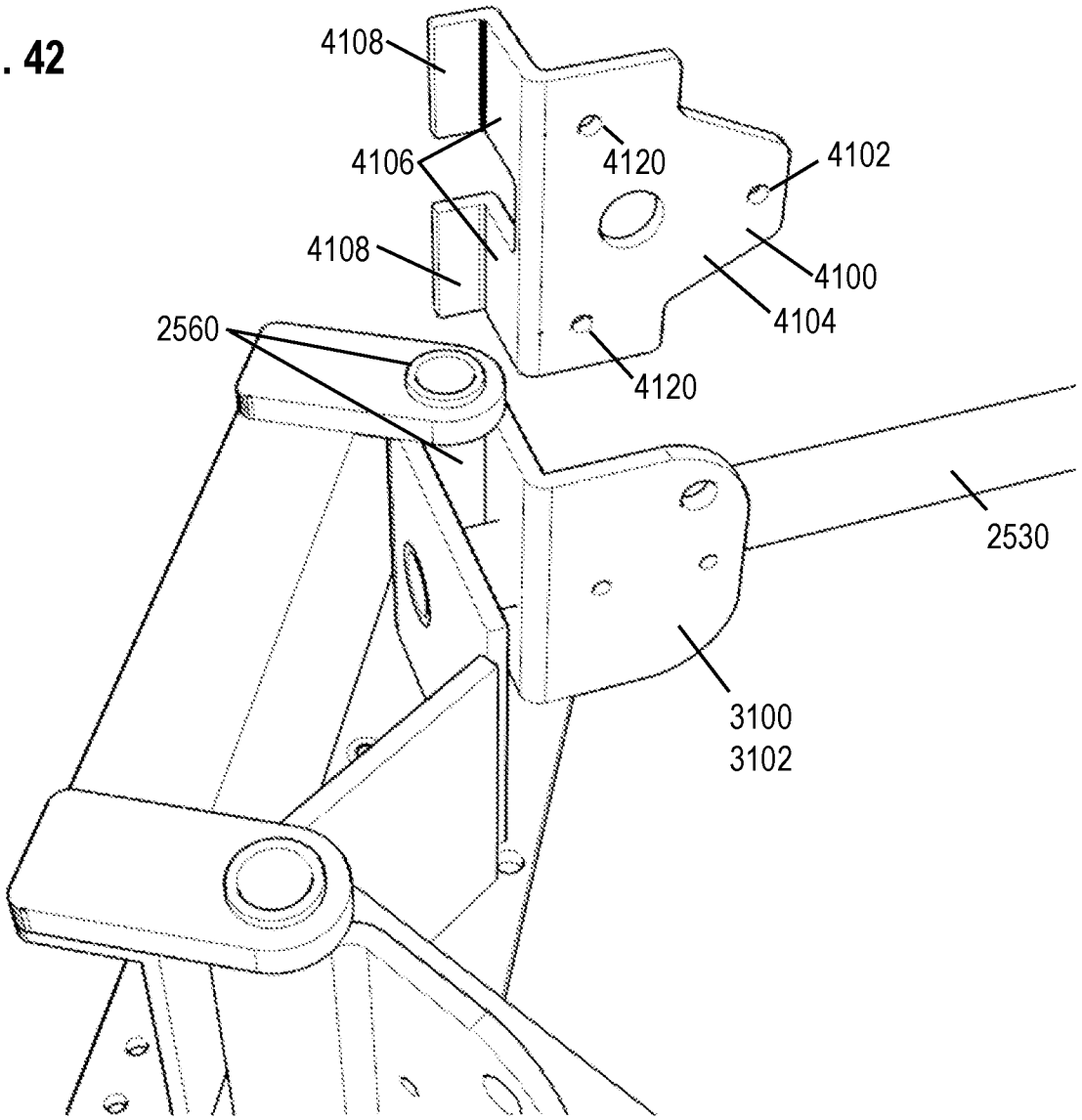

FIG. 41 and FIG. 42 show another alternate example embodiment of a crush arm clamp 4100 securing the right handle 2530 with the flap 3100 to the right pin 2560. This crush arm clamp 4100 operates using many of the same principles as crush arm clamp 3900. In this embodiment, a fastener such as a bolt is installed through a clamp fastener opening 4102 and secured, for example, via a bolt through the right handle 2530. The crush arm clamp 4100 includes a plate 4104, legs 4106, and pads 4108 that contact the right pin 2560. The fastener (e.g. bolt) that secures the crush arm clamp 4100 to the flap 3100 biases the plate 4104 toward the attachment section 3102 and biases the pads 4108 onto the right pin 2560. This action clamps/tightens the fit around the right pin 2560. The legs 4106 abut the top and bottom of the right handle 2530 and thereby keep the crush arm clamp 4100 properly positioned on the flap 3100.

The legs 4106 can be slightly longer than needed to reach the right pin 2560. The longer the legs 4106, the more the plate 4104 will flex once the pads 4108 contact the right pin 2560 as the fastener through the clamp fastener opening 4102 is further tightened. The more flex, the greater the clamp force that will be exerted on the right pin 2560. Hence, the length of the legs 4106 can be selected to achieve a desired clamp force. The crush arm clamp 4100 may be made of carbon steel, stainless steel, aluminum or the like, and the pads 4108 may include a wear portion/pad.

In an example embodiment, optional female threaded plate adjustment holes 4120 are disposed at an end of the plate 4104 opposite the clamp fastener opening 4102. A set screw (not shown) can be installed in each plate adjustment hole 4120. Once the fastener through the clamp fastener opening 4102 is fully tightened, a maximum clamp force is exerted on the right pin 2560. After the set screw is sufficiently threaded into the plate adjustment hole 4120 and contacts the attachment section 3102, further turning of the set screw will move the respective, flexible plate 4104 away from the attachment section 3102. This, in turn, adjusts/reduces an amount of force exerted by the pads 4108 on the right pin 2560. Hence, an amount of clamp force exerted on the right pin 2560 by the pads 4108 can be individually adjusted/controlled via the optional female threaded plate adjustment holes 4120 and set screws.

Figure 43:
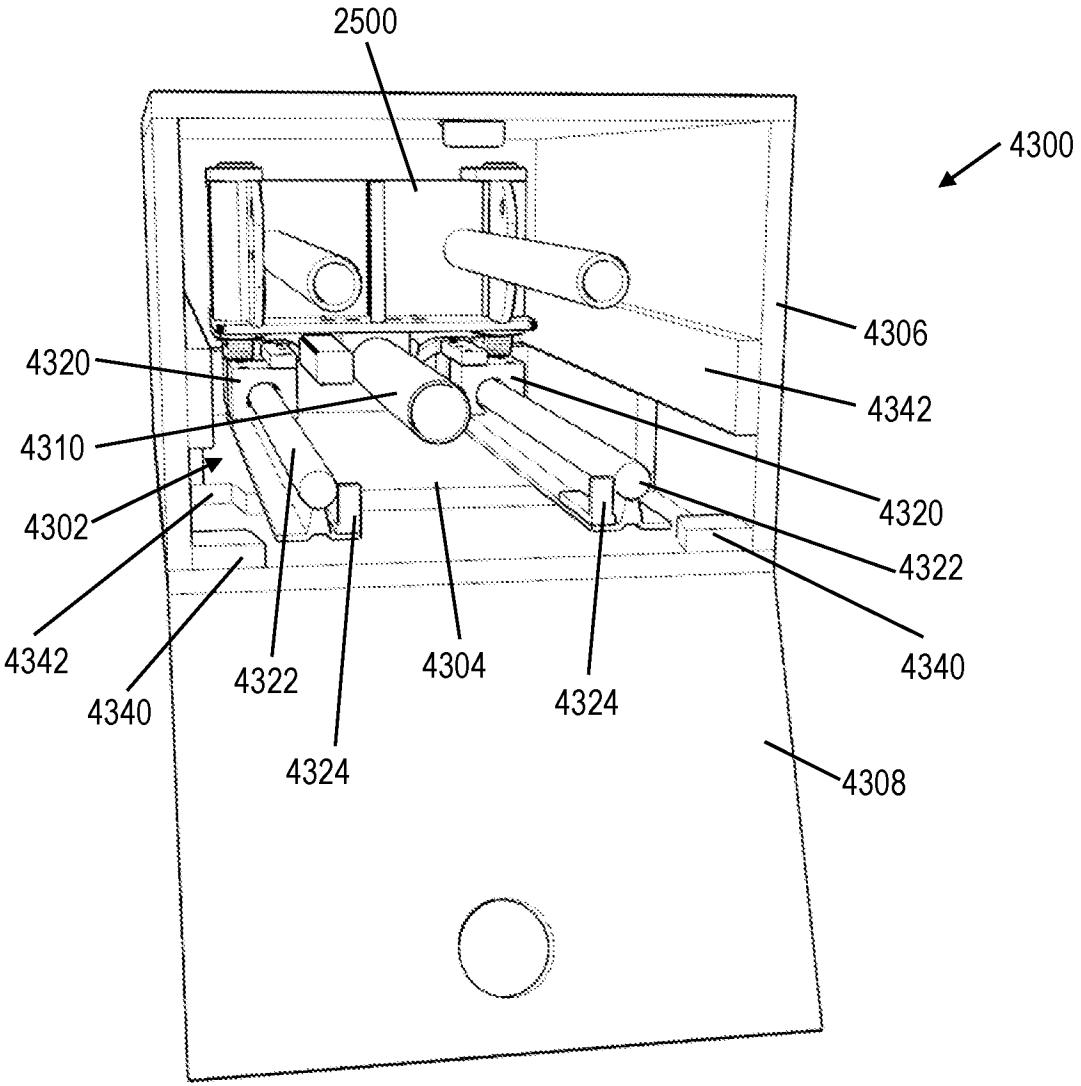
FIG. 43 to FIG. 50 show an example embodiment of a combination mount and storage arrangement for the can crusher.
Figure 44:
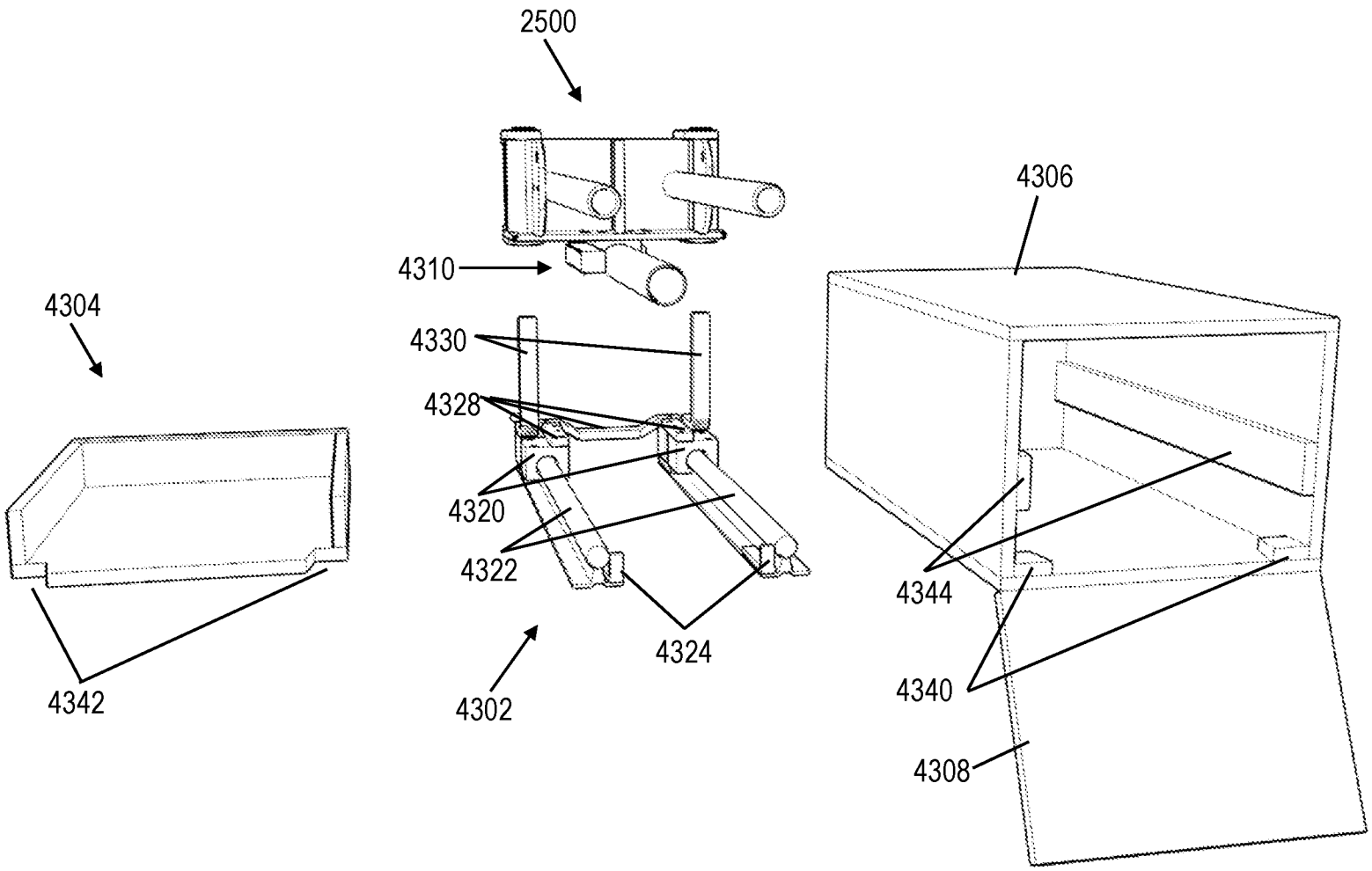
Figure 45:
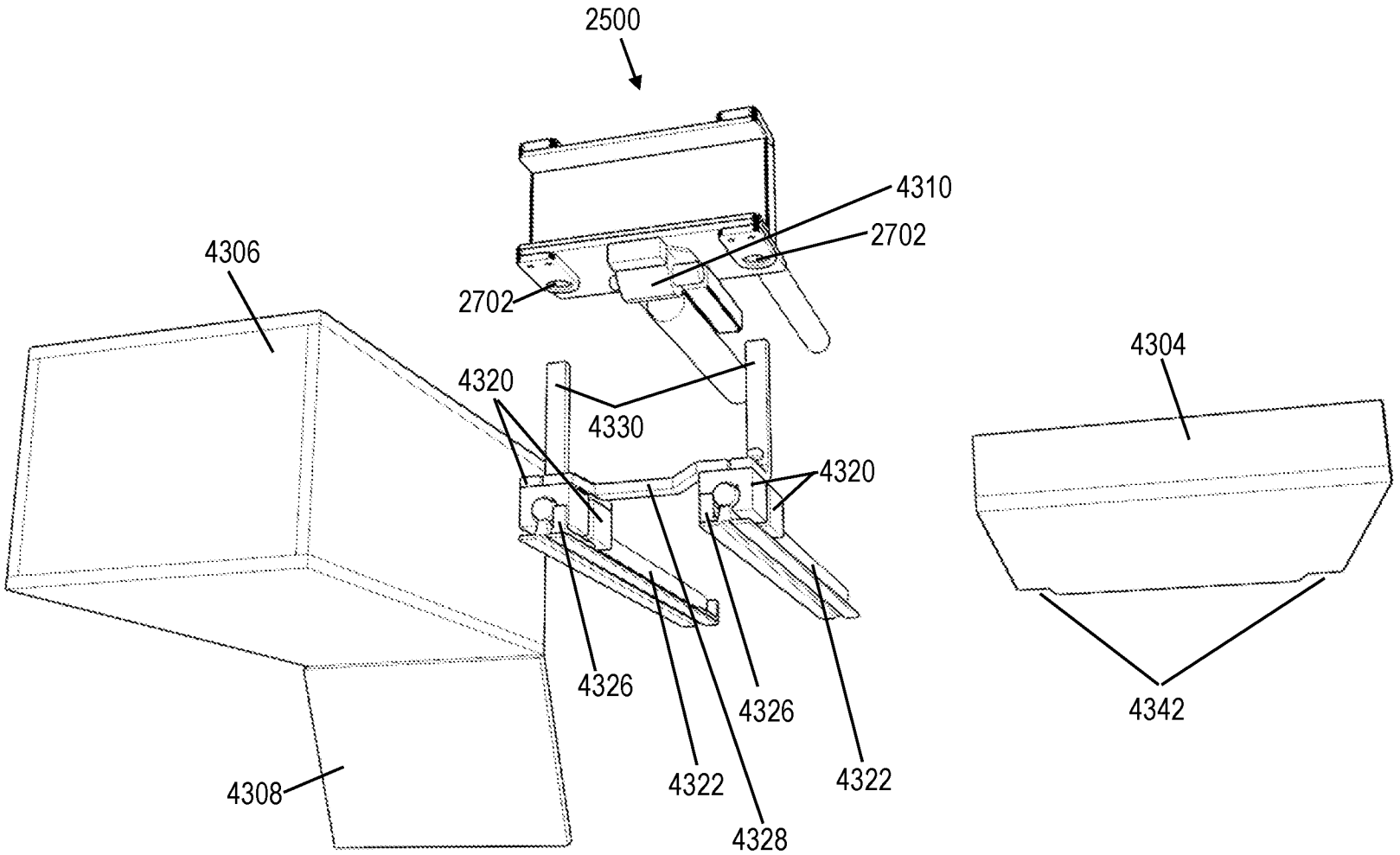
Figure 46:
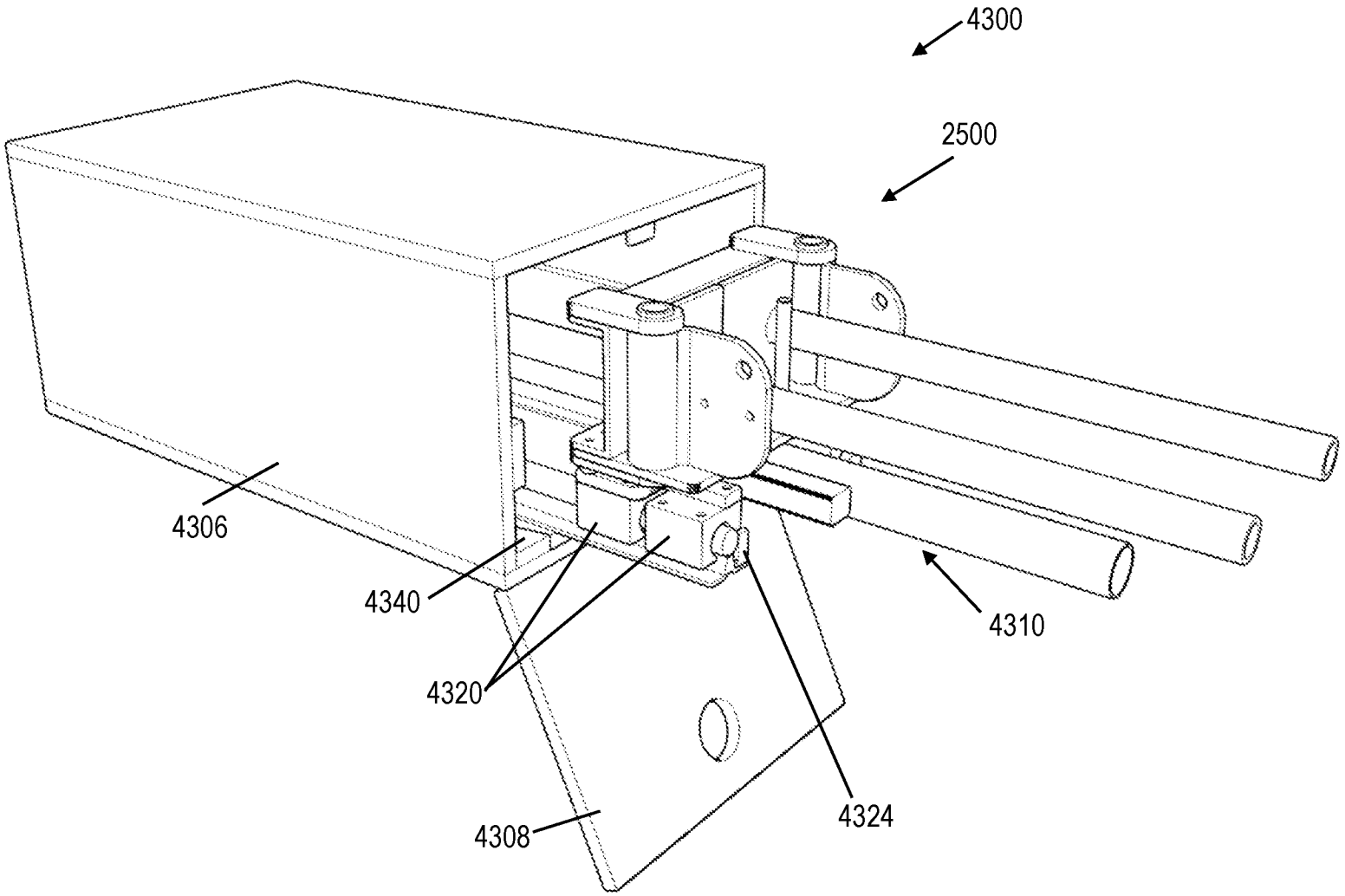
Figure 47:
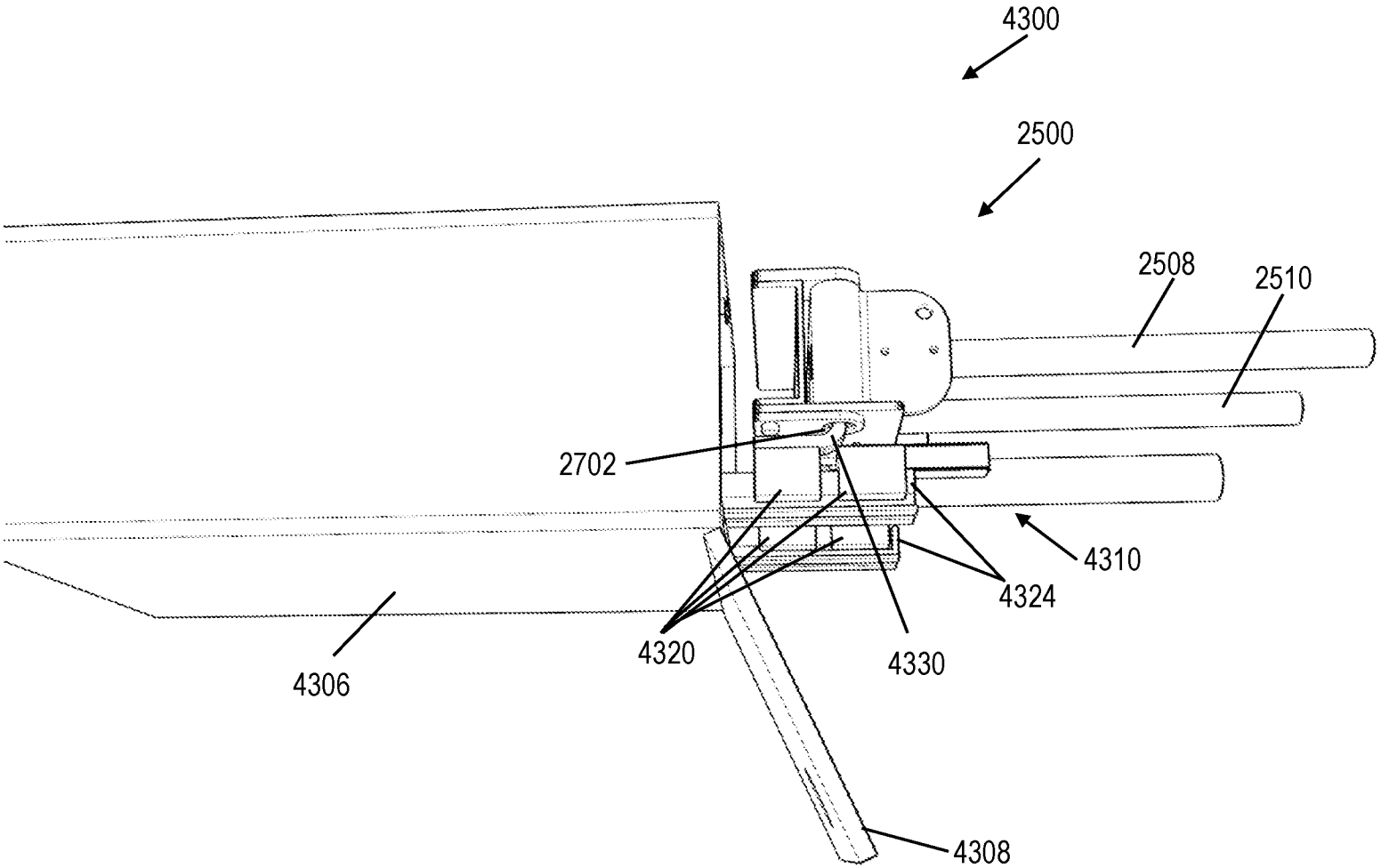
Figure 48:
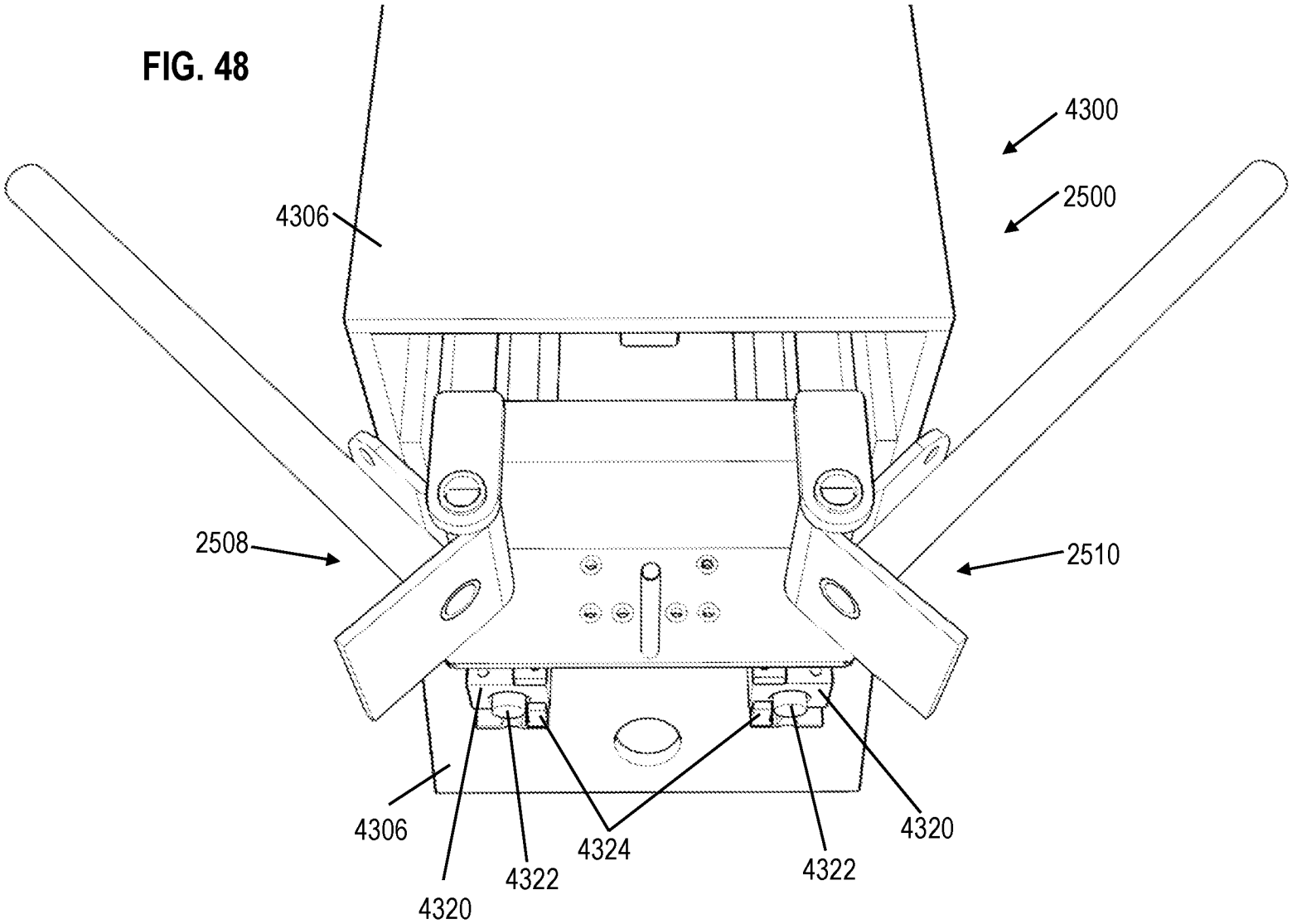
Figure 49:
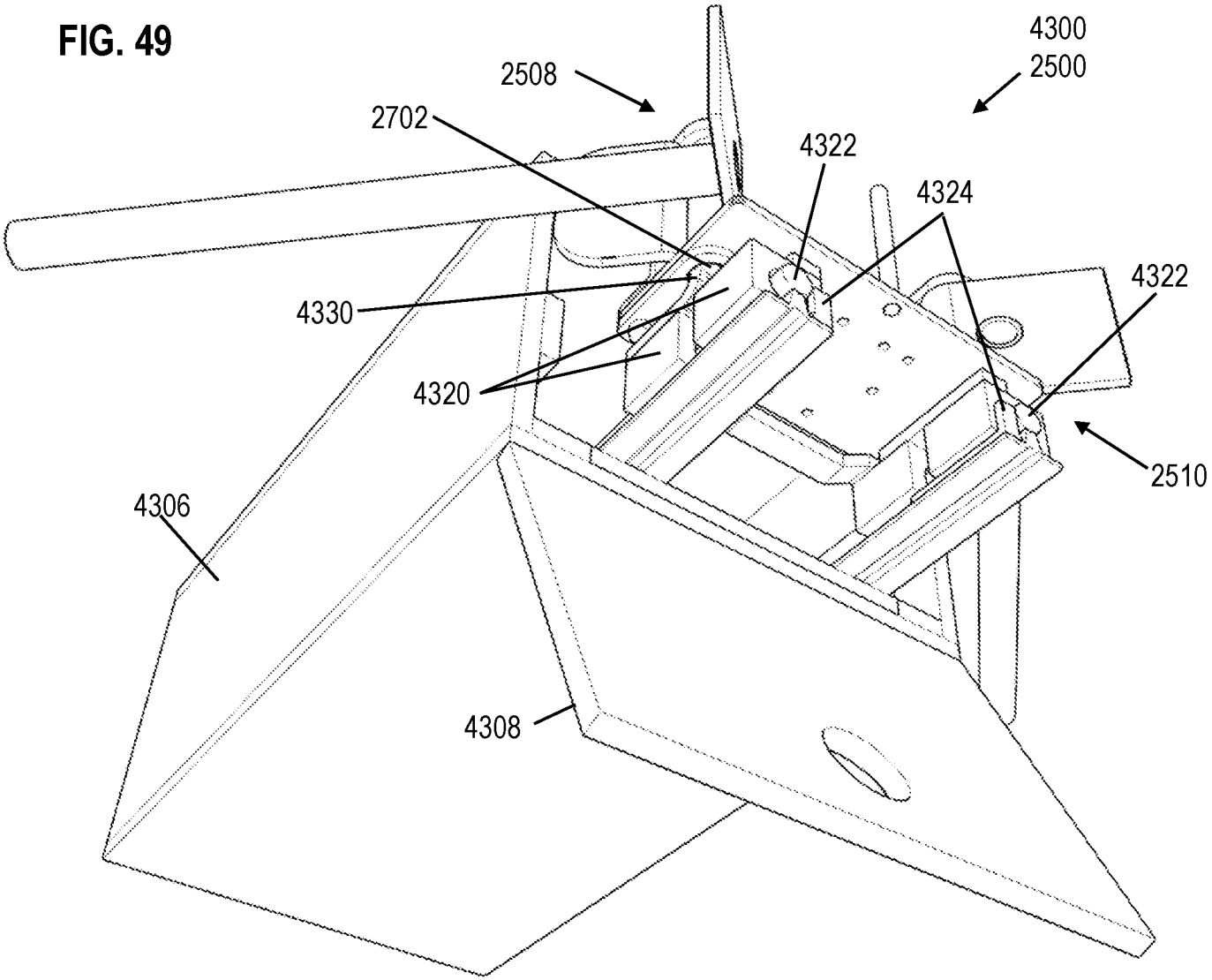
Figure 50:
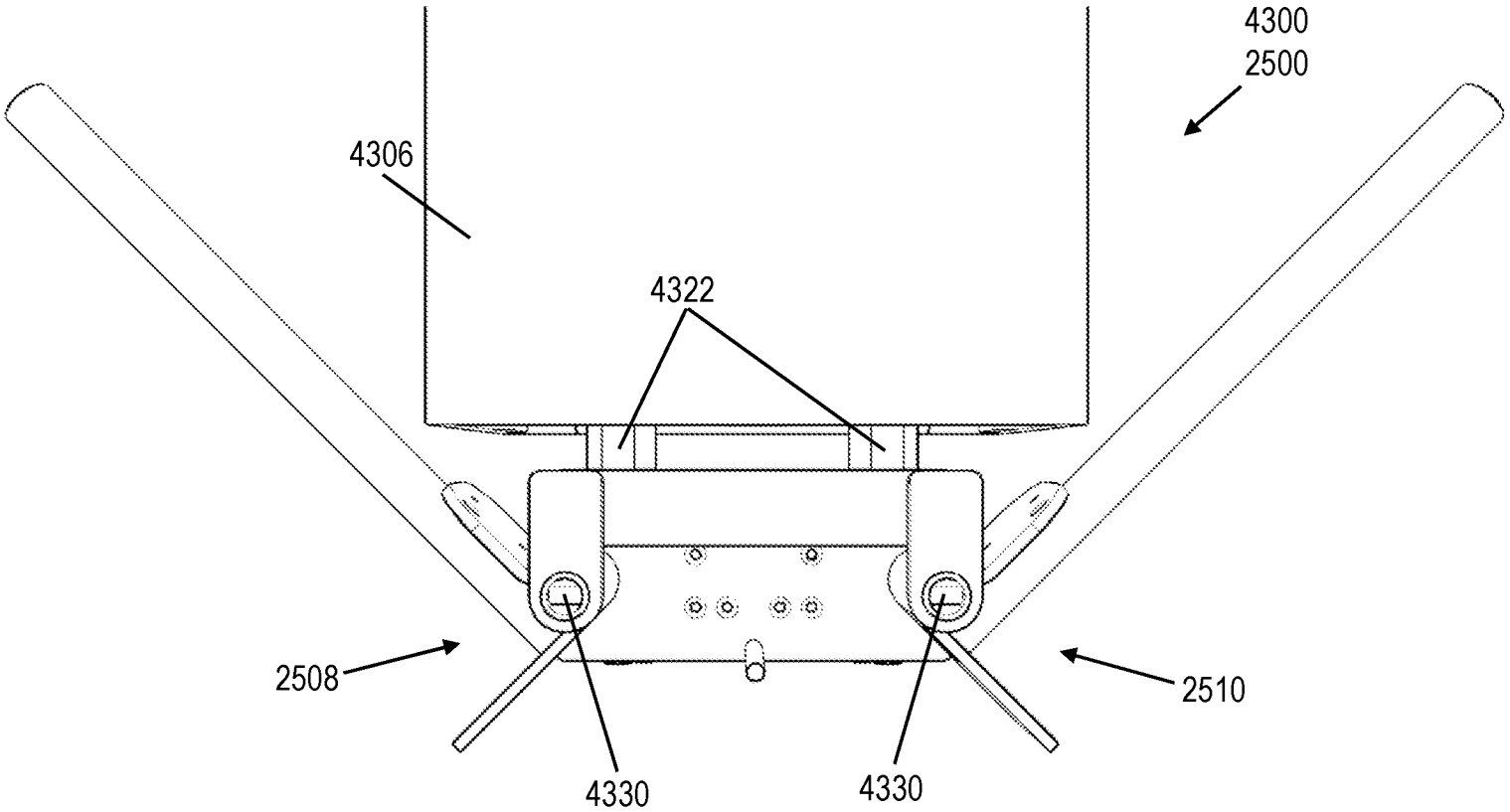

FIG. 43 to FIG. 50 show an example embodiment of a combination mount and storage arrangement 4300 for the can crusher 2500. FIG. 43 shows the combination mount and storage arrangement 4300 with the can crusher 2500 in a stowed configuration. In the stowed configuration, the can crusher is fully retracted on a track arrangement 4302. The track arrangement 4302 is disposed on a sliding shelf 4304 which is fully retracted in a cabinet 4306. In this configuration, a cabinet door 4308 can be closed so the can crusher 2500 is stored and out of sight. Example uses for the combination mount and storage arrangement 4300 include installation as, for example, a drawer in a boat or a drawer in an outdoor kitchen etc. As can be seen in FIG. 43 to FIG. 47, the combination mount and storage arrangement 4300 is configured to hold the can crusher 2500 even when the mount 4310 is still secured to the can crusher 2500. This enables a user to transfer the can crusher 2500 and mount 4310 from use in a fishing rod holder to the combination mount and storage arrangement 4300 without having to remove the mount 4310. As seen in FIG. 48 to FIG. 50, the can crusher 2500 can also be stored without the mount 4310 attached.

The track arrangement 4302 includes blocks 4320 that slide along rails 4322 until reaching front stops 4324 at the front of the rails 4322 and rear stops 4326 at the back of the rails 4322. Connector bars 4328 interconnect the blocks 4320. Posts 4330 are secured to the blocks 4320 and provide a mount for the can crusher by extending into the mounting recess 2702 in the pins 2540, 2560. As such, the can crusher 2500 can be lowered onto the track arrangement 4302 and lifted off the track arrangement 4302 by simply aligning the posts 4330 with the pins 2540, 2560.

The track arrangement 4302 is installed on the sliding shelf 4304. The sliding shelf is configured to slide in and out of the cabinet 4306. Shelf stops 4340 cooperate with notches 4342 in the sliding shelf 4304 to provide a positive stop for a fully extended position. Shelf rails 4344 hold the sliding shelf 4304 in position against a weight of the can crusher 2500 when the sliding shelf 4304 is fully extended.

FIG. 47 to FIG. 50 show the combination mount and storage arrangement 4300 with the can crusher 2500 in an extended configuration. In the extended configuration, the can crusher 2500 can be placed on or removed from the posts 4330. In addition, in the extended configuration, the can crusher 2500 can be used to crush cans. This is because the combination mount and storage arrangement 4300 positions the can crusher 2500 sufficiently far in front of the cabinet 4306 to permit the crush arms 2508, 2510 to swing through a fully range of motion necessary to crush a can.

Figure 51:
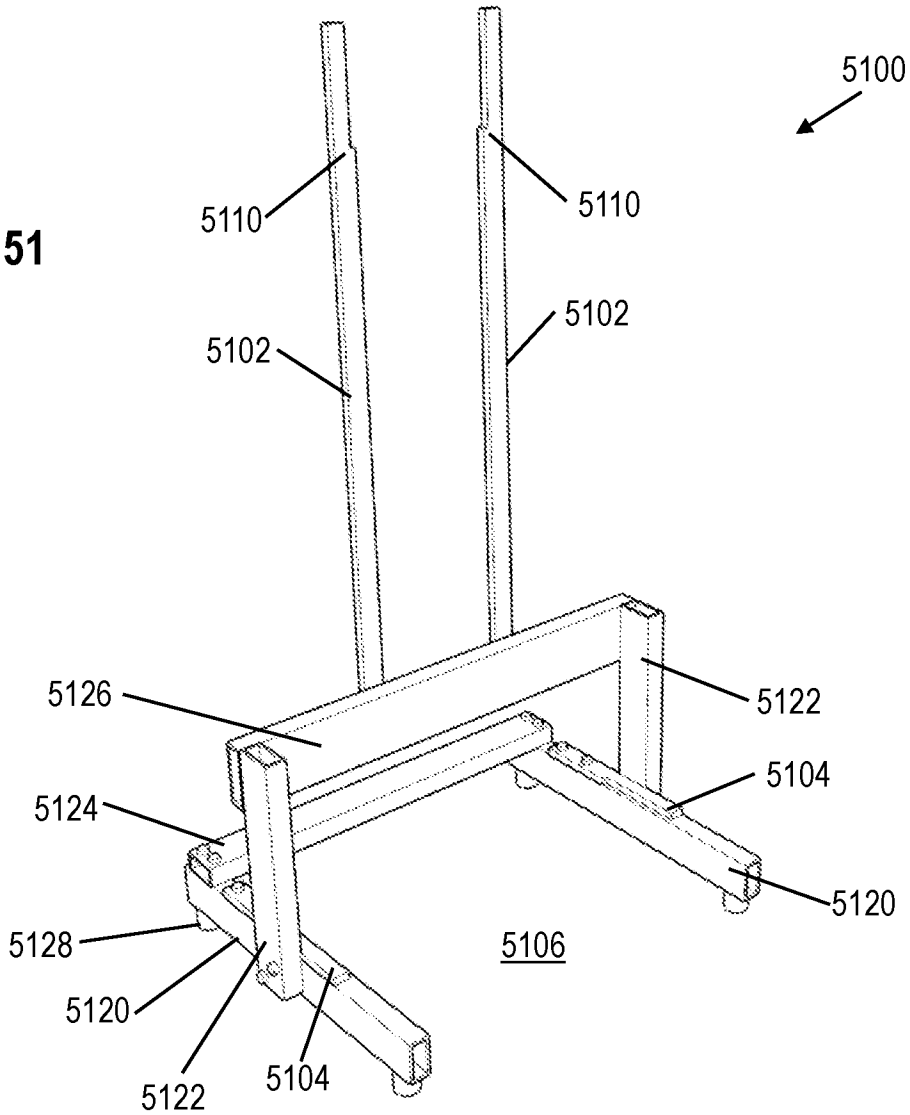
FIG. 51 to FIG. 55 show an example embodiment of a stand for the can crusher.
Figure 52:
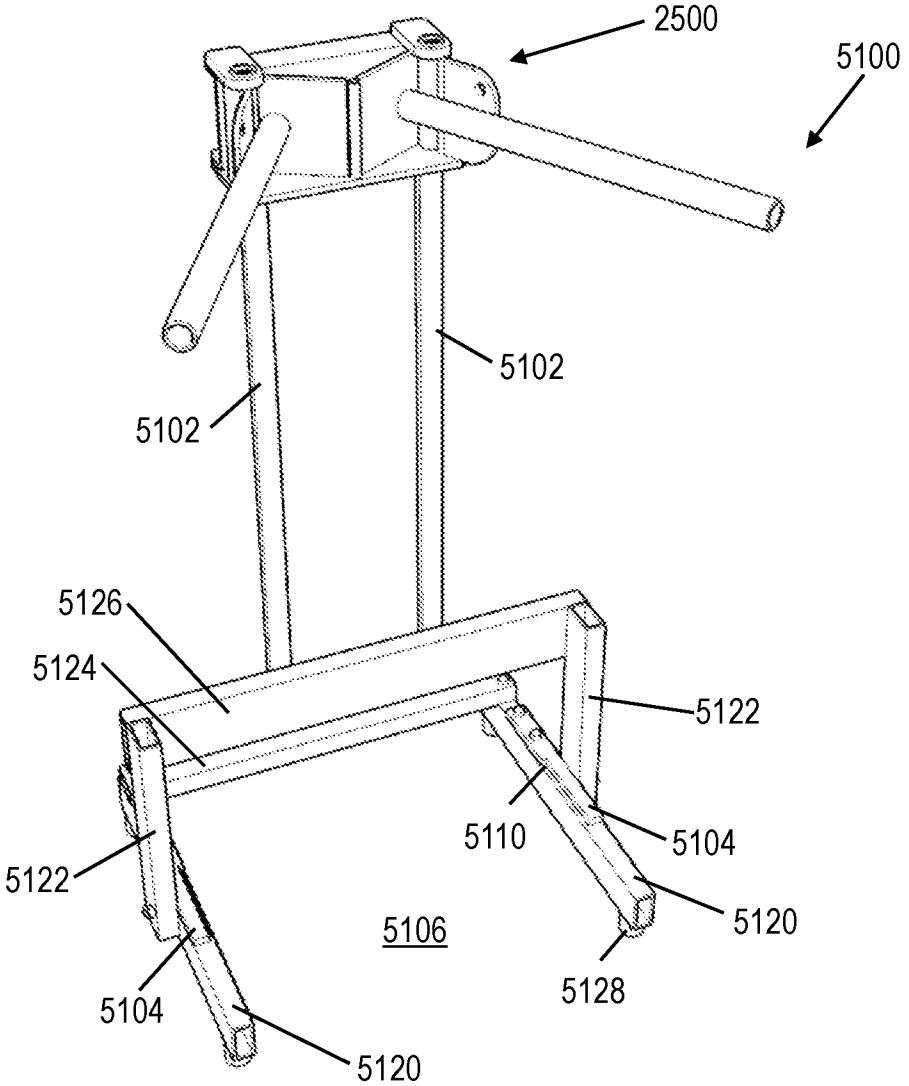
Figure 53:
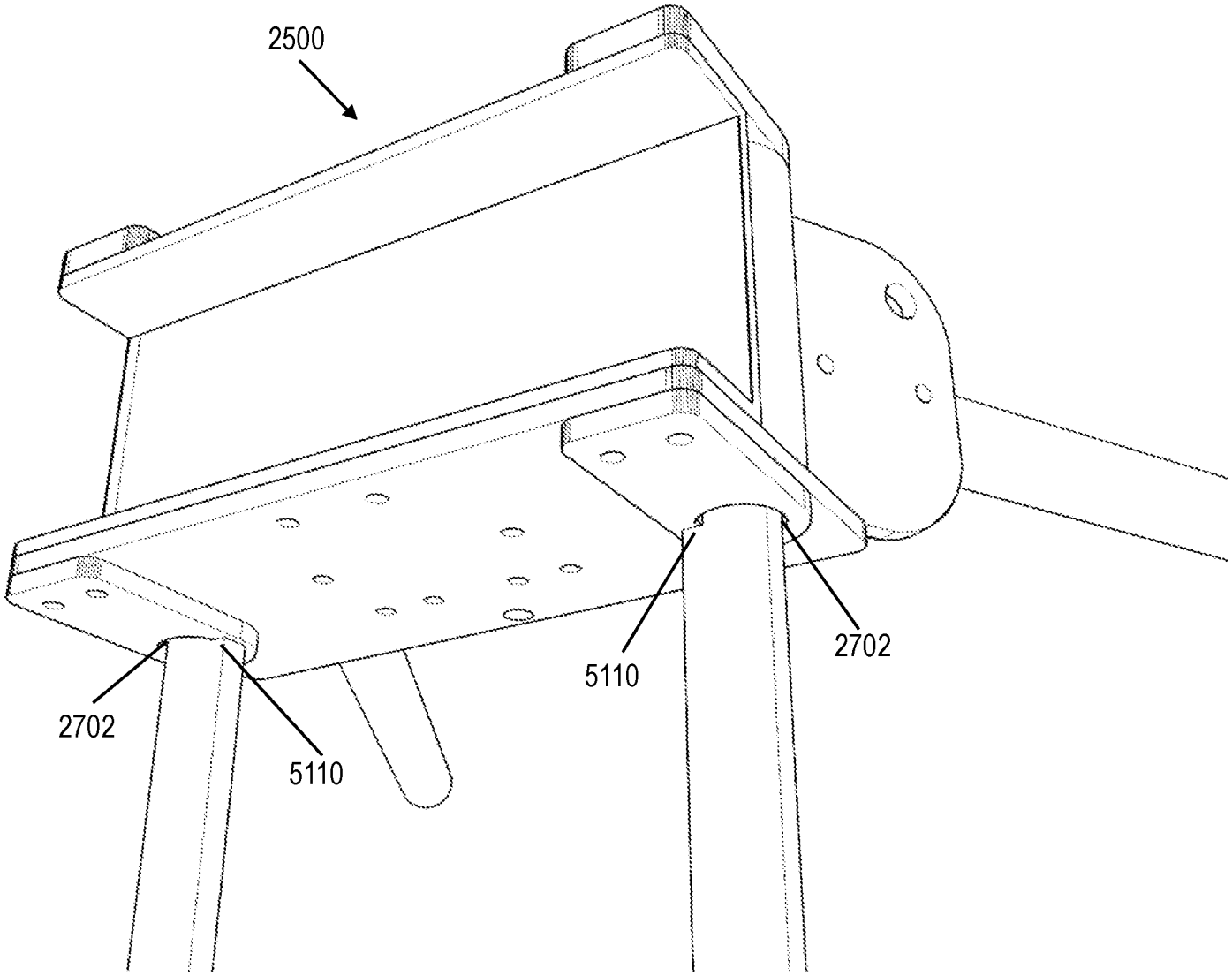
Figure 54:
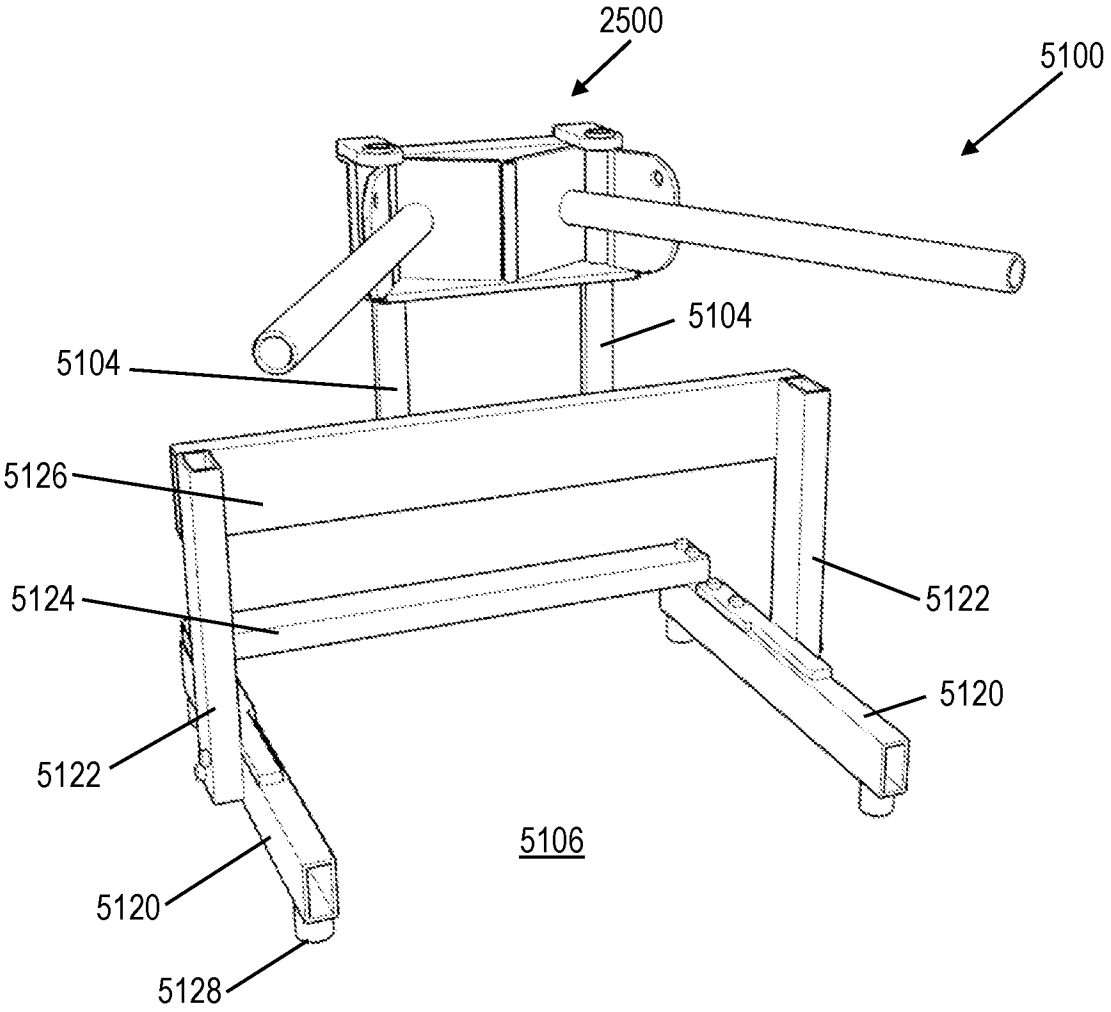
Figure 55:
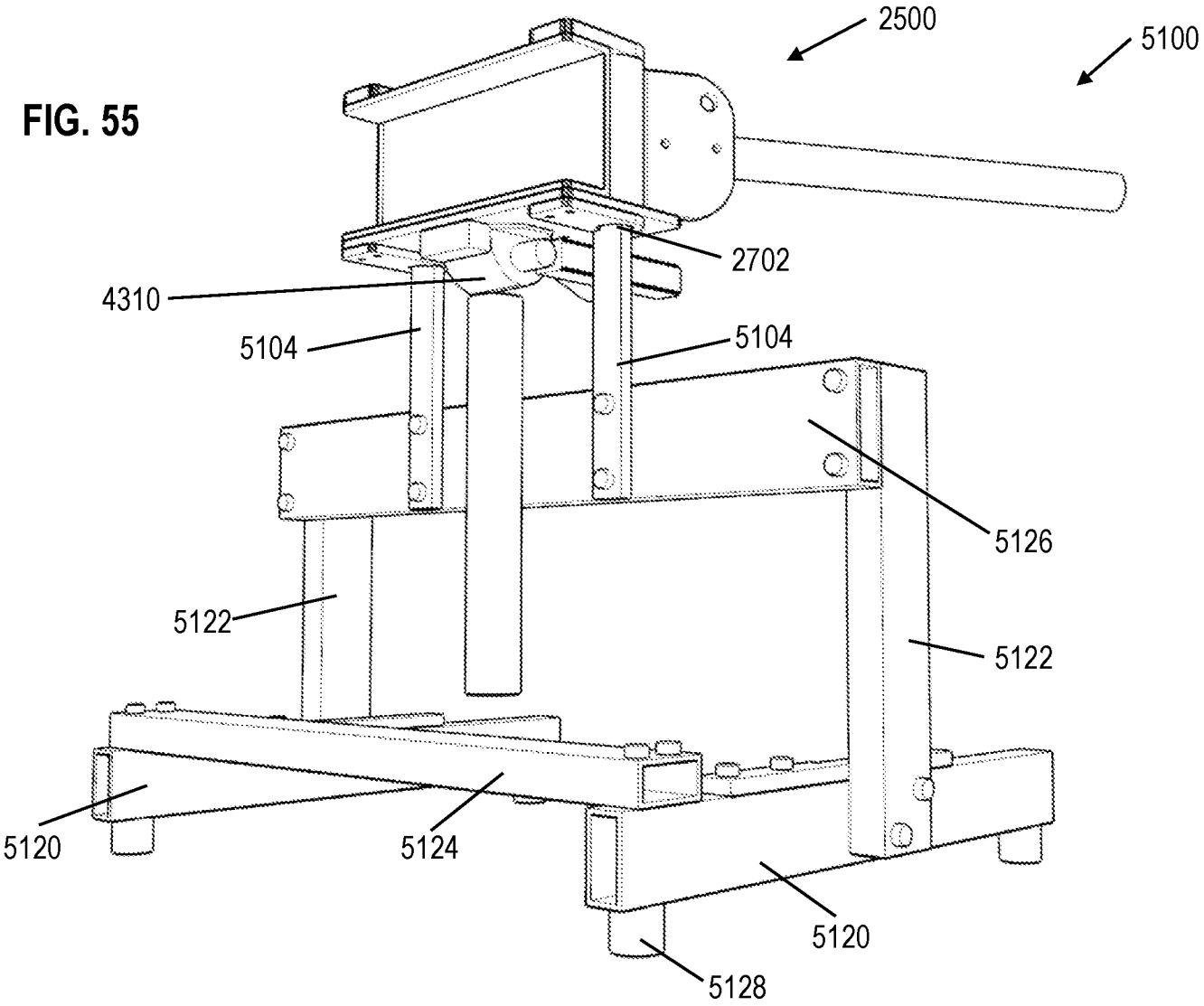

FIG. 51 to FIG. 55 show an example embodiment of a stand 5100 for the can crusher 2500. FIG. 51 to FIG. 52 show the stand 5100 with tall posts 5102 installed. The tall posts 5102 are suitable for positioning the can crusher 2500 for use by a user who is standing but not bent over. FIG. 53 to FIG. 55 shows the stand with short posts 5104 installed. The stand 5100 is sized so that most small coolers can fit in an area 5106 defined by the stand 5100. The short posts 5104 are suitable for use by a user who is bent over, for example when retrieving another drink from a cooler disposed in the area 5106. In an example embodiment, both the tall posts 5102 and the short posts 5104 have a ledge 5110 and acts as a stop on which the can crusher 2500 can rest when installed on the posts 5102, 5104. However, cross pins through the posts 5102, 5104 can act as a stop. Alternately, the top of the pins 2540, 2560 can be closed/capped (see e.g. the example embodiment of FIG. 19 to FIG. 23) and the tops of the pins (or the caps) 2540, 2560 can rest on the tops of the posts 5102, 5104.

The stand 5100 includes lower beams 5120, vertical beams 5122, a lower cross beam 5124, an upper cross beam 5126 to which the posts 5102, 5104 are secured, and optional feet 5128. The short posts 5104 can be secured to the lower beams 5120 for storage. The posts 5102, 5104, are configured to fit into the mounting recesses 2702.

As can be seen in FIG. 55, the can crusher 2500 can be placed on the stand 5100 when the short posts 5104 are installed even when the mount 4310 is still secured to the can crusher 2500. Likewise, the can crusher 2500 can also be placed on the stand 5100 when the long posts 5102 are installed even when the mount 4310 is still secured to the can crusher 2500. This enables a user to transfer the can crusher 2500 and mount 4310 from use in a fishing rod holder to the stand 5100 without having to remove the mount 4310. As seen in FIG. 51 to FIG. 54, the can crusher 2500 can also be placed on the stand 5100 without the mount 4310 attached.

As has been described above, the inventor has created a novel and innovate can crusher, combination mount and storage arrangement, and stand. The can crusher crushes cans without transferring forces to the mount. Further, when the fishing rod holder mount is installed, the can crusher can be moved among the fishing rod holder, the combination mount and storage arrangement, and the stand without removing the fishing rod holder mount, which provides significant freedom it its use and storage. Hence, this represents an improvement in the art.

While various embodiments of the present invention have been shown and described herein, it will be obvious that such embodiments are provided by way of example only. Numerous variations, changes and substitutions may be made without departing from the invention herein. Aspects of each embodiment are interchangeable and can be mixed and matched. Accordingly, it is intended that the invention be limited only by the spirit and scope of the appended claims.

The invention claimed is:

1. An apparatus comprising a can crusher, the can crusher comprising:

a backing plate;

a left crush-arm pivotally secured to the backing plate and comprising a left crush surface that faces the backing plate when the can crusher is in a closed configuration and a left handle that extends transverse relative to the left crush surface;

a right crush-arm pivotally secured to the backing plate and comprising a right crush surface that faces the backing plate when in the closed configuration and a right handle that extends transverse relative to the right crush surface;

a support plate, wherein in a vertical orientation of the can crusher: the backing plate is oriented vertically; the support plate is disposed below a horizontal sweep of the left crush surface and below a horizontal sweep of the right crush surface; and the support plate is effective to support a can in between the left crush surface and the right crush surface when the can crusher is in an open configuration; and a left pivot pin and a right pivot pin, wherein the left crush-arm comprises a left flap that comprises the left crush surface and which pivots around the left pivot pin, wherein the right crush-arm comprises a right flap that comprises the right crush surface and which pivots around the right pivot pin, and wherein the left flap is cantilevered from the left pivot pin, the right flap is cantilevered from the right pivot pin.

2. The apparatus of claim 1, wherein the can crusher further comprises a retaining pin, wherein when the can crusher is in the vertical orientation the retaining pin is secured to and extends vertically upward from the support plate, is outside the horizontal sweep of the left crush surface and outside the horizontal sweep of the right crush surface, is configured to trap the can between the retaining pin and the backing plate.

3. The apparatus of claim 2, wherein a distance between the backing plate and the retaining pin is less than 2 and ⅝ inches (2.625").

4. The apparatus of claim 1, further comprising an elongated base configured to support the can crusher, wherein the elongated base comprises a diameter of not greater than two inches (2") and is configured to fit within and be held in place by a fishing rod holder.

5. The apparatus of claim 4, further comprising an adjustable pivot joint between the elongated base and the can crusher configured to permit adjustment of an angular position of the can crusher relative to a position of the elongated base.

6. The apparatus of claim 1, wherein the left flap and the right flap are configured to flex when crushing a can.

7. The apparatus of claim 1, wherein the left crush-arm further comprises a left stop configured to abut the left flap after a predetermined amount of flex of the left flap, and wherein the right crush-arm further comprises a right stop configured to abut the right flap after a predetermined amount of flex of the right flap.

8. The apparatus of claim 7, wherein the left stop is further configured to resiliently bias the left flap onto the left pivot pin and the right stop is further configured to resiliently bias the right flap onto the right pivot pin.

9. The apparatus of claim 1, wherein the left handle traps the left pivot pin into the left flap to form a left pivot joint and the right handle traps the right pivot pin into the right flap to form a right pivot joint.

10. The apparatus of claim 1, wherein the left pivot pin and the right pivot pin each comprise a mounting recess at a bottom end of the respective pivot pin.

11. An apparatus comprising a can crusher, the can crusher comprising:

a backing plate;

a left crush-arm pivotally secured to the backing plate and comprising a left crush surface that faces the backing plate when the can crusher is in a closed configuration and a left handle that extends transverse relative to the left crush surface;

a right crush-arm pivotally secured to the backing plate and comprising a right crush surface that faces the backing plate when in the closed configuration and a right handle that extends transverse relative to the right crush surface; and a retaining pin, wherein in a vertical orientation of the can crusher the backing plate and the retaining pin are oriented vertically, wherein the retaining pin is disposed outside a horizontal sweep of the left crush surface and outside a horizontal sweep of the right crush surface, and wherein the retaining pin is configured to trap a can between the retaining pin and the backing plate when the can crusher is in an open configuration;

a left pivot pin and a right pivot pin, wherein the left crush-arm comprises a left flap that comprises the left crush surface and which pivots around the left pivot pin, wherein the right crush-arm comprises a right flap that comprises the right crush surface and which pivots around the right pivot pin, and wherein the left flap is cantilevered from the left pivot pin, the right flap is cantilevered from the right pivot pin.

12. The apparatus of claim 11, further comprising a support plate, wherein in the vertical orientation: the support plate is disposed not more than ⅛" below the horizontal sweep of the left crush surface and not more than ⅛" below the horizontal sweep of the right crush surface; and is effective to support the can in a crush position, and wherein the retaining pin is secured to the support plate.

13. The apparatus of claim 11, wherein when the left crush surface and the right crush surface are parallel to the backing plate, a gap between the left crush surface and the backing plate and between the right crush surface and the backing plate is between 3/16" and 5/16".

14. The apparatus of claim 11, wherein the left flap and the right flap are configured to yield by flexing when crushing a can.

15. The apparatus of claim 11, wherein the left crush-arm further comprises a left stop configured to abut the left flap after a predetermined amount of flex of the left flap, and wherein the right crush-arm further comprises a right stop configured to abut the right flap after a predetermined amount of flex of the right flap, wherein the left stop is further configured to resiliently bias the left flap onto the left pivot pin to form a left pivot joint and the right stop is further configured to resiliently bias the right flap onto the right pivot pin to form a right pivot joint.

16. The apparatus of claim 11, wherein the left handle traps the left pivot pin into the left flap to form a left pivot joint and the right handle traps the right pivot pin into the right flap to form a right pivot joint.

17. The apparatus of claim 11, wherein the retaining pin remains stationary as the can crusher transitions from the open configuration to the closed configuration.

18. The apparatus of claim 12, wherein in the vertical orientation and in the open configuration the apparatus defines an access through which a sideways-oriented can is lowered from above the can crusher until reaching a crush position between the backing plate and the retaining pin.

19. An apparatus comprising a can crusher, the can crusher comprising:

a backing plate;

a left crush-arm pivotally secured to the backing plate and comprising a left crush surface that faces the backing plate when the can crusher is in a closed configuration and a left handle that extends transverse relative to the left crush surface;

a right crush-arm pivotally secured to the backing plate and comprising a right crush surface that faces the backing plate when in the closed configuration and a right handle that extends transverse relative to the right crush surface;

a support plate, wherein in a vertical orientation of the can crusher: the backing plate is oriented vertically; the support plate is disposed below a horizontal sweep of the left crush surface and below a horizontal sweep of the right crush surface; and the support plate is effective to support a can in between the left crush surface and the right crush surface when the can crusher is in an open configuration;

an elongated base configured to support the can crusher, wherein the elongated base comprises a diameter of not greater than two inches (2") and is configured to fit within and be held in place by a fishing rod holder; and an adjustable pivot joint between the elongated base and the can crusher configured to permit adjustment of an angular position of the can crusher relative to a position of the elongated base.

* * * * *